US010080428B2

(12) United States Patent
Kern

(10) Patent No.: US 10,080,428 B2
(45) Date of Patent: Sep. 25, 2018

(54) DEVICE AND METHOD FOR CLEANSING AND TREATING SKIN

(71) Applicant: NSE Products, Inc., Provo, UT (US)

(72) Inventor: Dale G. Kern, Hyde Park, UT (US)

(73) Assignee: NSE Products, Inc., Provo, UT (US)

( * ) Notice: Subject to any disclaimer, the term of this patent is extended or adjusted under 35 U.S.C. 154(b) by 110 days.

(21) Appl. No.: 14/825,316

(22) Filed: Aug. 13, 2015

(65) Prior Publication Data

US 2016/0045081 A1 Feb. 18, 2016

Related U.S. Application Data

(60) Provisional application No. 62/036,785, filed on Aug. 13, 2014.

(51) Int. Cl.

| | |
|---|---|
| ***A46B 13/02*** | (2006.01) |
| ***A47K 7/04*** | (2006.01) |
| ***A46B 5/00*** | (2006.01) |
| ***A46B 13/00*** | (2006.01) |
| ***A46D 1/00*** | (2006.01) |
| ***A61H 7/00*** | (2006.01) |

(52) U.S. Cl.

CPC ..... *A46B 13/02* (2013.01); *A46B 5/0095* (2013.01); *A46B 13/008* (2013.01); *A46D 1/0238* (2013.01); *A47K 7/043* (2013.01); *A61H 7/003* (2013.01); *A46B 2200/102* (2013.01); *A61H 2201/12* (2013.01); *A61H 2201/1223* (2013.01); *A61H 2201/1678* (2013.01); *A61H 2205/022* (2013.01)

(58) Field of Classification Search

CPC . A46B 13/02; A46B 13/023; A46B 2200/102; A46B 13/008; A46D 1/02; A46D 1/0284; A46D 1/0269; A47K 7/043; A61H 7/003

USPC ..... 15/21.1–28, 188

See application file for complete search history.

(56) References Cited

U.S. PATENT DOCUMENTS

| | | | |
|---|---|---|---|
| 1,913,462 | A | 6/1933 | Timar |
| 2,480,023 | A | 8/1949 | Holden |
| 2,682,675 | A | 7/1954 | Prucha |
| 2,764,773 | A | 10/1956 | Wise |

(Continued)

FOREIGN PATENT DOCUMENTS

| | | |
|---|---|---|
| DE | 1757913 A1 | 6/1971 |
| DE | 20103026 | 8/2001 |

(Continued)

OTHER PUBLICATIONS

Face Scrub Brush & Anti Aging Skin Care | LUNA™ by FOREO downloaded from https://www.foreo.com/luna, 5 pages, Jan. 21, 2016.

(Continued)

*Primary Examiner* — Laura C Guidotti

(74) *Attorney, Agent, or Firm* — Dorsey & Whitney LLP

(57) ABSTRACT

A cleansing device for mammalian skin includes a cleansing head having a plurality of elastomeric cleansing features extending away from the first surface and having an aspect ratio of about 1:5 to 10:1. The cleansing head is attached to a handle adapted to apply oscillating movement to one or more cleansing head sections to provide a total displacement per oscillation of about 2 mm to 8 mm at a frequency of about 5 Hz to 30 Hz.

25 Claims, 28 Drawing Sheets

(56) References Cited

U.S. PATENT DOCUMENTS

| | | | | |
|---|---|---|---|---|
| 3,906,940 | A | 9/1975 | Kawada | |
| 3,968,789 | A | 7/1976 | Simoncini | |
| 4,027,348 | A | 6/1977 | Flowers | |
| 4,249,521 | A | 2/1981 | Gueret | |
| D262,672 | S | 1/1982 | Chase | |
| 4,343,265 | A | 8/1982 | Belschner | |
| 4,463,485 | A | 8/1984 | Gueret | |
| D285,131 | S | 8/1986 | Wilkeson | |
| D321,434 | S | 11/1991 | Strickler | |
| 5,176,130 | A | 1/1993 | Kim | |
| D333,730 | S | 3/1993 | Martin | |
| D333,922 | S | 3/1993 | Strickler | |
| 5,228,165 | A | 7/1993 | Westberry | |
| D342,319 | S | 12/1993 | Cheng | |
| D344,137 | S | 2/1994 | Yoo | |
| D351,947 | S | 11/1994 | Fitzgerald | |
| D357,322 | S | 4/1995 | Matthews | |
| D368,343 | S | 3/1996 | Gebhard | |
| D369,447 | S | 4/1996 | Mann | |
| D370,124 | S | 5/1996 | Chamieh | |
| D409,337 | S | 5/1999 | Johnson, Jr. | |
| 6,076,222 | A | 6/2000 | Jolly | |
| 6,267,736 | B1 | 7/2001 | Mccambridge | |
| D460,554 | S | 7/2002 | Park | |
| 6,424,862 | B1 | 7/2002 | Brown, III | |
| D462,483 | S | 9/2002 | Campbell | |
| 6,588,964 | B1 | 7/2003 | Au | |
| D479,336 | S | 9/2003 | La Bianco | |
| D485,990 | S | 2/2004 | Wallace | |
| D514,328 | S | 2/2006 | Huang | |
| D523,962 | S | 6/2006 | Huang | |
| 7,194,316 | B2 | 3/2007 | Bousfield | |
| D539,916 | S | 4/2007 | Baldachini | |
| D545,970 | S | 7/2007 | Eknoian | |
| D545,971 | S | 7/2007 | Eknoian | |
| D548,339 | S | 8/2007 | Stonier | |
| D555,407 | S | 11/2007 | Lan | |
| 7,320,691 | B2 * | 1/2008 | Pilcher | A61B 17/54 604/289 |
| D567,387 | S | 4/2008 | Nan | |
| 7,384,377 | B2 | 6/2008 | Berman | |
| 7,386,906 | B2 | 6/2008 | Roth | |
| 7,395,110 | B2 | 7/2008 | Hofmann | |
| D589,257 | S | 3/2009 | Van Wambeke | |
| 7,786,626 | B2 | 8/2010 | Reishus | |
| D636,933 | S | 4/2011 | Newman | |
| D646,795 | S | 10/2011 | Seehoff | |
| D661,811 | S | 6/2012 | Ferguson | |
| D671,281 | S | 11/2012 | Singer | |
| D682,497 | S | 5/2013 | Wargo | |
| 8,523,791 | B2 | 9/2013 | Castel | |
| D699,903 | S | 2/2014 | Singer | |
| 8,679,039 | B2 | 3/2014 | Tieu | |
| 8,745,807 | B2 | 6/2014 | Varner | |
| D711,656 | S | 8/2014 | Brewer | |
| D715,553 | S | 10/2014 | Brewer | |
| D720,933 | S | 1/2015 | Albers | |
| D726,418 | S | 4/2015 | Gruber | |
| 9,032,576 | B2 | 5/2015 | Zelickson et al. | |
| D734,949 | S | 7/2015 | Behnam | |
| D740,033 | S | 10/2015 | Gruber | |
| D749,325 | S | 2/2016 | Middendorp | |
| D753,399 | S | 4/2016 | Owen | |
| D753,400 | S | 4/2016 | Khoun | |
| 9,301,657 | B2 * | 4/2016 | Miller | A47K 7/04 |
| D768,391 | S | 10/2016 | Kling | |
| D778,064 | S | 2/2017 | Owen | |
| D778,065 | S | 2/2017 | Kern | |
| D778,066 | S | 2/2017 | Kern | |
| D781,588 | S | 3/2017 | Lee | |
| D782,197 | S | 3/2017 | Kern | |
| D795,593 | S | 8/2017 | Huang | |
| D796,212 | S | 9/2017 | Thornton | |
| D797,461 | S | 9/2017 | Dandridge | |
| D803,572 | S | 11/2017 | Nichols | |
| 2005/0059914 | A1 | 3/2005 | Kleinhenz | |
| 2005/0113725 | A1 | 5/2005 | Masuda | |
| 2005/0142093 | A1 | 6/2005 | Skover | |
| 2005/0277950 | A1 | 12/2005 | Pilcher | |
| 2005/0278877 | A1 | 12/2005 | Akridge | |
| 2006/0010630 | A1 | 1/2006 | Tse | |
| 2006/0058714 | A1 | 3/2006 | Rhoades | |
| 2006/0276731 | A1 | 12/2006 | Thiebaut | |
| 2007/0142845 | A1 | 6/2007 | Akridge | |
| 2007/0179412 | A1 | 8/2007 | Imboden | |
| 2008/0005860 | A1 | 1/2008 | Niizaki | |
| 2008/0119913 | A1 | 5/2008 | Powell | |
| 2008/0125682 | A1 | 5/2008 | Bonneyrat | |
| 2008/0167590 | A1 | 7/2008 | Jon | |
| 2008/0222822 | A1 | 9/2008 | Cobabe et al. | |
| 2008/0295268 | A1 | 12/2008 | Lei | |
| 2009/0198159 | A1 | 8/2009 | Linzell | |
| 2009/0318853 | A1 | 12/2009 | Reed | |
| 2010/0217357 | A1 | 8/2010 | Da Silva | |
| 2010/0262051 | A1 | 10/2010 | De Laforcade | |
| 2011/0118655 | A1 | 5/2011 | Fassih | |
| 2011/0184499 | A1 | 7/2011 | Radi | |
| 2011/0251537 | A1 | 10/2011 | Yeo | |
| 2012/0121313 | A1 | 5/2012 | Thiebaut | |
| 2012/0165708 | A1 | 6/2012 | Parsloe | |
| 2012/0165710 | A1 | 6/2012 | Nichols | |
| 2012/0209151 | A1 | 8/2012 | Zhou | |
| 2013/0023805 | A1 | 1/2013 | Ungemach | |
| 2013/0023806 | A1 | 1/2013 | Ungemach | |
| 2013/0046212 | A1 | 2/2013 | Nichols | |
| 2013/0079689 | A1 | 3/2013 | Thierman | |
| 2015/0305487 | A1 | 10/2015 | Pardo | |
| 2015/0359324 | A1 | 12/2015 | Brewer | |
| 2016/0183670 | A1 | 6/2016 | Brewer | |
| 2016/0206087 | A1 | 7/2016 | Skidmore | |
| 2017/0049278 | A1 | 2/2017 | Thomassen | |
| 2017/0073050 | A1 | 3/2017 | Smith | |
| 2017/0112333 | A1 | 4/2017 | McCauley | |

FOREIGN PATENT DOCUMENTS

| | | |
|---|---|---|
| WO | 2003/075712 | 9/2003 |
| WO | 2009/136911 | 11/2009 |
| WO | 2013/077284 | 5/2013 |
| WO | 2013077284 A1 | 5/2013 |
| WO | 2013/132363 | 9/2013 |
| WO | 2013/132364 | 9/2013 |
| WO | 2014/024084 | 2/2014 |
| WO | 2014/118596 | 8/2014 |
| WO | 2014118596 A1 | 8/2014 |

OTHER PUBLICATIONS

The Moodie Report, "Clinique advocates 'fitness for the face' with new Sculptwear range", downloaded from https://www.moodiereport.com/document.php?doc_id=43808, 2 pages, published Sep. 6, 2015.

Proactiv Advertisement—Deep Cleansing Brush, https://www1.proactiv.com, 1 page, date unkown.

X Out Wash in Treatment—Acne Treatment for Teens I X Out™, downloaded from https://www.xout.com/specialoffer/, 1 page, Oct. 27, 2015.

International Search Report dated Jan. 15, 2016 for PCT/US2015/045040 filed Aug. 13, 2015, 22 pages.

International PCT Search Report and Written Opinion for Application No. PCT/US2016/046738 dated Dec. 1, 2016.

* cited by examiner

FIG. 2

| Design | Geometry | Feature 3D | Pattern | ISO |
|---|---|---|---|---|
| 1 Alpha Blade | | | | |
| 2 Alpha Latch | | | | |
| 3 Crested Wave Latch | | | | |
| 4 Alpha tipped Latch | | | | |
| 5 Alpha Latch Concentric Chase | | | | |
| 6 Blade Tipped Latch Chase | | | | |
| 7 Concentric Blades | | | | |
| 8 Inverting Mushroom | | | | |
| 9 Inter-links | | | | |
| 10 Non-inverting Mushroom | | | | |
| 11 Split Alpha Blades | | | | |

DEVICE AND METHOD FOR CLEANSING AND TREATING SKIN

CROSS-REFERENCE TO RELATED APPLICATIONS

This application claims priority to U.S. Provisional Patent Application No. 62/036,785, filed Aug. 13, 2014, which is incorporated by reference herein, in the entirety and for all purposes.

TECHNICAL FIELD

The invention is related to devices for cleansing and treating skin, particularly facial skin, and methods of using the devices for cleansing and treating skin.

BACKGROUND

Skin is the largest organ of the human body with several important functions, including forming a physical barrier to the environment, protection against micro-organisms, allowing and limiting the inward and outward passage of water and electrolytes, ultraviolent radiation and toxic agents. Within the skin there are three structural layers: the epidermis, the dermis and the subcutis. Keratinocytes are the main cell type found within the epidermis. Fibroblasts are the predominant cell type within the dermis. The dermis is composed of a supportive extracellular matrix and contains bundles of collagen which run parallel to the skin surface. The role of fibroblasts within the dermis is to produce collagen, elastin, and structural proteoglycans. The collagen fibers constitute 70% of the dermis, giving it strength and toughness while elastin provides normal elasticity and flexibility. The proteoglycans provide viscosity and hydration. Transforming growth factor β (TGF-β) is associated with the regulation of extracellular matrix production in human skin connective tissue. This factor is also of importance in the process of wound healing. Skin also is innervated and vascularized, and also contains small numbers of immune cells (e.g. mast cells, tissue macrophages, etc.).

Aging of human skin is associated with discoloration, wrinkling, and the sagging effect. These developments related to aging are dramatically visible in human skin which becomes dry, wrinkled, lax, and irregularly pigmented over time. Typically, aged skin is characterized by a flattening of the dermal-epidermal junction, increased atrophy, and a loss of elasticity of the dermal connective tissue. The loss of firmness and elasticity is commonly associated with the decrease/loss and disorganization of the major extracellular components, including collagen I (associated with being the primary cause of wrinkle formation), elastin, and large and small proteoglycans and glycosaminoglycans. Aging skin also possesses decreased TGF-β which results in reduced production of collagen and compromised wound healing. A histological analysis of aging in human skin has revealed a decrease in tissue thickness, disorganization of collagen, and accumulation of non-functional elastin.

Handheld skin cleansing devices are used for cosmetic purposes to efficiently cleanse facial skin. In some cases the devices claim additional benefits, such as exfoliation, smoothing/resurfacing, or deep cleaning. Such devices have one or more discrete electrically powered bristle brushes or nonwoven fabric pads that oscillate, vibrate, or a combination thereof to provide mechanical action of the brush(es) or pad(s) against the skin. Typically, a cleanser is applied to the bristles or the pad. Cleansing effectiveness of these devices depends on the bristle or pad type, pressure applied, and the type of cleanser.

One example of many is the SonicDermabrasion Facial Brush ST255, sold by PRETIKA® Corp. of Laguna Hills, Calif. The brush includes a handle and a round bristle brush head that rotates. Another example is the Pore Sonic Cleanser sold by Pobling of Seoul, South Korea, which includes an oblong brush that is vibrated. A further example is found in U.S. Patent Application Publication 2012/0233798 for BRUSHHEAD FOR ELECTRIC SKIN BRUSH APPLIANCE, published Sep. 20, 2012. Another example is the MIA 1®, MIA 2®, and MIA 3®, sold by CLARISONIC® of Redmond, Wash. A further example is the PRO X® Facial Brush by Procter & Gamble of Cincinnati, Ohio. Many examples similar to these are easily found in department stores, drug stores, and online.

Such rotating and/or vibrating heads provide cleaning action that is superior to the use of hands to clean one's face. However, the brushes and pads only reach the surface of the topmost layer of skin cells. Brush tips do not effectively reach the interstitial spaces between cells or other fine skin features where dirt or dead cells may be trapped, and thus do not effectively clean such spaces. Additionally, brushes tend to build up a combination of cleansers, dirt, bacteria, and dead skin cells at the base of the bristles that is difficult or impossible to clean off. Finally, brushes used for facial cleansing tend to lift, but not remove facial skin cells. Thus, brushes can actually have a skin roughening effect.

SUMMARY

Disclosed herein is a cleansing device including a handle; an electrical motor disposed within the handle and attached to an actuator, said motor and actuator adapted to apply an oscillating movement at a frequency of about 5 Hz to 30 Hz; and a substantially planar cleansing head having a first major surface and a second major surface and partitioned into two or more cleansing head sections, the first major surface comprising a plurality of elastomeric cleansing features extending away from the first surface and having an aspect ratio of about 1:5 to 10:1, wherein the actuator is attached to the second major surface of the cleansing head to apply oscillating movement to one or more cleansing head sections to provide a total displacement per oscillation of about 0.5 mm to 12 mm.

In some embodiments, the oscillation is a circular oscillation and at least one cleansing head section is circular or annular. In some embodiments, at least two cleansing head sections are adapted to counter-oscillate relative to each other. In some embodiments, the cleansing head first surface includes more than one cleansing feature shape, relative cleansing feature orientation, or both. In some embodiments, the elastomer is characterized by a fully reversible strain of about 5%-700%, Shore A hardness of about 10 to 50, and a coefficient of friction of about 0.25 to 0.75. In some embodiments, the cleansing features include a prismatic or frusto-prismatic shape having a base footprint of about 0.1 mm to 10 mm in the longest dimension, and a height of about 0.5 mm to 5 mm. In some embodiments, the elastomer includes one or more permanent or fugitive additives. In some such embodiments, the one or more permanent or fugitive additives include antibacterial compositions, abrasive compositions, cleansing or treatment compositions, or a combination thereof. In some embodiments, the total displacement is about 0.5 mm to 8 mm.

Also disclosed herein is a skin cleansing system including a device with a handle; an electrical motor disposed within the handle and attached to an actuator, said motor and actuator adapted to apply an oscillating movement at a frequency of about 5 Hz to 30 Hz; a substantially planar cleansing head having a first major surface and a second major surface and partitioned into two or more cleansing head sections, the first major surface comprising a plurality of elastomeric cleansing features extending away from the first surface and having an aspect ratio of about 1:5 to 10:1, wherein the actuator is attached to the second major surface of the cleansing head to apply oscillating movement to one or more cleansing head sections comprising a total relative displacement per oscillation of about 0.5 mm to 12 mm; and a cleanser selected from the group consisting of a liquid, dispersion, lotion, gel, serum, or solution that reduces a stick portion of the stick-slip action of a cleansing feature that has frictional contact with a skin surface during the oscillating movement of the cleansing head.

Additional advantages and novel features of the device will be set forth in part in the description that follows, and in part will become apparent to those skilled in the art upon examination of the following.

BRIEF DESCRIPTION OF THE DRAWINGS

FIG. 2 shows a number of exemplary cleansing feature shapes useful in conjunction with the cleansing device.

DETAILED DESCRIPTION

Figure 1B:
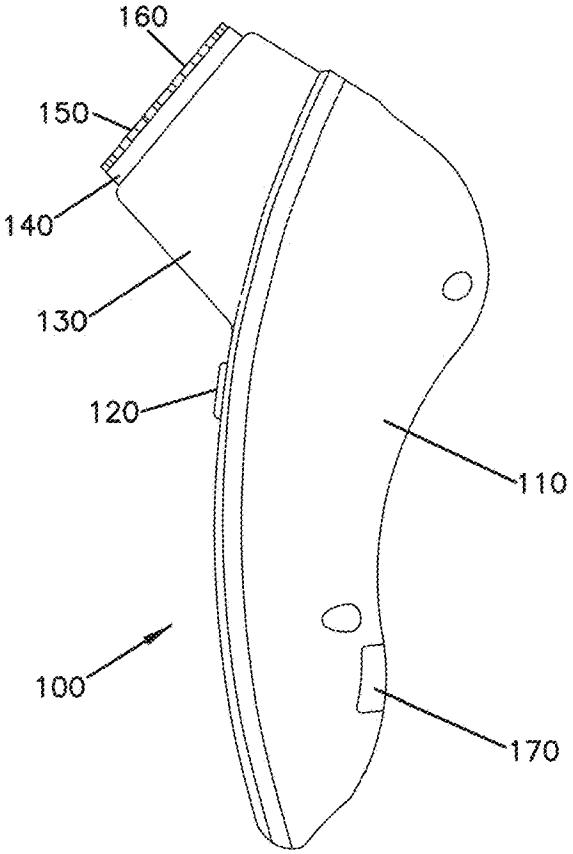
FIGS. 1A-1I depict several representative schematic views of a cleansing device and motion-generating sub-assemblies as described herein.

Although the present disclosure provides references to preferred embodiments, persons skilled in the art will recognize that changes may be made in form and detail without departing from the spirit and scope of the invention. Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Definitions

As used herein, the term "cleansing head" means an article having a first major surface and second major surface, wherein the first major surface has a plurality of cleansing features arranged thereon and the second surface is adapted to be attached at least to the actuator of a cleansing device. In some embodiments, the cleansing head includes two or more discrete cleansing head sections, each section including a plurality of cleansing features. In some such embodiments, one or more cleansing head sections are attached to the handle; provided that at least one cleansing head section is attached to be moved by an actuator. In some embodiments the cleansing head first major surface is substantially planar. In other embodiments, the cleansing head has a curvilinear or arcuate shape, including in some embodiments a hemispherical shape. In some embodiments the cleansing head is generally symmetrical; in other embodiments, the cleansing head includes one or more asymmetries or asymmetrical contours. In some embodiments, the cleansing head includes multiple arcuate shapes.

As used herein, the term "cleansing feature" means a protrusion attached to and extending away from the first major surface of a cleansing head in a direction generally perpendicular thereto. There are between 2 and 100 cleansing features per square centimeter of the first major surface. The cleansing features have an aspect ratio of 1:5 to 10:1 (width:height), wherein width, or x distance, is the longest dimension of the base (portion of the cleansing feature intersecting the first major surface of the cleansing head) and height, or y distance, is the distance between the base and the peak (portion of the cleansing feature furthest away from the first major surface). The cleansing features are elastic cleansing features, that is, they are formed from an elastomeric composition and are resiliently deformable to a degree. The shape of the cleansing features is not particularly limited. In some embodiments, more than one cleansing feature shape, relative cleansing feature orientation, or both is situated on a single cleansing head. In some embodiments, more than one cleansing feature shape, relative orientation, or both is situated on a single cleansing head section.

As used herein, the term "total displacement" means the maximum linear distance traveled by the movement of a first cleansing head section relative to a second, adjacent cleansing head section, as measured at two adjacent points, such as two points on opposed sided of their adjacent edges. In a sinusoidal oscillating movement, the displacement traveled at the peak of the amplitude is measured relative to a stationary adjacent cleansing head section to result in the total displacement. Where the adjacent stationary cleansing head section is also oscillating, the total displacement is a result of the combined movement of the sections.

As used herein, the term "handle" or "handle portion" means the portion of the cleansing device that fits in an average human grip in a manner that enables a user to urge the cleansing head of the device toward the user's face, and manipulate the device to slide the cleansing head across the facial surface. The handle further includes the motor and associated wiring, supports, and power input to facilitate the application of electrical power to the motor via DC or AC/DC. In some embodiments, the handle includes a switch for switching the electrical power to the motor or device control module on and off. In some embodiments the handle includes additional controls.

As used herein, the term "elastomer" or "elastomeric composition" means a thermoplastic or thermoset polymeric composition that has a fully reversible strain of about 5%-700%, a Shore A hardness of about 10 to 50, and a coefficient of friction against human facial skin of about 0.2 to 0.8, for example about 0.25 to 0.75. In some embodiments the elastomeric composition includes one or more fillers, crosslinks, or both. Examples of suitable polymers used in the elastomeric composition include silicone rubbers (polydiorganosiloxane), rubbery polyurethanes, styrene-butadiene rubber (SBR), butyl rubber (isobutylene-isoprene copolymer), natural or synthetic polyisoprene, nitrile rubber (butadiene-acrylonitrile rubber), rubbery polypropylene, EPDM (ethylene propylene diene copolymer), EPM (ethylene propylene copolymer), and others as well as blends and copolymers thereof.

As used herein, the term "electrical motor means a device powered by electricity for generating motion, whether rotary, reciprocal, orbital or otherwise that can be coupled directly or indirectly to a cleansing head or cleansing head section to cause it to move as described herein.

As used herein, the term "about" modifying, for example, the quantity of an ingredient in a composition, concentration, volume, process temperature, process time, yield, flow rate, pressure, and like values, and ranges thereof, employed in describing the embodiments of the disclosure, refers to variation in the numerical quantity that can occur, for example, through typical measuring and handling procedures used for making compounds, compositions, concentrates or use formulations; through inadvertent error in these procedures; through differences in the manufacture, source, or purity of starting materials or ingredients used to carry out the methods, and like proximate considerations. The term "about" also encompasses amounts that differ due to aging of a formulation with a particular initial concentration or mixture, and amounts that differ due to mixing or processing a formulation with a particular initial concentration or mixture. Where modified by the term "about" the claims appended hereto include equivalents to these quantities.

As used herein, the word "substantially" modifying, for example, the type or quantity of an ingredient in a composition, a property, a measurable quantity, a method, a position, a value, or a range, employed in describing the embodiments of the disclosure, refers to a variation that does not affect the overall recited composition, property, quantity, method, position, value, or range thereof in a manner that negates an intended composition, property, quantity, method, position, value, or range. Intended properties include, solely by way of nonlimiting examples thereof, elasticity, modulus, hardness, and shape; intended positions include position of a first cleansing feature relative to a second cleansing feature. Where modified by the term "substantially" the claims appended hereto include equivalents to these types and amounts of materials.

Cleansing Device

Disclosed herein is a cleansing device for cleansing the skin of a mammal, for example a person, the device including at least a handle; an electrical motor disposed within the handle and attached to an actuator, said motor and actuator adapted to apply an oscillating movement at a frequency of about 5 Hz to 30 Hz; and a cleansing head having a first major surface and second major surface, the first major surface comprising a plurality of elastomeric cleansing features, the cleansing features extending away from the first surface and having an aspect ratio of about 1:5 to 10:1 (width:height), wherein the cleansing head is partitioned into two or more cleansing head sections, and wherein the actuator is attached to the second major surface of the cleansing head to apply oscillating movement to one or more cleansing head sections, resulting in a total displacement per oscillation of about 0.5 mm to 8 mm.

Figure 1A:
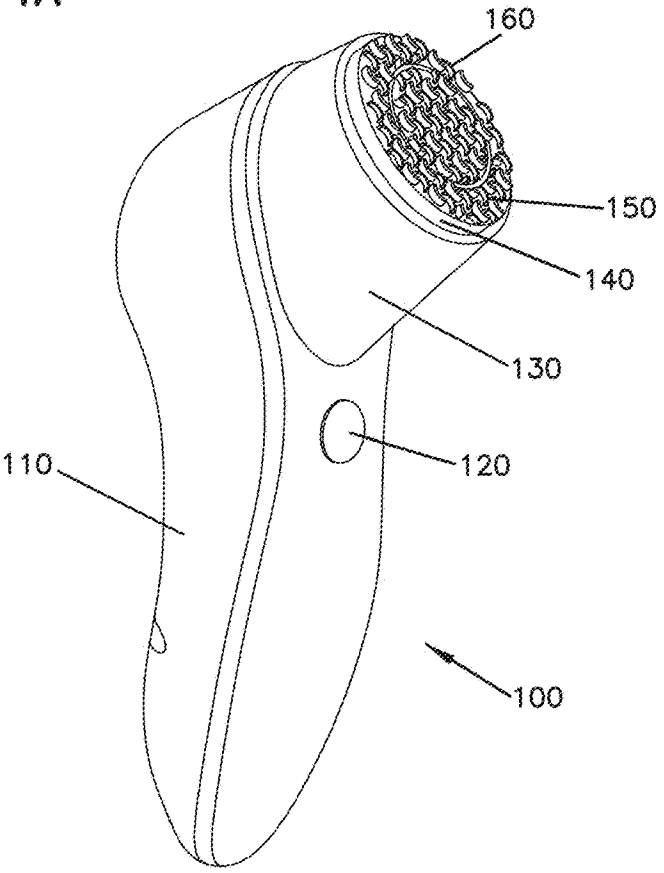

FIGS. 1A, 1B are representative views of one exemplary embodiment of a cleansing device. Cleansing device 100 is shown in FIG. 1A, wherein device 100 includes handle portion 110, on/off switch 120, and mounting portion 130 that positions and secures cleansing head 140. Cleansing head 140 first major surface 150 includes cleansing features 160. In various embodiments, handle portion 110 includes a motor (not shown) that actuates a selected motion of cleansing head 140 or a section thereof. Cleansing head 140 second major surface (not shown) is attached to an actuator (not shown) in a manner that facilitates the actuation of the oscillatory movement. FIG. 1B shows a recharging port 170, which is configured to receive a charger cable (not shown) for providing electricity, for example from a 120V wall plug, to a rechargeable battery device inside handle portion 110. The battery device provides electrical energy to the motor and control module that actuates movement of cleansing head 140 or one or more sections thereof.

Figure 1D:
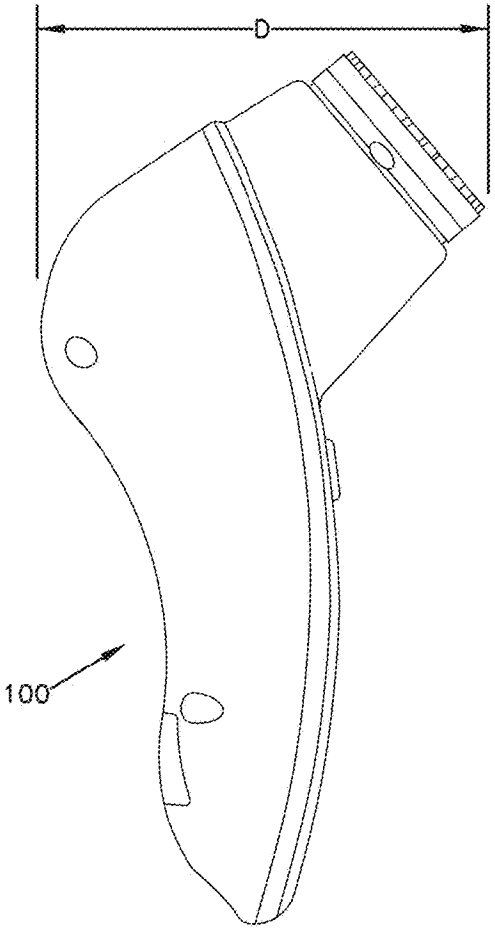
Figure 1C:
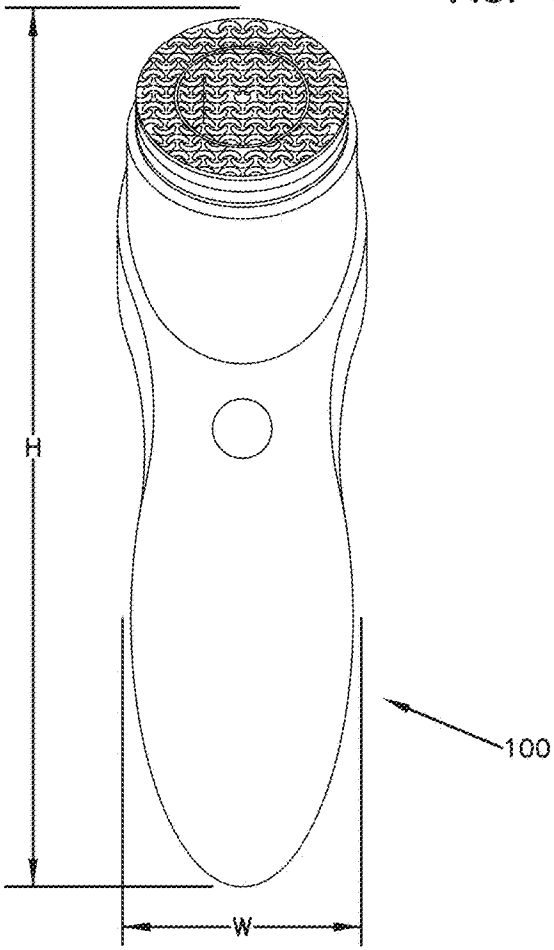

FIGS. 1C and 1D show representative dimensions of the cleansing device. In the embodiment shown, height H of the device is between about 140 mm to 220 mm, or about 170 mm to 180 mm. Width W of the device is about 30 mm to 70 mm, or about 40 mm to 60 mm. Depth D of the device is about 50 mm to 120 mm, or about 70 mm to 100 mm.

Various other configurational embodiments of the cleansing device 100 are envisioned. Some of these embodiments are described below in greater detail.

The cleansing head of the cleansing device is an article having a first major surface and second major surface, the first major surface having a plurality of cleansing features arranged thereon. At least some portions of the cleansing features are formed from an elastomeric composition. In some embodiments the cleansing head, including all cleansing features, is formed from an elastomeric composition. In other embodiments, the cleansing head is a composite construction having an elastomeric composition as a portion thereof, wherein the portion includes at least the surface of the first major surface of the cleansing head and at least a portion of the cleansing features. The elastomeric composition is a thermoplastic or thermoset polymeric composition that has a fully reversible strain of at least about 5%-1000%, a Shore A hardness of about 10 to 50, and a coefficient of friction (μ, a property affected by the composition) against human facial skin (without a beard or similar substantial facial hair) of about 0.20 to 1.20. In embodiments, the reversible strain is at least 100%, or 200% and as much as 1000%, for example about 700%, or about 500%. In embodiments, Shore A is about 20 to 40. In embodiments, the coefficient of friction against human facial skin is about 0.20 to 1.20, or about 0.20 to 1.00, or about 0.20 to 0.90, or about 0.20 to 0.80, or about 0.25 to 0.80, or about 0.25 to 0.75, or about 0.30 to 1.00, or about 0.40 to 1.00, or about 0.40 to 0.90, or about 0.40 to 0.80, or about 0.50 to 1.00, or about 0.50 to 0.90, or about 0.30 to 0.90, or about 0.30 to 0.80

Examples of suitable polymers used in the elastomeric composition include crosslinked silicone rubbers (polydiorganosiloxanes, in particular polydimethylsiloxane), rubbery polyurethanes, styrene-butadiene rubber (SBR), butyl rubber (isobutylene-isoprene copolymer), natural or synthetic polyisoprene, nitrile rubber (butadiene-acrylonitrile rubber), rubbery polypropylene, EPDM (ethylene propylene diene copolymer), EPM (ethylene propylene copolymer), and others as well as blends and copolymers thereof. In some embodiments the elastomeric composition is a crosslinked network. In some embodiments the elastomeric composition includes one or more fillers, plasticizers, or both. In some embodiments, the elastomeric composition further includes one or more colorants, thermal stabilizers, UV stabilizers, antimicrobials, and the like.

One example of a suitable elastomeric composition is a silica-filled silicone elastomer, such as those sold by the Dow Corning Co. of Midland, Mich., Momentive Performance Materials Inc. of Columbus, Ohio; Wacker Chemie AG of Munich, Germany, and Shin-Etsu Chemical Co. Ltd. of Tokyo, Japan. Suitable silicone elastomeric compositions include SUPERSIL®, a two-part filled silicone elastomer sold by Mouldlife of Suffolk, Great Britain, and SYLGARD®-184, a 10:1 two-part mix sold by DOW CORNING® Corporation of Midland, Mich. Other suitable elastomeric polymers useful in forming the elastomeric compositions include rubbery or thermoplastic polyurethanes sold by Bayer MaterialsScience AG of Leverkusen, Germany, Huntsman International LLC of The Woodlands, Tex., and others.

In some embodiments, the elastomeric composition includes one or more additives. The additives are embedded within the cleansing head or cleansing head surface to provide further beneficial results for the user during using of the cleansing device. In some embodiments, the additives are permanent, that is, they are not depleted from the cleansing head surface during use. In other embodiments, the additives are fugitive additives; that is, they are depleted during use. Examples of additives include abrasive particles embedded at least within the cleansing features for skin exfoliation or microdermabrasion, or to adjust the static friction or stick-slip level of the cleansing features with respect to the skin surface. Such additives are suitably permanent or fugitive, as determined by the manufacturer. Examples of suitable fugitive additives include skin-beneficial inorganic and organic molecules that allow the user to treat the skin during cleansing. Examples of such molecules include magnesium, calcium, vitamins such as vitamin D, plant-derived skin active ingredients, anti-oxidants, and the like. Another example of a fugitive additive is a skin cleansing composition that is embedded within or surrounding the cleansing features or the cleansing head or a portion thereof.

In some embodiments, a portion of or the entirety of one or more cleansing heads is a consumable item intended for frequent replacement, i.e. a disposable cleansing head. For example, in embodiments where one or more fugitive additives are provided as part of one or more cleansing heads, a suitable time to replace the one or more cleansing heads is upon depletion of the fugitive additive. In some such embodiments, one or more indicators are present on the cleansing head to indicate when the fugitive additive is depleted and a fresh cleansing head is needed. One illustrative example of a suitable indicator is a color layer disposed under a layer of a fugitive additive, such that depletion of the fugitive additive is indicated by exposure of the color layer that is visible to the user. Other such indicators are easily envisioned by one of skill. In some embodiments, a manufacturer provides instructions to the user to replace the cleansing head after a designated period of time in order to ensure the user is using a cleansing head having a sufficient amount of one or more fugitive additives. In some embodiments, one or more on-board electronic indicators is used to inform a user that it is time to replace the cleansing head.

Another example of a useful additive is an antimicrobial composition. Useful antimicrobial compositions are either permanent or fugitive, depending on the nature of the additive. For example silver or a silver (Ag) composition. In some embodiments, the silver composition is a particulate. One useful type of silver composition is BIOMASTER® TD100, available from ADDMASTER® Ltd. of Stafford, UK. Where present, the silver compositions are dispersed in the elastomer composition employed in forming the first major surface of the cleansing head at about 0.001 wt % to 5 wt % based on the weight of the elastomer composition, or about 0.01 wt % to 1 wt %, or about 0.05 wt % to 0.5 wt % based on the weight of the elastomer composition.

In some embodiments, the cleansing features are integral with the cleansing head or cleansing head sections, that is, a cleansing head or cleansing head section having a plurality of cleansing features is a single article formed by molding, 3D printing, or the like. In other embodiments, a cleansing head or cleansing head section is a composite construction having at least a surface layer including an elastomer composition, the surface layer disposed at least on the first major surface and inclusive of the cleansing features. In some such embodiments, the cleansing head includes a stiffness layer proximal to the first major surface. The stiffness layer is composed of one or more non-elastomeric thermoplastics, thermosets, metals, and combinations thereof such as poly(ethylene terephthalate), acrylonitrile-butadiene-styrene copolymer, polycarbonate, nylon, aluminum, steel, glass, combinations thereof, and the like. In some such embodiments the stiffness layer forms the second major surface.

The shape of the cleansing features is selected from one or more of a variety of shapes as will be described in detail below. In some embodiments, more than one cleansing feature shape, relative cleansing feature orientation, or both is situated on a single cleansing head or cleansing head section.

The cleansing features are protrusions attached to and extending away from the first major surface of the cleansing head in a direction generally perpendicular thereto. In some embodiments, the cleansing features are integral with the first surface of the cleansing head or cleansing head section; that is, the cleansing head or cleansing head section including cleansing features disposed thereon is a single molded or shaped article or portion thereof. In various embodiments, the cleansing features have an aspect ratio of about 1:5 to 10:1 (width:height), wherein width, or x distance, is the longest dimension of the base (portion of the cleansing feature intersecting the first major surface of the cleansing head) and height, or y distance, is the distance between the base and the peak (portion of the cleansing feature extending furthest away from the first major surface). In some embodiments, the cleansing feature aspect ratio is about 1:5 to 5:1, or about 1:4 to 4:1, or about 1:3 to 3:1, or about 1:3 to 2:1, or about 1:3 to 1:1. In some embodiments, the aspect ratios of individual cleansing features are variable on a single cleansing head or section thereof.

In some embodiments, there are about 2 to 100 cleansing features per square centimeter on at least one area of the cleansing head, or about 3 to 70 cleansing features per $cm^2$, or about 5 to 50 cleansing features per $cm^2$. In some embodiments, the space between cleansing features, or "land area" of the first major surface of the cleansing head or cleansing head section, is about 1% to 50% of the total first major surface area of the cleansing head, or about 5% to 30% of the first major surface area of the cleansing head. In some such embodiments, the cleansing features are spaced so as to be substantially equally distributed on the first major surface in one or more directions. In some embodiments, the cleansing features are spaced in a pattern on the first major surface. In some embodiments, the cleansing features are spaced irregularly on the first major surface. In some embodiments, the footprint of the base of the cleansing features is about 0.1 mm to 10 mm in the longest dimension, or about 0.5 mm to 8 mm, or about 1 mm to 6 mm, or about 2 mm to 5 mm in the longest direction. In some embodiments, the peak, or height, of the cleansing features extends about 0.5 mm to 5 mm from the base, or about 1 mm to 4 mm, or about 1 mm to 3 mm from the base. In order to impart to skin the stretch-slip action described below that is different than what is imparted by bristles used on some skin treatment devices, a cleansing feature has a substantially continuous contact surface with the skin of about at least 1 mm square or greater, for example about 1 mm to 5 mm square. This area, significantly larger than the skin contact area of a conventional single bristle, is useful to apply the stretch-slip forces to the skin described below.

The shape of the cleansing features is not particularly limited, except that in many configurations the peak footprint area is the same or less than the base footprint area of individual cleansing features. The benefits of such configurations include ease of manufacturing and more robust anchoring of the cleansing features on the first surface of the cleansing head or section thereof during use of the device. Cleansing feature shapes useful in the devices include conical, frusto-conical, pyramidal (base has triangle shape), frusto-pyramidal, cylindrical, hemispherical, prismatic (triangular prism with rectangular or square base), frusto-prismatic, cubic, cuboid, pentahedral (base has rectangular shape), frusto-pentahedral, and variations and modifications thereof. In some embodiments, the base of the cleansing feature has an "x" shape, a "v" shape, a "y" shape, a "u" shape, a star shape, a crescent shape, an annular shape, or some other shape and the peak footprint mirrors the shape; in some such embodiments, the peak footprint is somewhat smaller than the base footprint. In some embodiments, the base footprint has one distinguishable shape, and the peak footprint has a different distinguishable shape. For example, in some such embodiments, the base of the cleansing feature is hexagonal and the peak is hemispherical.

Irregular shapes and variations on the shapes recited above include an elongated prism shaped feature that is notched in one or more locations at the peak; mushroom shapes (substantially cylindrical base portion having a solid or hollow hemispherical or frusto-conical peak portion with the larger dimension thereof facing the first major surface of the cleansing head or portion thereof), inverted mushroom shapes (substantially cylindrical base portion having a solid or hollow hemispherical or frusto-conical peak portion with the smaller dimension thereof facing the first major surface of the cleansing head or portion thereof), conical features that are curved as the feature proceeds from the base portion to the peak portion, in some cases forming a hook-like appearance; and other variations that are envisioned by one of skill.

Some examples of cleansing features and their distribution on a first surface of a cleansing head are shown in FIG. 2. Shape design 1 ("Alpha Blade") is a prism shape having a rectangular base footprint and a blade-like peak footprint, wherein the distribution of Alpha Blade features on the cleansing head or cleansing head section is provided by a first three cleansing features in a single, even parallel orientation, then a second three cleansing features oriented 90° from the first three. Shape design 2 ("Alpha Latch") is a curved conical shape having a circular base footprint and a smaller circular peak footprint, wherein the distribution thereof on the cleansing head or cleansing head section is provided by a first row of features wherein the conical shape is curved in a first direction and a second row of features wherein the conical shape is curved in a second direction that is about 180° from the first direction. Shape design 3 ("Crested Wave Latch") is a different curved conical shape having a rectangular peak footprint, wherein the distribution thereof on the cleansing head or cleansing head section is similar to that of shape design 2. Shape design 4 ("Blade Tipped Latch") is similar to shape design 2, except that the peak footprint has a rectangular shape. The distribution of shape design 4 on the cleansing head or cleansing head section is similar to that of shape design 2. Shape 5 ("Alpha Latch Concentric Chase") is the same shape as shape 2, but the direction of the curved portion of the conical shape is somewhat randomized; further, the overall spatial arrangement of the features on the cleansing head or cleansing head section is concentric and not in straight rows.

Still referring to FIG. 2, shape 6 ("Blade Tipped Latch Chase") is the same as shape 4, but the direction of the curved portion of the conical shape is somewhat randomized on the cleansing head or cleansing head section; further, the overall spatial arrangement of the features on the cleansing head or cleansing head section is concentric and not in straight rows. Shape 7 ("Concentric Blades") is the same shape as shape 1, wherein groups of 3 aligned features are arranged in a concentric pattern. Shape 8 ("Inverting Mushroom") is a frusto-conical feature mounted on a cylindrical portion, or stalk. The features are arranged in a hexagonally packed arrangement on the cleansing head or cleansing head portion. Notably, the frusto-conical portion of shape 8 is sufficiently flexible that can become inverted. Shape 9 ("Inter-links") is a crescent shape having a blade like peak footprint. The features are disposed on the cleansing had or cleansing head portion in an interleaved fashion; the interleaved features are arranged in rows on the cleansing head or cleansing head portion. Shape 10 ("Non-inverting Mushrooms") is the same as shape 8, but lacks the flexibility to invert to yield a mushroom shape. Shape 11 ("Split Alpha Blade) is the same as Shape 1, except that the prism has a notched peak footprint. Configuration of Shape 11 on the cleansing head or cleansing head portion is configured in a same manner as Shape 1.

In some embodiments, the cleansing head is partitioned into two or more discrete cleansing head sections, each section including a plurality of cleansing features. Cleansing head sections are formed by the discrete division of the cleansing head at least at the first major surface thereof, the divisions extending toward the second major surface. In some embodiments, the cleansing head is partitioned through the entirety of its thickness, that is, from the first major surface to the second major surface thereof. The cleansing head sections allow movement of one or more sections by one or more motors activating one or more actuators via the connection of the second major cleansing head surface to the handle portion of the cleansing device. Skin stretching movement is imparted by the interaction of the cleansing features with the skin during the movement of one or more cleansing head sections while maintaining contact with the skin.

Figures 3A, 3B, 3C, 3D, 3E, 3F:
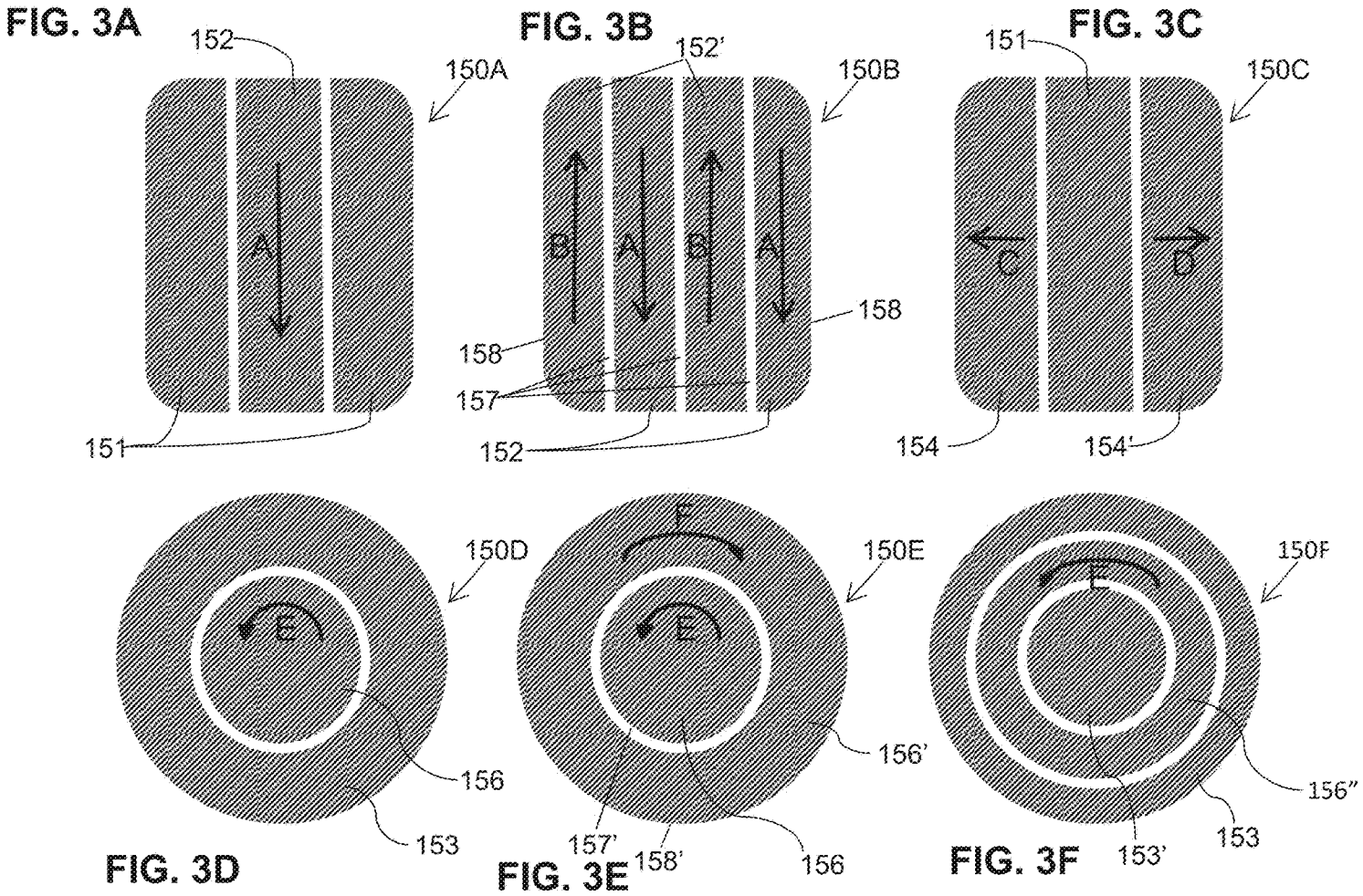
FIGS. 3A-3F illustrate exemplary cleansing head section displacement.
Figures 4A, 4B, 5A, 5B:
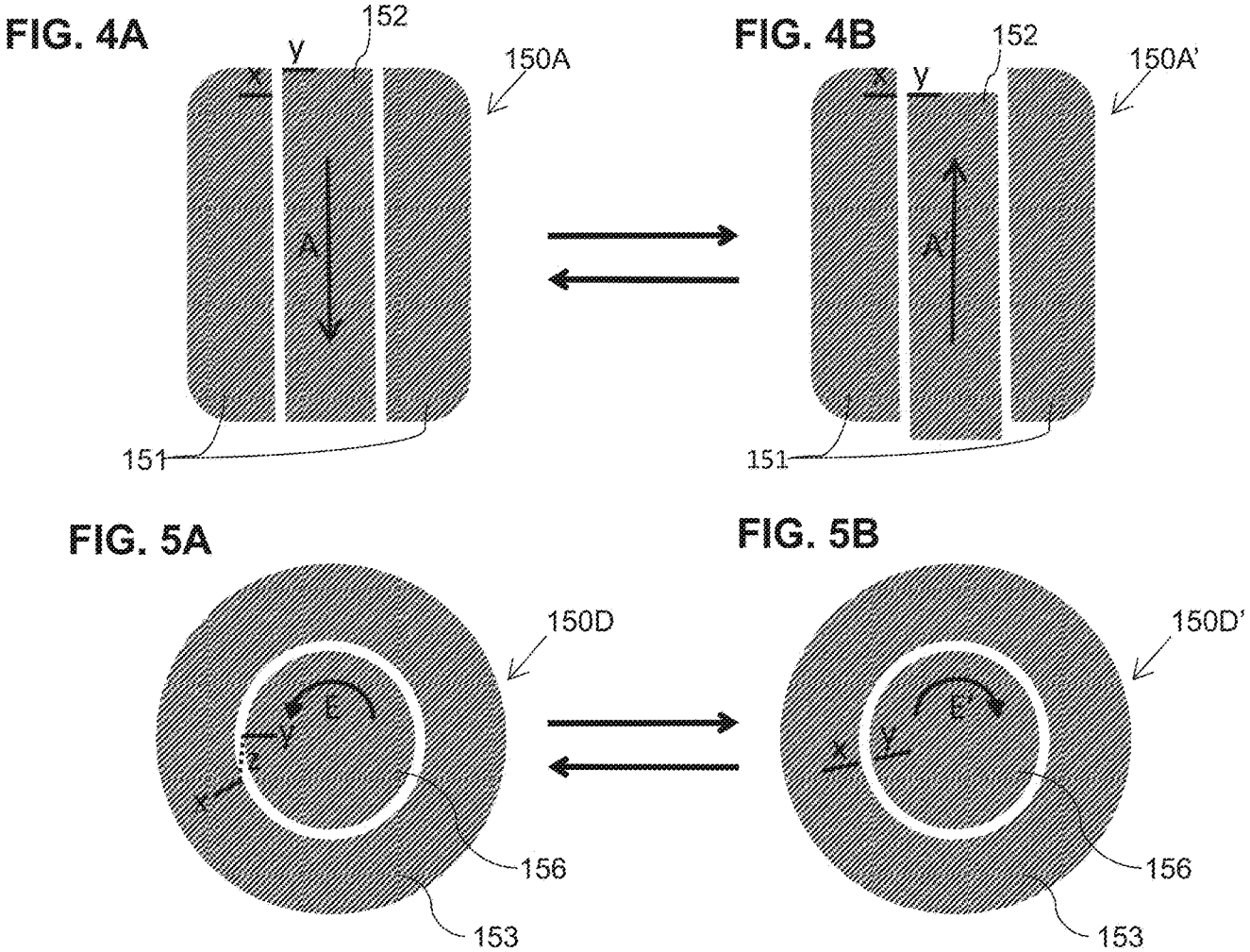
FIGS. 4A and 4B illustrate additional details of the cleansing head section displacement of FIG. 3A.
FIGS. 5A and 5B illustrate additional details of the cleansing head section displacement of FIG. 3D.

Representative embodiments of cleansing head designs designed to provide skin stretching movement are shown in FIGS. 3A-3F. Many other shapes and configurations that accomplish similar displacing movement of one or more cleansing head sections will be envisioned by one of skill. In FIGS. 3A-3F, first major surface configurations 150A-150F are variations of the cleansing head first major surface 150 of FIG. 1. The configurations of FIGS. 3A-3F are shown without cleansing features to show detail of the cleansing head section configurations and their selected movement relative to one another. In each embodiment, the first half of an oscillatory movement is shown by an arrow, wherein the second half of the oscillatory movement (not shown) is in the opposite direction from that indicated by the arrow. All movements shown by arrows are contemporaneous in each individual embodiment shown in FIGS. 3A-3F. FIG. 3A illustrates first embodiment 150A, which includes stationary sections 151 positioned on either side of first linear moving section 152 moving in first linear direction A. FIG. 3B illustrates second embodiment 150B, which includes first linear moving sections 152 moving in first linear direction A alternating with proximal second linear moving sections 152' moving in second linear direction B. Such opposing movement of two proximal sections is referred to in some embodiments as "counter-oscillation." FIG. 3C illustrates third embodiment 150C, which includes first lateral moving section 154 and second lateral moving section 154' on either side of stationary section 151, with first lateral moving section 154 moving in linear direction C and second lateral moving section 154' moving in linear direction D. FIG. 3D illustrates fourth embodiment 150D, which includes circular moving section 156 moving in counterclockwise direction E and positioned within annular stationary section 153. FIG. 3E illustrates fifth embodiment 150E, which includes circular moving section 156 moving in counterclockwise direction E and positioned within annular moving section 156 moving in clockwise direction F. Such counter-rotation of two proximal circular or annular sections is referred to in some embodiments as "counter-oscillation." FIG. 3F illustrates sixth embodiment 150F, which includes annular stationary section 153, circular stationary section 153', and annular moving section 156" moving in counterclockwise direction E, annular moving section 156" disposed between annular stationary section 153 and circular stationary section 153'.

It will be appreciated by one of skill that counter-oscillation type movements, such as in embodiments 150B and 150E of FIGS. 3B and 3E, respectively, result in two different types of movement boundaries. As used herein, the term movement boundary means the outer edge of a moving cleansing head or cleansing head section as shown in FIG. 3A-3F. A movement boundary exists at the edge of each moving cleansing head section. Referring to 150B, counter-oscillation provides an opposing movement boundary 157 at the edges of 152 proximal to the edges of 152', whereas movement boundaries 158 are simple movement boundaries. Similarly, referring to embodiment 150E, counter-oscillation of 156, 156' provides opposing movement boundary 157', whereas oscillation of 156' provides a simple movement boundary 158'.

As described above, each of the embodiments 150A-150F of FIG. 3A-3F shows the first half of an oscillatory movement, wherein the second half of the oscillatory movement is in the opposite direction from that indicated by the arrow. When the cleansing device is switched on, the oscillatory movement is repeated as a series of cycles that continues until the device is switched off. The oscillatory movement is a skin-stretching movement when the cleansing features disposed on cleansing head 150 are held against the skin. Skin-stretching movement is particularly beneficial within certain defined parameters. FIGS. 4A-5B provide additional details of this movement, specifically with regard to embodiments 150A and 150D of FIGS. 3A and 3D, respectively, to illustrate these parameters. Referring to embodiment 150A, at the beginning of an oscillation points x and y are about 0.5 mm to 8 mm apart. Halfway through one oscillation 150A', first linear moving section 152 has moved in first linear direction A and points x and y are aligned; thus, section 152 has moved 0.5 mm to 8 mm relative to stationary sections 151. First linear moving section 152 now moves in the opposite direction until the cleansing head is back in its original configuration 150A, completing one oscillation.

It will be appreciated that in some configurations, first linear moving section 152 moves in a manner that causes it to oscillate from the position represented by 150A equally on both sides, that is, half the total displacement distance is represented by 150A' and 150A-150A' represents a quarter of a cycle instead of a half, and in embodiment 150A, points x and y are about 1 mm to 4 mm apart. It will also be appreciated that for two contiguous moving cleaning head sections such as the representations of 150B and 150E of FIGS. 3B and 3E, respectively, the total displacement distance must take into account the movement of both moving sections. In some such embodiments, each moving cleaning head section moves one half the total displacement distance in each cycle.

Similarly to embodiment 150A-150A', embodiment 150D-150D' shows that at the beginning of an oscillation, points x and y are displaced 0.5 mm to 8 mm apart along line z. Halfway through one oscillation 150D', circular moving section 156 has moved in counterclockwise direction E and points x and y are aligned; thus, movement of circular section 156 has displaced point y 0.5 mm to 8 mm. Circular moving section 156 now moves in a clockwise direction until it arrives back in its original configuration 150D, completing one oscillation.

The oscillation of some other embodiments cleansing head configurations, for example other configurations shown in FIGS. 3A-3F, are similar to those of FIGS. 4A-5B. Total displacement per cycle of each moving cleansing head section relative to contiguous moving cleansing head section(s), or relative to contiguous stationary cleansing head sections, is about 0.5 mm to 8 mm. In some embodiments, the displacement per cycle is about 1 mm to 8 mm, or about 2 mm to 8 mm, or about 2 mm to 7 mm, or about 2 mm to 6 mm, or about 2 mm to 3 mm, or about 3 mm to 5 mm, or about 3 mm to 4 mm. Additionally, the cycle frequency (time per cycle) is about 5 Hz to 30 Hz, or about 10 Hz to 30 Hz, or about 15 Hz to 30 Hz, or about 20 Hz to 30 Hz, or about 25 Hz to 30 Hz, or about 5 Hz to 25 Hz, or about 5 Hz to 20 Hz, or about 5 Hz to 15 Hz, or about 10 Hz to 30 Hz, or about 10 Hz to 25 Hz, or about 10 Hz to 20 Hz.

It will be appreciated that various configurations of the cleansing head, specifically with regard to the number and configuration of cleansing head sections, is not particularly limited and is selected by the designer. Thus, in some embodiments where a circular center cleansing head section is surrounding by counter-oscillating rings, 1 to 3 annular cleansing head sections, or 2 to 5, or even 5 to 100 annular cleansing head sections are arranged in concentric circles on the cleansing head wherein counter-oscillating action is provided by alternating oscillation motion of the concentric annular cleansing head sections. In one example, a single annular cleansing head section includes a single row of cleansing features arranged radially around the annular section. The sections can be counter-oscillating, or oscillating sections can be alternated with stationary sections, or a combination thereof. Similarly, linear oscillating cleansing head sections are not particularly limited as to total number of counter-oscillating or alternating stationary/oscillating sections.

In some embodiments, the cleansing head is partitioned into two cleansing head sections including an inner circular section and an outer annular section, wherein one of the sections is adapted to be substantially stationary during operation of the cleansing device while the other section is moved in an orbital motion. The orbital motion follows a round or elliptical path without any circular (turning or twisting) displacement. In such embodiments, the shifting gap formed between the inner circular section and the outer annular section provides a displacement of about 0.5 mm to 8 mm. In some embodiments, the outer annular section is stationary and the inner circular section moves in an orbital fashion at a frequency of 5 Hz to 30 Hz to provide displacement between the inner and outer sections of 0.5 mm to 8 mm. In other embodiments, the inner circular section is stationary and the outer annular section moves in an orbital fashion at a frequency of 5 Hz to 30 Hz to provide displacement between the inner and outer sections of 0.5 mm to 8 mm, as well as displacement at the outer perimeter of the outer annular section.

In some embodiments, the first major surface of the cleansing head is not divided into cleansing head sections. Instead, in such embodiments movement of the cleansing features relative to one another is accomplished by moving the elastomeric surface from underneath. In such embodiments, a cleansing head has a single, continuous elastomeric top layer bearing the cleansing features. The cleansing head first surface is manipulated or stretched from underneath. In some such embodiments, more complicated modes of movement are implemented, such as planetary or orbital movement and the like.

The movement of the cleansing head sections is facilitated by the motor coupled to actuate the movement by the attachment of a cleansing head section to the actuator. It will be appreciated that in some embodiments, the cleansing head is attached to the handle, while one or more cleansing head sections are attached to one or more actuators. In some embodiments, one or more cleansing head sections are attached to one or more actuators to provide an oscillatory movement, while one or more additional cleansing head sections are attached to the handle to provide one or more stationary cleansing head sections. In other embodiments one or more actuators provide counter-oscillatory movement of two or more cleansing head sections.

Notably, a user is free to use the cleansing device without engaging the motor to move the cleansing head or cleansing head section(s). Thus, a user may simply move the cleansing device against the skin in a cleansing motion and achieve a cleansing effect. Additionally, the cleansing device includes in some embodiments one or more settings allowing the user to employ greater or less displacement per cycle, a greater cycle frequency such as 30 Hz to 100 Hz, or combinations of such variable displacement and frequency to accomplish specific tasks, such as deep cleansing or exfoliation.

Figure 1F:
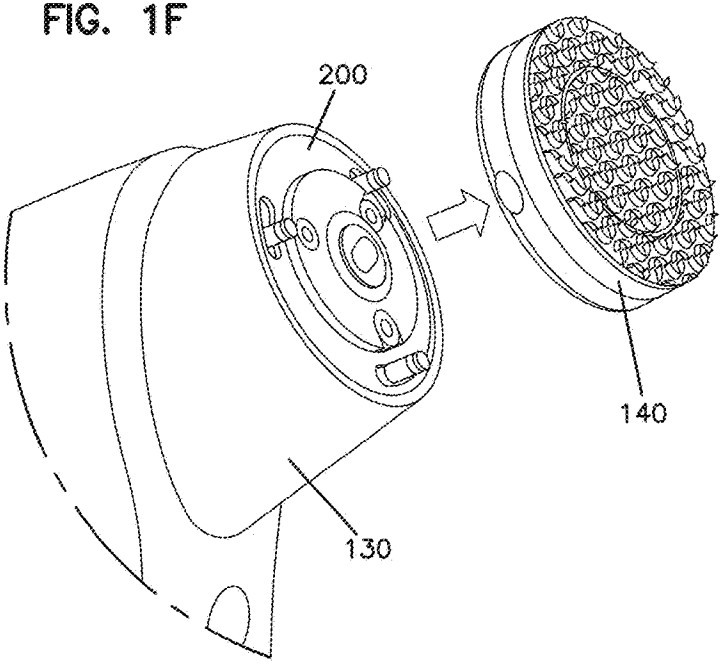
Figure 1E:
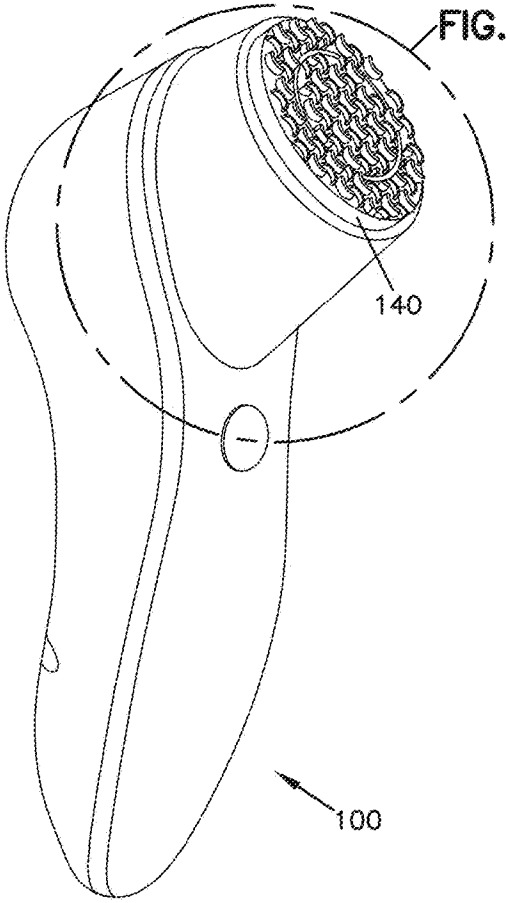

Regarding the interaction of the cleansing head with the actuator, one exemplary embodiment will now be discussed in detail in order to provide an understanding of one possible mechanism of oscillatory movement. Referring to FIG. 1E, cleansing head 140 and its attachment to cleansing device 100 is shown in somewhat more detail. FIG. 1F illustrates an enlarged view of the cleansing device of FIG. 1E. In particular, FIG. 1F shows cleansing head 140 as removable from cleansing device 100, revealing features of actuator mechanism 200.

Figure 1G:
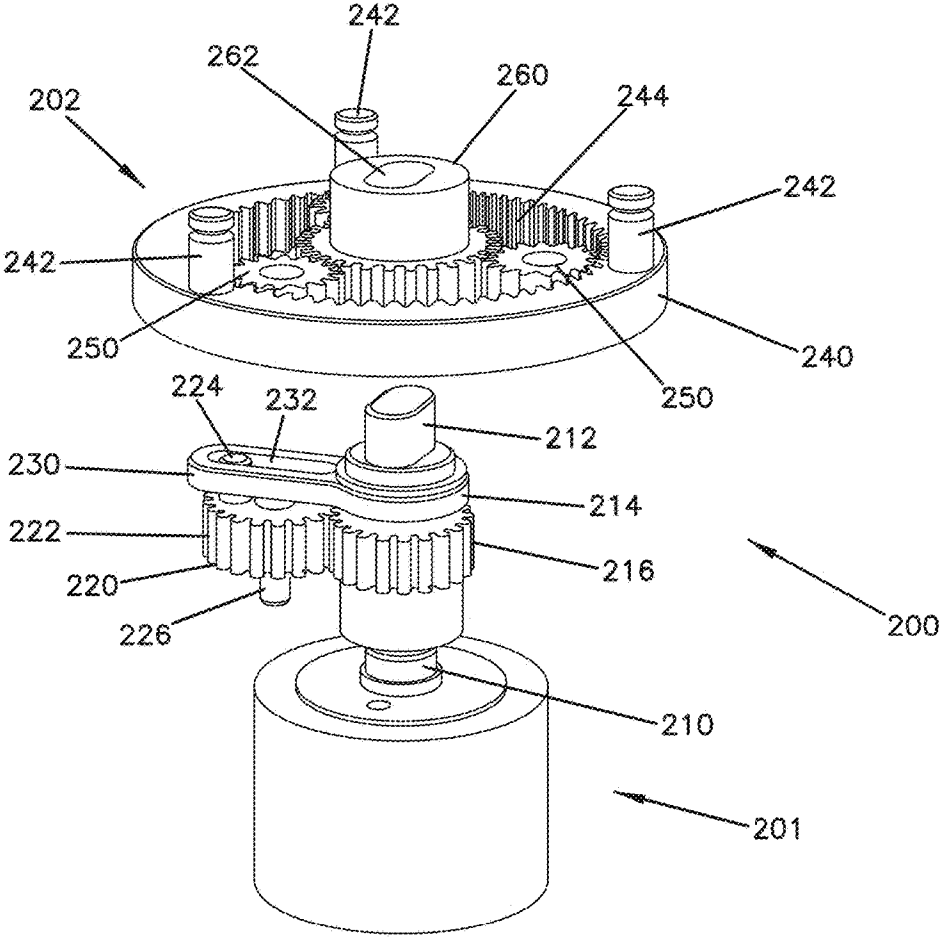

FIG. 1G is a partially exploded view of actuator mechanism 200, including features disposed within handle 110 of cleansing device 100. Actuator mechanism 200 includes primary drive 201 and secondary drive 202. Primary drive 201 includes motor drive shaft 210, gear mechanism 220 and pivot arm 230. Motor drive shaft 210 includes engagement member 212, collar 214, and collar gear 216. Collar gear 216 is attached to motor drive shaft 210 and thus moves along with motor drive shaft 210. Collar 214 and engagement member 212 are attached to each other but not to motor drive shaft 210 and thus the collar 214 and engagement member 212 are able to move in a rotational manner independently of motor drive shaft 210 and collar gear 216. Gear mechanism 220 includes gear 222, offset pin 224 (extending upwards from gear 222 in FIG. 1G), and center pin 226 (extending downward from gear 222 in FIG. 1G). Gear 222 is engaged with collar gear 216 and is held stationary in space by center pin 226 (that is, center pin 226 is engaged with a stationary member, not shown). Pivot arm 230 is attached to and is supported by collar 214 and includes slot 232 that is slidably engaged with offset pin 224. Secondary drive 202 includes outer ring gear 240, planetary gears 250, and sun gear 260. Outer ring gear 240 includes engagement pins 242. Sun gear 260 includes engagement slot 262 that is adapted to receive engagement member 212. Sun gear 260, planetary gears 250, and outer ring gear 240 combined to form a planetary gear system.

Figure 1H:
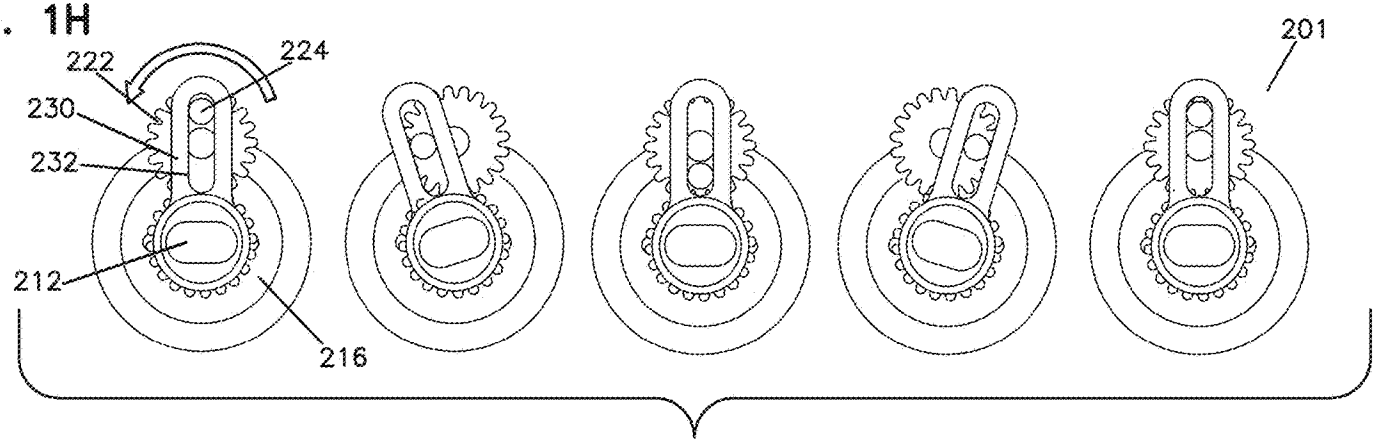
Figure 1I:
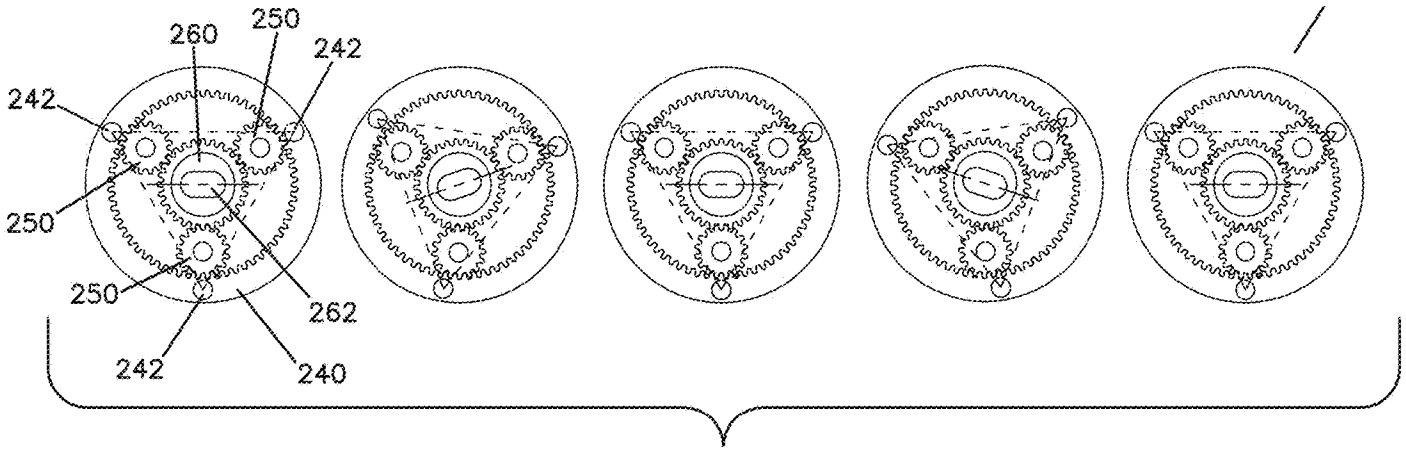

When engagement member 212 is operably engaged with engagement slot 262, primary drive 201 and secondary drive 202 are operable to provide counter-oscillatory movement by virtue of moving collar gear 216 by the rotational motion of the motor turning the shaft 210. This movement is shown in FIGS. 1H and 1I. FIG. 1H is a top-down view of the primary drive 201. One full cycle of movement of primary drive 201, driven by the motor turning collar gear 216, is shown from left to right in FIG. 1H. Movement of shaft 210 moves collar gear 216 in a clockwise direction. Motion of gear 222 in a counter-clockwise direction occurs by engagement of collar gear 216 with gear 222. Rotation of gear 222 causes movement of offset pin 224 within slot 232, urging pivot arm 230 to move in a first counterclockwise, then clockwise, then counterclockwise movement as shown by the left-to-right series of configurations in FIG. 1H. In some embodiments, the arcuate movement of pivot arm 230 over a single complete cycle as shown in FIG. 1H traverses an arc of about 20° to 50°, or about 25° to 45°, or about 30° to 40°. Engagement member 212 moves contemporaneously and over the same arc as that described by the pivot arm 230. FIG. 1I is a top-down view of the motion of secondary drive 202 when engagement member 212 of primary drive 201 is engaged within engagement slot 262. One full cycle of movement of primary drive 202, driven by the actuator engaged with primary drive 201, is shown from left to right in FIG. 1I. Dashed lines are provided to add perspective regarding the relative movement of sun gear 260 and pins 242 attached to outer ring gear 240. Movement of sun gear 260, engaged with planetary gears 250, acts to move outer ring gear 240 in an opposing direction to the movement of sun gear 260, as shown by motion of pins 242. The movement of outer ring gear 240 over a single complete cycle as shown in FIG. 1I traverses an angle of about 5° to 30°, or about 7° to 25°, or about 10° to 20°.

Thus, design of a cleansing head fitted to work in conjunction with actuator mechanism 200 of FIG. 1G includes an annular outer cleansing head section adapted and designed to engage with pins 242 of secondary drive 202, and an inner circular cleansing head section adapted and designed to be engaged with the hub of engagement slot 262. Collar gear 216 on primary drive 201, as shown in FIG. 1G, is connected to a DC motor. The action of the motor turning shaft 210 and collar gear 216 in either a clockwise or counterclockwise motion causes the movement described and shown in FIGS. 1H and 1I. Motion of the hub of engagement slot 262, moved when engaged with moving engagement member 212 of primary drive 201, moves the circular inner cleansing head section in a first direction (counterclockwise as shown in FIG. 1H), then counterclockwise; contemporaneously, motion of pins 242 moves the annular outer cleansing head section in a second direction (clockwise as shown in FIG. 1I). In this manner, radial counter-oscillating motion is achieved. Other embodiments, not particularly limited by the description of the exemplary embodiment provided here, are envisioned by one of skill and do not depart from the spirit and scope of the appended claims.

The handle portion of the device houses the motor, which is either directly powered by AC/DC power or is battery powered. The handle further includes associated wiring, supports, and power input to facilitate the application of electrical power to the motor via DC or AC/DC. If directly powered, a cord is provided that allows a user to plug the cleansing device into a standard wall socket (120V, 60 Hz in North America for example) and converts the power to DC. If the cleansing device is battery powered, a recharging cord is removably attached to the device and the charging cord plugs into a standard wall socket for recharging depleted batteries. In some embodiments where the device is battery powered and rechargeable, a sensor visible to a user is coupled to a display wherein the user is alerted to the status of the remaining battery power. In some embodiments, the handle includes a switch, available to a user for switching the electrical power to the motor on and off.

In some embodiments, the cleansing device further houses a timer that beeps, vibrates, or otherwise notifies the user that a particular increment of time has passed. For example, a timer algorithm that causes a beeping signal to sound every 15 seconds, or every 30 seconds, or some other interval when the cleansing device is turned "on" is useful to alert the user that he or she should start cleansing a different area of the skin. The timer interval is usefully employed in conjunction with an automatic "off" switch housed internally that shuts the device off after a certain number of timed intervals. For example, in some embodiments for facial cleansing, a timer routine is implemented that vibrates every 15 seconds, and after four 15 second intervals (during which the timer vibrates three times), the device automatically shuts off. In some embodiments, the user can select (via a control situated on the handle) a skin cleansing program, wherein the timer and automatic shut off are programmed for facial cleansing, gentle facial cleansing, foot cleansing, and the like.

In some embodiments, the cleansing device is waterproof, and for example is able to withstand immersion in up to 0.25 meters, up to 1 meter, up to 2 meters, or more without water entering the handle or other parts of the device housing electrical components. In other embodiments, the cleansing device is water resistant, that is, the device can be washed or splashed without water entering the handle or other parts of the device housing electrical components, but cannot be immersed without water entering the handle or other parts of the device housing electrical components.

The handle portion fits in an average human grip in a manner that enables a user to comfortably place the cleansing head first major surface in contact with the user's face with some applied pressure, and manipulate the device to slide the cleansing head across the facial surface. The embodiment shown in FIGS. 1A and 1B is instructive, though not limiting of the types of handle designs usefully employed with the cleansing device. Materials used to make the handle chassis, that is, the portion of the handle visible to the user, are not particularly limited. Generally, metals or plastic compounds or a combination thereof are used to form the chassis and design or functional details present thereon. A common material employed to form the handle portion is acrylonitrile-butadiene-styrene (ABS) copolymer. Antibacterials, colorants, surface finishes and textures and the like are suitably included in the handle portion of the device.

In some embodiments the cleansing head, or a portion thereof including the first major surface, is removably affixed to the cleansing device. Removing the cleansing head is useful, in embodiments, to wash or replace the cleansing head or a portion thereof. Various attachment mechanisms are useful for removable attachment of the cleansing head or a portion thereof to the cleansing device. Examples of useful attachment mechanisms include hook and loop mated attachment surfaces, snaps, latches, screws, and any other such mechanisms known to those of skill. In some embodiments, the cleansing head second major surface is disengaged from the actuator to affect removal of the entire cleansing head. In other embodiments, the removable portion of the cleansing head is an elastomeric member that includes at least a portion of the first major surface; in some such embodiments, an attachment means such as described above is employed to removably attach the elastomeric member to the cleansing head. In other such embodiments, the elastomeric member is adapted to be stretched to cover and surround at least a portion of the non-removable portion of the cleansing head such that a combination of elastic recovery of the stretched elastomeric member and static friction maintain the position of the elastomeric member on the cleansing head.

In embodiments of the cleansing device wherein a portion of the cleansing head is removable, it is an advantage of the cleansing device that the user can not only remove the cleansing head or portion thereof to clean or replace it, but that the user can interchange cleansing features on the first major surface thereof. Thus, in embodiments, the cleansing device is part of a kit that includes two or more replacement cleansing heads or cleansing head portions wherein the cleansing features are different. Such embodiments are described in more detail below.

In some embodiments, it is an advantage of the cleansing feature design that the cleansing head is easily washed between uses. The high aspect ratio of the cleansing features (width:height of no less than 1:5, when compared to brush bristles, typically having an aspect ratio of 1:10 or less) imparts cleanability to the cleansing heads wherein the detritus remaining from cleansing—residual cleanser, dirt, bacteria, and dead skin cells) are easily washed off the cleansing head surface. The cleansing head sections therefore are more sanitary with repeated use than are cleansing brushes. Further, in embodiments wherein the elastomeric compositions include e.g. antimicrobial compound or particles, the growth of bacteria or other microorganisms on the cleansing head surfaces is retarded or prevented altogether. Thus, the cleansing head of the present invention has superior cleanliness and/or cleanability when compared to brush-based devices.

Control System

Figure 6:
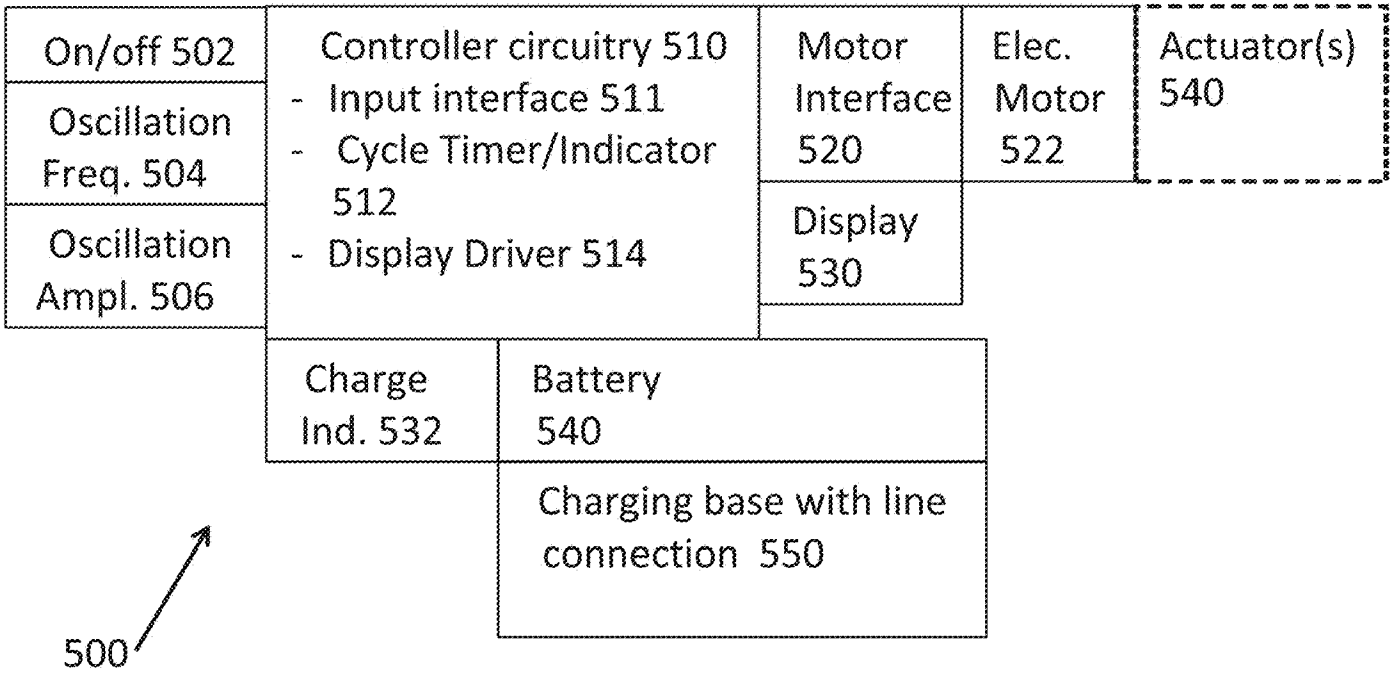
FIG. 6 illustrates one embodiment of a controller as used in the cleansing device in a schematic block diagram.

The cleansing device has a control system 500 (see FIG. 6) that allows the user to turn the device on and off and, in some embodiments to make selections of operating parameters. As seen in FIG. 6, in one embodiment the controller 500 has an on-off control 502. It may have an optional oscillation frequency control 504 and/or oscillation amplitude control 506. The controls may be individual buttons or areas on a touch pad or touch screen (not shown).

Controller circuitry 510 has logic circuits or may be a programmed microprocessor, in either case configured to receive a variety of input signals and to provide output signals to control components or optional displays. Power for controller circuitry 510 comes from battery 540, which may be rechargeable and may have an associated charge level indicator 532. Controller circuitry 510 has an input interface that senses the status of controls 502, 504, 506 used as inputs to the control logic. The control logic includes a timer, which may be used as a cycle timer for a usage cycle or to time other intervals used in control. In one embodiment, the controller circuitry 510 times one long interval which defines a full usage cycle, such as 2, 3 or 5 minutes or any appropriate usage interval. It also times fractions of that full usage cycle, at the end of which a brief change in oscillation frequency, a beep or other indicator may indicate to the user to move on to a new treatment zone on a multi-zone skin area to be treated. For example, when the face is to be treated, the facial skin may be subdivided into 2, 3, 4, or more zones to be addressed at different times by the device as part of a full usage cycle that is recommended. The controller circuitry 510 also may optionally include a display driver 514 that controls, text or graphics or other visual signals presented to a user on an optional display 530. As an alternative, only audible signals may be used to provide signals to a user, in place of visual signals. In this case display 530 is a beeper or a small transducer for producing one or more sounds under control of the controller circuitry 510. In certain implementations, the controller circuitry 510 may be configured to produce artificial human speech (e.g., to give voice directions) using a speech synthesizer, pre-recorded content, or other means.

The controller circuitry 510 also has a motor interface 520 by which it delivers selected amounts and potentially changeable patterns of electrical power and/or actuation signals to the electrical motor 522. In this manner, the action of the electrical motor may be controlled. The electrical motor 522 is operably connected to the actuators 540 that deliver motion to the cleansing surfaces shown in FIGS. 3A-4B. The controller 500 with its controller circuitry 510 permits the user to control operation of the device during its use, as described next. Basic control permits the device to be turned on or off. With other control features, for example, the user may control motion of the cleansing surfaces as to amplitude of the motion within the ranges discussed above, as well as to control frequency of the oscillations of the cleansing surfaces within the ranges discussed above to meet a user's perceptions of comfort and effectiveness, in combination with the pressure the user exerts at the cleansing surfaces shown in FIGS. 3A-4B. The two parameters may be controlled independently. There may be variations among users as to the level of these parameters that are perceived as comfortable and/or effective. The device permits the user to control these selections by adjustment, optionally with the display 530 showing current parameter adjustment states and providing guidance for making adjustments, such as a graphic showing a bar graph with the current level and the range of available adjustment. The display 530 also may show a time counter for the full treatment cycle or for discrete segments.

Figure 7:
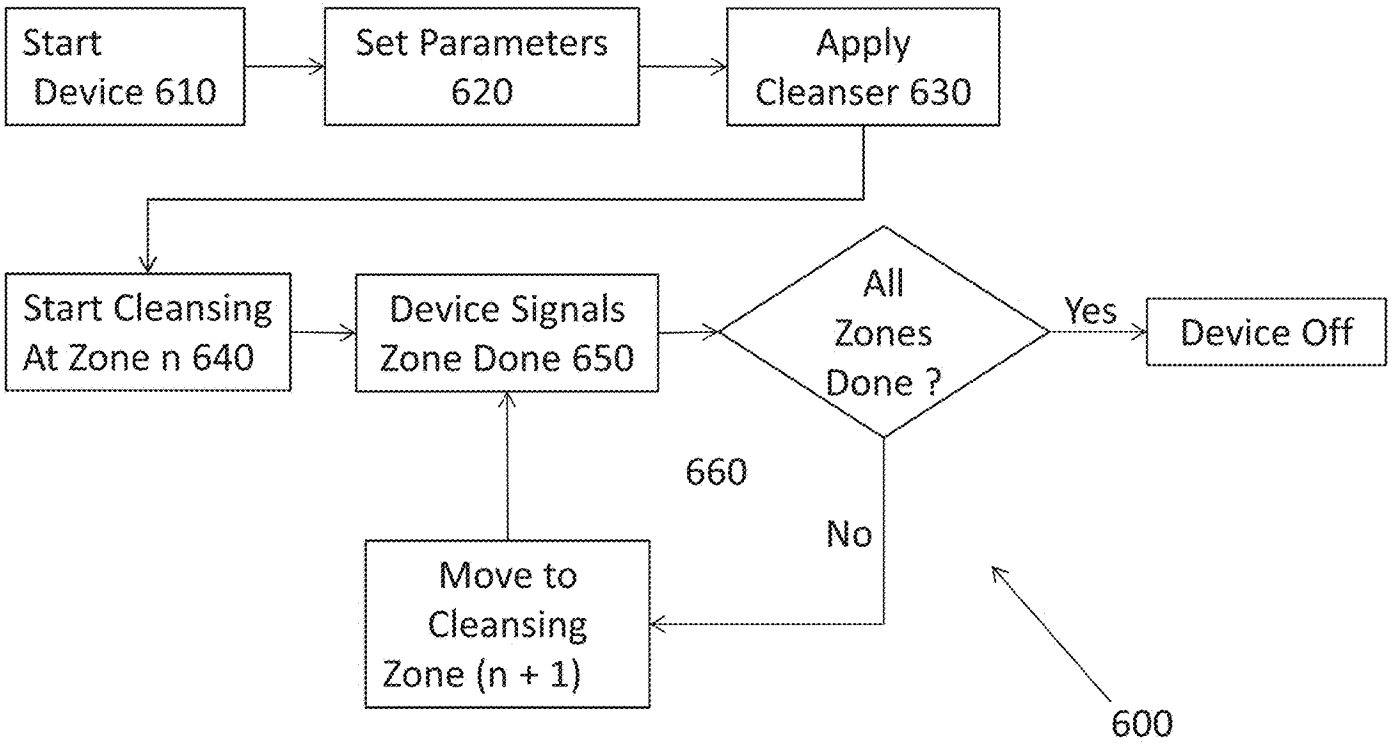
FIG. 7 is a flowchart representation of one embodiment of a method of using the cleansing device.

In some embodiments, as described above, the cleansing device further houses a timer that notifies the user that a particular increment of time has passed. For example, a timer that beeps every 30 seconds is useful to alert the user that he or she should start cleaning a different area of the skin. The timer interval is usefully employed in conjunction with an automatic "off" switch housed internally that shuts the device off after a certain number of timed intervals. A flowchart showing one such timing algorithm is shown in FIG. 7. Timer algorithm is initiated by the user starting the cleansing device 610, setting use parameters 620, applying a cleansing composition to the device or the user's skin 630 (or the skin of someone whose skin will be cleansed by the user), and initiation of cleansing 640 of the first zone (n=1). After a predetermined interval, the timer algorithm sends a signal to a mechanism (speaker that causes a tone or beep, vibrating element that sends a vibration through the handle, switch that momentarily shuts off the cleansing device, and the like) that alerts the user that the zone cleansing is complete. The user is then alerted to move to the next zone of skin for cleansing. After a predetermined number of such time intervals n, the device is signaled to shut off; this is accomplished via a series of queries 660 after each zone is completed. After each signal, 1 is added to n after each interval, until n reaches a target value and the device shuts off.

Kits

In embodiments of the cleansing device wherein a portion of the cleansing head is removable, it is an advantage that the user can not only remove the cleansing head or portion thereof to clean or replace it, but that the user can interchange cleansing features on the first major surface thereof. Thus, in embodiments, the cleansing device is part of a kit that includes two or more replacement cleansing heads or cleansing head portions wherein the cleansing features are different.

In some embodiments, a kit includes at least a cleansing device and two or more cleansing heads or cleansing head portions. In some embodiments, the two or more cleansing heads or cleansing head portions are substantially the same; in other embodiments the two or more cleansing heads or cleansing head portions have different cleansing features or a different arrangement of the cleansing head features arranged thereon. In some embodiments, the kit includes two or more cleansing heads or cleansing head portions that are substantially the same, and additionally includes one or more additional cleansing heads or cleansing head portions that have different cleansing features or a different arrangement of the cleansing head features arranged thereon.

In some embodiments, the kit further includes a power cord for removably attaching to the cleansing device handle and a plug adapted to be received by an electrical power source. In some embodiments, the kit further includes a docking station adapted to secure the cleansing device while not in use. In some embodiments the docking station includes an adapter that connects to the cleansing device handle connect the device to a power cord having a plug adapted to be received by an electrical power source. In some embodiments, the docking station includes a cleaning mechanism for cleaning the cleansing head first surface while the cleansing device is secured to the docking station. In some embodiments, the kit further includes one or more skin cleansing compositions packaged for use with the cleansing device. In some embodiments, the kit further includes a travel case adapted to contain the cleansing device within to protect it during travel, such as in a suitcase or bag.

Replacement kits are also contemplated; such kits are associated with the cleansing device but do not include a cleansing device. The replacement kits include replacement parts or compositions for users already in possession of the cleansing device. One such kit includes one or more cleansing heads or cleansing head portions that are substantially the same. Another such kit includes two or more cleansing heads or cleansing head portions having different cleansing features or a different arrangement of the cleansing head features arranged thereon. Another such kit includes one or more cleansing heads or cleansing head portions and one or more packages including skin cleansing compositions; the compositions are the same or different. Some kits include two or more of the above replacement parts or compositions.

In some embodiments, the kits further include one or more instruction sets for instructing the user on how to use the cleansing device, specialized packaging, labels, decorative designs, coupons, and the like.

It will be appreciated that the different cleansing heads or cleansing head portions, whether or not included in a kit, are designed to achieve variable effects when used by a user; further, a specific cleanser may be recommended in some embodiments for use in conjunction with a specific cleansing feature design or arrangement. Thus, varying effects ranging from gentle massage to vigorous exfoliation are achieved by interchanging cleansing features and skin cleansing compositions.

Use of the Device

The cleansing device is used to cleanse the skin of a mammal; in particular, the skin of a human. In some embodiments, the device is used as a facial skin cleanser for a human. In some embodiments, the device is used to treat the facial skin of a human. The device is intended to be used in conjunction with a skin cleansing or treating composition, for example a detergent or non-detergent facial skin cleansing composition, or a non-detergent treating composition such as a moisturizing composition such as a lotion, a gel, a cream, or a combination thereof. To use the device, a user coats at least a portion of the cleansing head first major surface with a skin cleansing or treating composition (or alternatively applies the composition to a skin area), contacts the device to his or her own face, and turns the device on to start the skin-stretching movement. The skin-stretching movement of the cleansing features imparts certain surprising and unexpected advantages when employed in conjunction with a cleansing composition.

The skin-stretching movement stretches the skin surface and also skin cells, allowing a greater extent of cleaning and/or treating than can be achieved using conventional brush-type skin cleansing equipment yet without causing pain or discomfort to the user. The skin-stretching movement also provides a scraping or squeegee like cleaning action. These two observed motions are the combined result of the cleansing features, together with a skin cleanser, interacting with the skin surface in a stick-slip mechanism when the cleansing device is "on" and held against the skin. "Stick-slip" can be described as surfaces alternating between sticking to each other and sliding over each other, with a corresponding change in the force of friction. Typically, the static friction coefficient (a heuristic number) between two surfaces is larger than the kinetic friction coefficient. When the applied force is large enough to overcome the static friction, then the reduction of the friction from static to kinetic can cause a sudden jump in the velocity of the movement.

Figure 8:
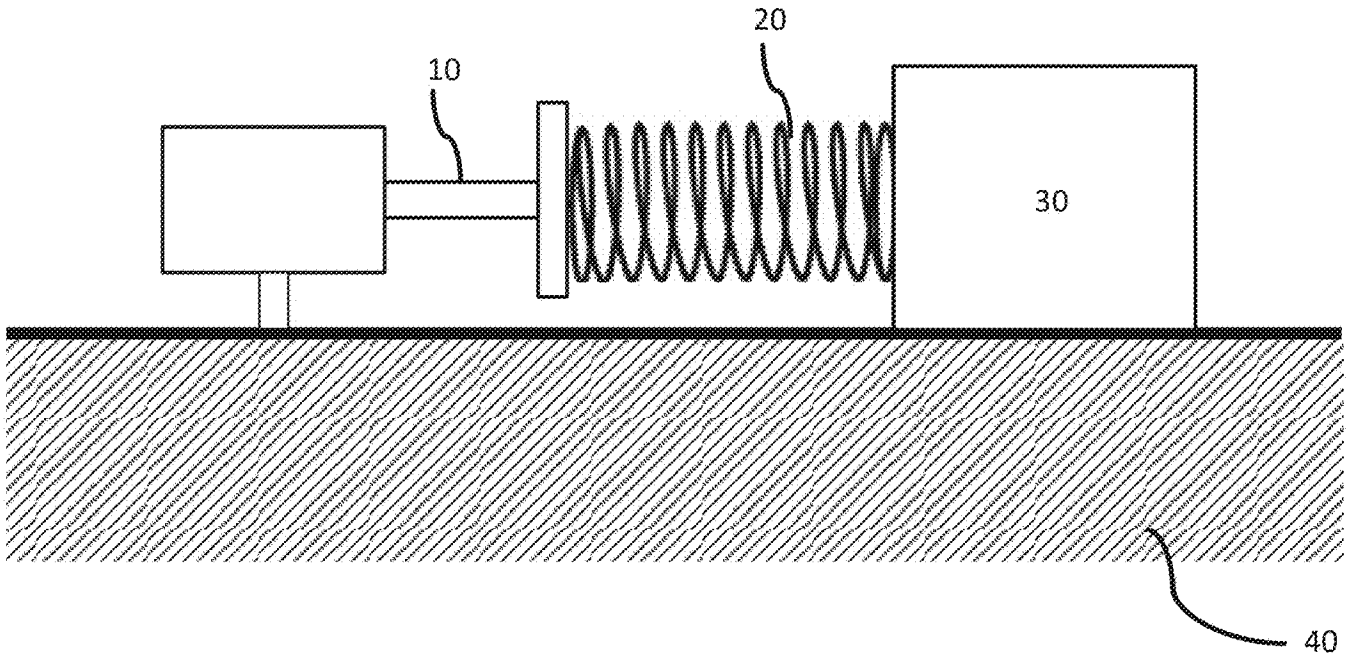
FIG. 8 illustrates the theoretical physical elements of stick-slip movement (static and kinetic friction).

FIG. 8 is a schematic diagram showing the theoretical physical elements of stick-slip behavior. A drive system 10 is connected to spring 20, and load 30 is lying on horizontal surface 40. The static friction between load 30 and surface 40 is determined by mass (gravity). When the drive system 10 is started, spring 20 is loaded and its pushing force against load 30 is thereby increased until the static friction coefficient between load 30 and surface 40 is overcome. At that point, load 30 starts sliding horizontally across surface 40 and the friction coefficient decreases from its static value to its dynamic value. At the moment sliding begins, spring 20 accelerates load 30. During the movement of load 30, the force imparted by spring 20 decreases, until it is insufficient to overcome the dynamic friction of load 30 on surface 40. From this point, load 30 decelerates and eventually stops. The drive system 10, however, is continuously loading spring 20, and the stick-slip cycle starts again as the spring is reloaded. In a system where the load is to oscillated, it is retracted, which may cause a stick-slip cycle during the return motion.

Following the schematic representation of FIG. 8, 10 represents an actuator on a cleansing device urged in a first direction by the motor, 20 represents the elasticity (elastic modulus) of a cleansing feature, 30 represents the cleansing feature held against a surface, represented by skin 40, with a force determined by the user urging the cleansing device toward the skin rather than by gravity. In this manner, the static and dynamic friction of the cleansing features against the skin are activated in a slip-stick mechanism. The static-dynamic friction balance is achieved by the use of a selected cleanser and/or water, the coefficient of friction of the cleansing features against the skin, and the force with which the user presses the cleansing device against the skin. The cleanser reduces a stick portion of the stick-slip action of a cleansing feature that has frictional contact with a skin surface during the oscillating movement of the cleansing head. Thus, depending on the force applied by the user, the stretching caused by the stick portion of the stick-slip action of a cleansing feature may be more easily modulated and reduced relative to a nominal total displacement distance in an oscillation cycle.

The sticking portion of the stick-slip action causes stretching of skin cells due to the movement of the cleansing features by the cleaning head actuator until static friction is overcome. Initiation of the slipping portion of the stick-slip action then causes the cleansing features to slide across the skin cell surfaces. When a skin cleansing composition is added to the first major surface of the cleansing head, the lubricating effect of a liquid interface between the cleansing features and the skin reduces the drag during the "slip" portion of the movement or in some cases also reduces the static friction, causing less "stick" and more "slip" during use. Similarly, user-applied pressure of the cleansing features against the skin affects the balance of "stick" and "slip" during use.

In certain embodiments, a method of cleansing and/or treating the skin of a human includes applying a cleansing and/or treating composition to the skin and/or to the cleansing head of the device, contacting the cleansing head to the skin, and turning the device on. A user may move the cleansing head of the device across the skin to reach desired treatment areas. In embodiments, the contacting includes applying force, such as an average of about 1N to 10N pressure, or about 1N to 8N, or about 2N to 6N, or about 2N to 4N, or about 2N to 10N, or about 4N to 10N, or about 2N to 8N, or about 2N to 6N, or about 3N to 5N, or about 4N force. In certain embodiments, the applied force may vary based on the desired treatment area (e.g., a relatively light force may be applied to more sensitive facial skin around a user's eyes, while a relatively high force may be applied to less sensitive facial skin near a user's cheek), the coefficient of friction between the cleansing head and the desired treatment area (e.g., as modified by the applied cleansing and/or treating composition), and other factors.

In certain embodiments, the displacement of the cleansing head combined with the stick-slip action of the cleansing features during the contact and further with the cleansing and/or treating composition applied provides a skin displacement of about 5% to 100% of the displacement of the cleansing head, or about 5% to 90%, or about 10% to 90%, or about 20% to 90%, or about 25% to 90%, or about 30% to 90%, or about 40% to 90%, or about 50% to 90%, or about 5% to 80%, or about 5% to 70%, or about 5% to 60%, or about 5% to 50%, or about 10% to 70%, or about 20% to 60% of the displacement of the cleansing head as determined by measurements of displacement of a synthetic silicone skin model as described in Example 2 herein. Thus, for example, if the cleansing head displacement is 5 mm, the skin displacement at least at one location measured is about 0.25 mm to 4.5 mm. One of skill will understand that variability of the skin displacement measured during use of a cleansing head having a known displacement during operation thereof is caused by the choice of cleansing and/or treating composition employed, the Shore A hardness and coefficient of friction of the cleansing features, and force applied during use by the user. The aforementioned variables affect the stick-slip action and thus actual skin displacement.

Without wishing to be limited by theory, it appears that the "stick" phase of the cleansing action provides benefits in manipulating the skin by stretching that cannot be effectively achieved with bristles, which because of their greater aspect ratio and flexibility relative to applicant's cleansing features do not as effectively stretch the skin surface and layers below the surface in ways that have been found to be beneficial. The bristles also appear less suited to apply a scraping force across skin areas in a slipping action. As noted above, bristles tend to lift skin cells but not remove them; thus brushes can have a skin-roughening effect. In sharp contrast, the cleansing action of the present cleansing features is capable of removing surface cells effectively via the stick-slip motion, producing a skin smoothing effect observable by the user. The peak footprint of the elastomeric cleansing features together with the displacement and frequency of oscillating action thereof produce a wiping effect on the skin surface. This action removes loose skin cells but does not "dig in" to the stratum corneum to lift, but not remove, other stratum corneum cells. Stated differently, the cleansing features of the cleansing device remove what is loose and rough without adding roughness to the skin surface.

Without wishing to be limited by theory, we believe that a specific degree, frequency, or period of controlled stretching of the human skin, or combination of two or more thereof, results in micro-extracellular matrix stretching that in turn causes stretching of the attached dermal fibroblasts. Such stretching, we believe, causes favorable gene expression changes in the fibroblasts, directing them to repair or augment the extracellular matrix (ECM) of the skin and improve skin health and appearance. The extracellular matrix is composed of collagen fibers, elastin fibers, and the water-holding molecules retained within the network of the fibers, for example other proteins and gycosaminoglycans such as chondroitin, biglycan, hyaluronic acid, and the like. Restoring the ECM results in an improvement in appearance and a decrease in the apparent age of the subject.

Various types of skin cleansing compositions are useful in conjunction with the cleansing device without limitation. In general, any liquid, dispersion, lotion, gel, serum, or solution conventionally used to clean skin can be used in conjunction with the cleansing device. The preferred method of use is to apply the cleanser to the first major surface of the cleansing head, then contact the first major surface to the skin, and turn the device "on". However, the user can also apply cleansing composition to the skin, then contact the cleansing device to the skin and turn the device "on". In some embodiments, a cleanser cartridge is integrally disposed within the cleansing head and arranged to dispense a skin cleansing composition or other composition to the skin during use. Other compositions include, for example, oils or other slip agents to reduce static friction, astringents, medicated compositions to treat skin conditions such as acne, and the like. The cartridges are refillable by the user in some embodiments. In other embodiments the cartridge itself is replaced by the user when empty. In some such embodiments, the cleansing device includes a sensor adapted to provide a signal alerting the user when the cartridge is empty.

During use, the cleansing device is moved around the surface of the skin by the user. The skin-stretching movement of the cleansing features acts on the skin and the cleansing composition, present on the cleansing features, is present at the interface between the skin and the cleansing features. The skin-stretching movement is thus coupled with the availability of cleansing composition, which can be deposited by the cleansing features into skin crevices and interstices by the action of the cleansing features during the "stick" phase of the cleansing action, then urged further across the skin surface during the "slip" phase of the cleansing action Examples of skin cleansing compositions usefully employed along with the cleansing device include Neutrogena Deep Clean or Ultra Gentle, sold by Neutrogena Corp. of Los Angeles, Calif.; CeraVe cleansers, sold by Valeant Pharmaceuticals North America LLC of Laval, Quebec, Canada; Clarisonic cleansers, sold by Pacific Bioscience Laboratories Inc. of Redmond, Wash.; Aveeno cleansers sold by Johnson & Johnson of New Brunswick, N.J.; Purity cleanser sold by Philosophy Inc. of Phoenix, Ariz.; facial cleansers sold by Estee Lauder Cos. of New York, N.Y.; FREE & CLEAR® cleansers, sold by Pharmaceutical Specialties, Inc. of Rochester, Minn.; or a cleanser such as bar or liquid soap mixed with water. In embodiments, the cleanser is a non-detergent, non-foaming cleanser. In some embodiments, the skin cleansing composition is characterized by the absence of lauryl sulfate salts such as sodium lauryl sulfate or ammonium lauryl sulfate. In some embodiments, the skin cleansing composition is characterized by the absence of ionic surfactants. In some embodiments, the skin cleansing composition is characterized by a semi-liquid state, that is, a viscosity that is similar to honey and does not undergo substantial shear thinning. In some embodiments, the skin cleansing composition is pumpable and is delivered in a pump bottle. In some embodiments, the skin cleansing composition is characterized by a smooth, silky hand feel without substantial gritty or chalky feel. In some embodiments, the skin cleansing composition included one or more humectants, glycols, or oils.

Examples of useful components included in a skin cleansing composition include those that do not substantially negate or retard the stick-slip action of the cleansing device during use. In some embodiments, the skin cleansing composition includes water, Glycerin, Cetearyl Alcohol, Polyglyceryl-10 Laurate, Ethylhexylglycerin, Cetearyl Glucoside, Caprylyl Glycol, Carbomer, Sodium Hydroxide, Phenoxyethanol. In some embodiments, the skin cleansing composition includes 0.001% to 4% salicylic acid, or about 0.5% to 3 wt % salicylic acid, or about 1 wt % to 2 wt % salicylic acid. In some embodiments, the skin cleansing composition includes water, Sodium Cocoyl Isothionate, Glycerin, Sodium C14-16 Olefin Sulfonate, Glycereth-2 Cocoate, Glyceryl Stearate, Sodium Methyl Cocoyl Taurate, Acrylates Copolymer, PEG-18 Glyceryl Oleate/Cocoate, *Portulaca Oleracea* Extract, *Camellia Oleifera* Leaf Extract, *Hamamelis Virginiana* (Witch Hazel) Water, *Nelumbo Nucifera* Flower Extract, Panthenol, Butylene Glycol, Tetrahexyldecyl Ascorbate, Allantoin, Tocopheryl Acetate, Hydroxyphenyl Propamidobenzoic Acid, Hydrolyzed Jojoba Esters, Hydroxyethylcellulose, 10-Hydroxydecanoic Acid, Lactic Acid, Xanthan Gum, Sodium Hydroxide, Iodopropynyl Butylcarbamate, Methylisothiazolinone, Fragrance, Alcohol, Disodium EDTA-Copper, and Pentylene Glycol. In some embodiments, the skin cleansing composition includes Water (Aqua), Sodium Lauroamphoacetate, Sodium Trideceth Sulfate, Limnanthes Alba Seed Oil (Meadowfoam), Coco Glucoside, *Cocos Nucifera* Alcohol (Coconut), PEG 120 Methyl Glucose Dioleate, Aniba Rosaeodora (Rosewood) Oil (Rosewood), Geranium *Maculatum* (Geranium) Oil, Guaiac Extract (Guaiacum *Officinale*), Cymbopogon *Martini* (Palma Rosa) Oil, Rosa *Damascena* Extract, Amyris *Balsamifera* (West Indian Rosewood) Bark Oil, Santalum Album Oil (Sandalwood), *Salvia Officinalis* Oil (Sage), *Cinnamomum Cassia* Leaf Oil, *Anthemis Nobilis* (Roman Chamomile) Flower Oil, *Daucus Carota Sativa* (Carrot) Seed Oil, *piper nigrum* seed extract (pepper), Polysorbate 20, Glycerin, Carbomer, Triethanolamine, Methylparaben, Propylparaben, Citric Acid, Imidazolidinyl Urea, and Yellow 5 (CI 19140).

The benefits of the stick-slip mechanism include more thorough cleansing action than can be achieved by conventional brush-type skin cleansing devices. The sticking portion of the cleansing head action stretches the cells, exposing a greater surface area for cleansing without causing discomfort to the user; the subsequent squeegee action more effectively removes loosened dirt from the skin surface than does a conventional brush-type cleansing device. An additional benefit is exfoliation, because stretching followed by squeegee action on the skin serves to effectively remove dead cells. An additional benefit is skin smoothing, provided during the slip portion of cleansing head action and optimized by the design of the cleansing features to slide across the cell surfaces with a squeegee action. One desired effect of cleansers applied under the cleansing head is that they serve to emulsify the dead cells and dirt that the cleansing head is able to loosen by its manipulation of skin and its stick/slip action at the skin surface. Removing the cleanser after device use then removes the loosened dead cells and dirt.

Without being limited by theory, it appears that yet an additional benefit provided by use of the cleansing device is increased protein fibril (collagen) production within the lower dermal layer. It has been found that stretching the skin surface about 0.5 mm to 8 mm at 5-25 Hz produces stretching of the individual fibroblasts in the lower dermal layer by about 20-100 microns. That is the stretching distance lessens with skin depth but appears to cause some stretching of individual cells that may act as a mechanical stimulus to the cells. There is evidence that this type of stretching produces a response of the fibroblasts to increase protein production. See e.g. Lee, S. L. et al., "*Physically-Induced Cytoskeleton Remodeling of Cells in Three-Dimensional Culture*", *PLOS One* 7(12), e45512 (December 2012).

Further, we have found that the motion, frequency, amplitude, and duration of skin cleansing using the skin cleansing device results in a change in the water-binding molecules of the skin, specifically Biglycan. This was an unexpected and rapid change, the result of only two, 2-minute periods of cleansing spaced apart by 8 hours. In the past, little attention was paid to the water-binding molecules of the skin. However, our in vitro data suggests that use of the cleansing device of the invention rapidly improves the water-binding capacity of the skin. This is likely to provide a more rapid change in appearance, while increased collagen expression and improved organization follows in due course.

EXPERIMENTAL

Example 1

Using 3 AATCC Dermal Fibroblast cell lines derived from Caucasian females aged 48-56 years cultured on an inert 3D polymer scaffold coated with collagen gel to mimic the dermis environment, the present inventors initiated testing of the tissue response to static and cyclic stretching by RT-qPCR analysis to examine RNA genes Col-1, decorin, TGF-β, and biglycan. The TGF-β pathway is the major regulator of extracellular matrix production in human skin connective tissue. Impairment of TGF-β results in reduced production of collagen and compromised wound healing in aged human skin. Col-1 produces a component of type I collagen, which combines with other collagen components to produce type I procollagen. Decorin is associated with collagen fibrillogenesis, wherein a decorin-deficient matrix affects skin chondroitin/dermatan sulfate levels and keratinocyte function. Phenotypic effects of biglycan deficiency are linked to collagen fibril abnormalities, are synergized by decorin deficiency, and mimic Ehlers-Danlos-like changes in bone and other connective tissues.

The cell lines were maintained in 1 mL aliquots in liquid nitrogen until required. For preparation, it was removed from the liquid nitrogen, thawed in a 37 C water bath and placed into Dulbecco's modified Eagle media (DMEM, obtained from the Sigma-Aldrich Company of St. Louis, Mo.) supplemented with 7.5% fetal bovine serum (FBS, obtained from Thermo Fisher Scientific of Waltham, Mass.) in a T75 flask. This media composition provided a doubling time of 26 hours. Cells were grown at 37° C. in humidified atmosphere with 5% CO2 until 90% confluent and a cell concentration of 105 per mL was achieved. Cells were not utilized past passage 5. At this point, the cells were detached from the flask using trypsin/EDTA for 4 minutes, centrifuged at 500 G for 8 minutes and reconstituted in DMEM supplemented with 7.5% FBS ready for seeding of the scaffolds.

Custom produced scaffolds were composed of aliphatic polyester copolymer synthesized by ring-opening copolymerization of ι-lactide and ε-caprolactone at a ratio of 75/25 according to the techniques of Tomihata, K., M. Suzuki, T. Oka, and Y. Ikada, *A new resorbable monofilament suture*, Polym. Degrad. Stab. 1998, 59(51):13-18. Scaffold dimensions were 1 cm in diameter with a thickness of 0.5 cm in order to fit the dimensions of the BOSE 5200 Biodynamics chamber (obtained from BOSE ESG of Eden Prairie, Minn., USA). The scaffold coating procedure used was that described by Rentsch B, et al., Embroidered and surface modified polycaprolactone-co-lactide scaffolds as bone substitute: in vitro characterization. Ann Biomed Eng 2009a, 37: 2118-2128. To summarize, porcine skin collagen I (obtained from MBP GmbH of NeustadtGlewe, Germany) was suspended in 0.01M acetic acid. To immobilize the collagen I on the scaffolds the suspension was diluted 1:2 in phosphate buffer solution (PBS—60 mM Pi, 270 mM NaOH, pH 7.4). After 4 hours of incubation at 37° C. the scaffolds were dried and crosslinked, followed by adding 0.1M N-(3-dimethylaminopropyl)-N-ethylcarbodiimide hydrochloride and 0.05 M N-hydroxysuccinimide (obtained from the Sigma-Aldrich Company of St. Louis, Mo.). This was done in a 0.1M phosphate buffer at pH 5.5/40% ethanol. After 6 hours at room temperature the scaffolds were again dried and then washed with four cycles of 15 minutes in 0.1M phosphate buffer pH 9 and 30 min in 4M NaCl and ultra-pure water. Sterilization was undertaken with gamma rays at ≥25 kGray (obtained from Synergy Health Radeberg GmbH of Radeberg, Germany).

A BOSE Electroforce 5200 (obtained from BOSE ESG of Eden Prairie, Minn. USA) series Biodynamics four chamber test system was configured to maintain cell seeded scaffolds in a physiologically relevant environment whilst applying force under steady flow conditions. The cell seeded scaffolds were placed in the center of the non-porous compression platens within the Biodynamics chamber. The chamber and closed loop pump system was filled with 500 ml of growth media at 37° C. at a constant flow rate of 100 ml/min. The Biodynamics system and tubing ancillaries were housed within an environmental chamber (obtained from Caron Products and Services, In. of Marietta, Ohio) at 37° C., RH % 25, pH 7.4. Control samples were held in place by a 4-sample compression platen with only hydrostatic loading applied and no mechanical loading.

Coated scaffolds were placed into a six well plate and 250 μl of the cell suspension was placed onto the scaffold. The scaffolds were then incubated for 1 hour at 37° C. to facilitate cell adhesion. DMEM supplemented with 7.5% FBS was then dispensed into the well containing the cell seeded scaffold and incubated at 37° C. in humidified atmosphere with 5% $CO_2$. Media was changed every 24 hours for 3 days. After 3 days, the scaffolds were aseptically removed from the six well plates and loaded into the biodynamic chamber for mechanical loading.

Static Loading.

For baseline comparison, static compression was applied at 500 kPa (ramp rate 50 kPA/sec) for 1 min. This static testing methodology was defined in order to establish an experimental protocol for mechanical testing and to assess the impact of static compression. The compression load was then reduced to a pre-loaded state at 10% (50 kPa) of maximum (ramp rate 50 kPa/sec) for 14 min. before being re-applied for a further 1 min. A total of four mechanically loaded scaffolds and four control samples were examined during the course of this study. After the end of the experimental protocol, the scaffolds were removed from the chamber and immediately placed into a −80° C. freezer for 24 hrs before undergoing fractionation and analysis by RT-qPCR (iCycler, obtained from Bio-Rad Laboratories, Inc. of Hercules, Calif.).

Dynamic Loading.

To test the influence of dynamic loading on the response of selected molecules in the skin analogue, dynamic loading was undertaken between 500 kPa and 50 kPa at a rate of 15 Hz for 2 minutes. The compression load was reduced to a pre-loaded state at 10% (50 kPA) of maximum for 8 hr before being re-applied for a further 2 minutes at 15 Hz. A total of nine mechanically loaded scaffolds and nine control samples were examined during the course of this study. At the end of the experimental protocol, the scaffolds were removed from the chamber and immediately placed into a −80° C. freezer for 24 hr before undergoing fractionation and analysis by RT-qPCR (Bio-Rad iCycler).

RNA Extraction and Quantitative Real Time Polymerase Chain Reaction (RT-qPCR).

Total RNA was extracted using the TRIspin method as per the manufactures instructions and reverse transcription was carried out using the Omniscript kit (obtained from Qiagen Inc of Valencia, Calif.). Aliquots of the resulting cDNA were amplified in a Bio-Rad iCycler using human-specific primer sets for the molecules in question. The resulting values were normalized to the housekeeper 18S.

Statistical Analysis.

Mean data, standard deviation, and error bars were compiled and calculated using Microsoft EXCEL® (obtained from Microsoft Corporation of Redmond, Wash.). A paired student t test was performed using Microsoft EXCEL®. Values of >0.05 were considered significant.

Results.

The data generated suggest that the application of a dynamic mechanical loading regime produces a favorable upregulation in the production of beneficial molecules associated with skin and wound healing. More detail on these results are provided as follows.

Effect of Static Compression on Human Dermal Fibroblasts.

Figure 9A:
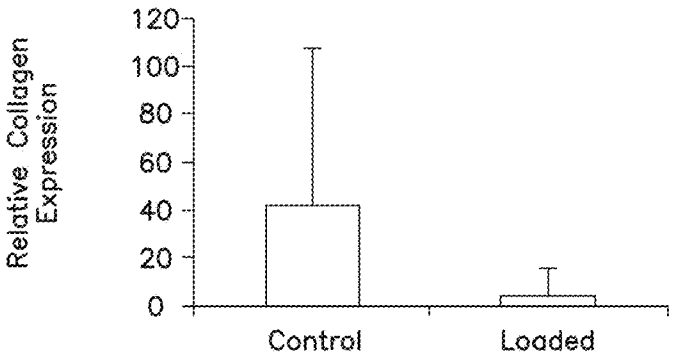
FIGS. 9A and 9B are plots showing the effect of a static compression loading regime on the expression of (8A) Collagen 1 and (8B) TGF-β.
Figure 9B:
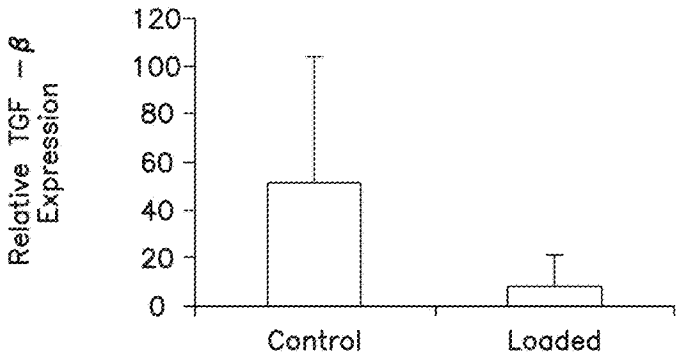
Figure 10A:
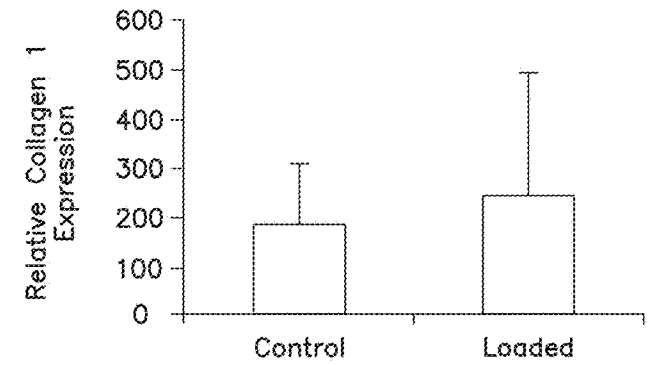
FIGS. 10A-10D are plots showing the effect of a dynamic compression loading regime on the expression of (9A) Collagen 1, (9B) biglycan, (9C) decorin and (9D) TGF-β.
Figure 10B:
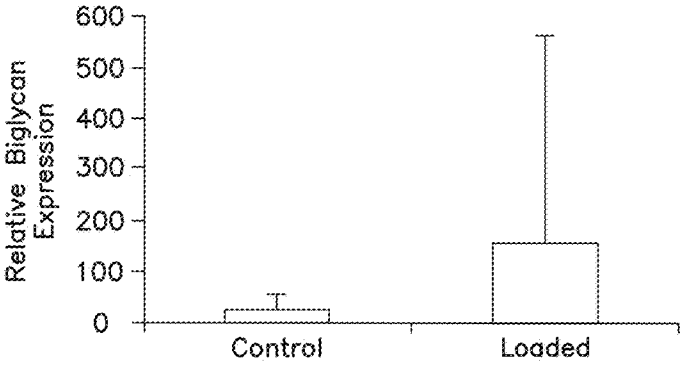
Figure 10C:
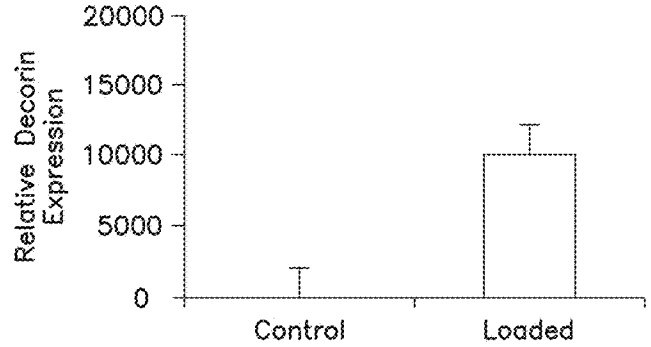
Figure 10D:
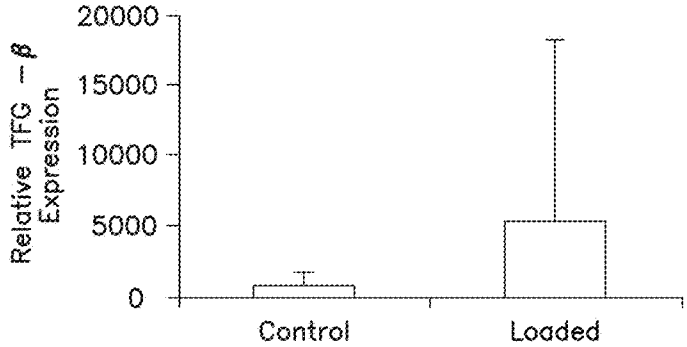

The static compression loading regime produced a down regulation on the expression of collagen I and TGF-β (FIGS. 9A and 9B) in statically loaded samples (n=4) when compared to control (unloaded) samples, as expected. This result provides strong baseline evidence that the system is responding to a static stimulus as predicted. Consequently, it was deemed reasonable to proceed with dynamic loading stimulus with this skin analogue system.

Effect of a Dynamic Compression Loading on Human Dermal Fibroblasts.

The response of the skin analogue to dynamic compression loading regime on the expression of biglycan, collagen I, decorin, and TGF-β (FIGS. 10A-10D) was varied. Expression of decorin was observed to be significantly upregulated when compared to untreated control samples (n=9). Biglycan, collagen 1 and TGF-β expression appears to demonstrate an upregulation in dynamically loaded samples when compared to the control (unloaded) samples.

Without being limited by theory, in addition to the apparent useful effects from stretching of the individual fibroblasts in the lower dermal layer, it appears that the stretching motion of the cleansing surfaces during the "stick" portion of an oscillation cycle can manipulate the skin surface so as to open interstitial spaces between cells or other fine skin features where dirt or dead cells may be trapped. Further, this motion may open and then allow relaxation of pores. This may result in a kind of pumping action that will assist in clearing material that becomes lodged in or is produced in a pore. This opening of skin features and pores also allows cleanser to enter.

Example 2

A synthetic skin sample was prepared according to the following protocol. First, the following components were mixed: 30 wt % of a mixture of polyorganosiloxanes 75-85 wt %, amorphous silica 20-25 wt %, and platinum-siloxane complex 0.1 wt %; 30 wt % of a mixture of polyorganosiloxanes 65-70 wt %, amorphous silica 20-25 wt %, and other components 10 wt %; 8.6 wt % of silicone fluid (non-reactive silicone oil); and 31.4 wt % of a mixture of polyorganosiloxanes that alter hardness and the feel of the final cured material. The blended components were cast into a film 2 mm thick and cured by allowing the film to sit undisturbed for about 8 hours at ambient laboratory temperature. Then the same components were blended at the same ratio, but 20 wt % of a white dye was added to the components based on the total component weight. The white dye layer was cast on one of the major sides of the cured film and allowed to cure.

Figure 11B:
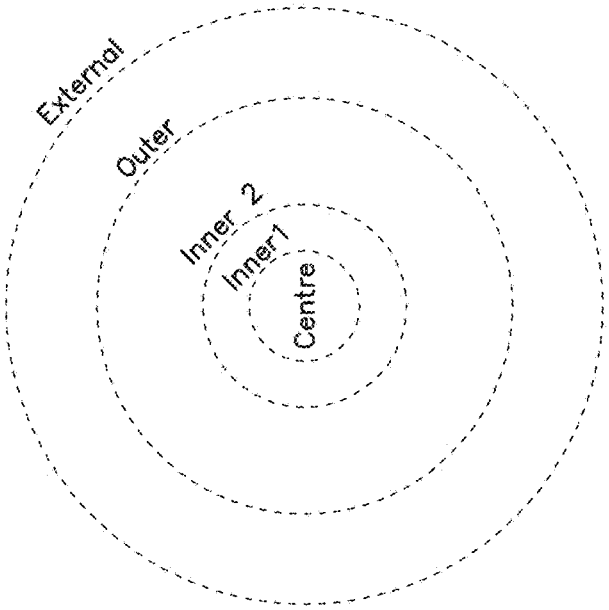
FIGS. 11A-11C are illustrations of a pattern of marks used to measure displacement of a silicone film by stretching upon application of an embodiment to a film used as a skin model, and displacement of the film upon the application of the embodiment.
Figure 11A:
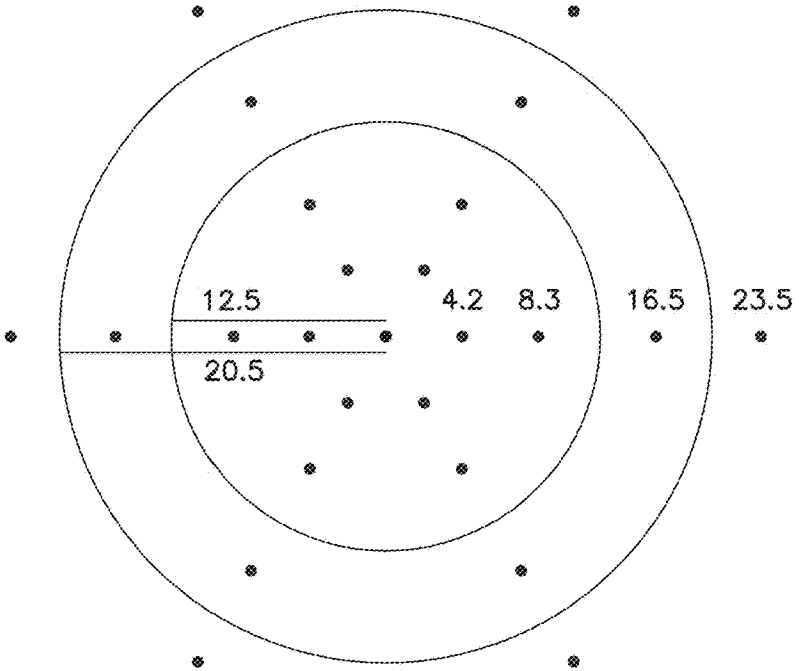

After both curing steps were complete, the template sheet shown in FIG. 11A was laid on top of the cured silicone films. The dots pictured in FIG. 11A were provided as 500 μm holes, and the cured silicone films were marked using the template holes. Distances marked in FIG. 11A represent millimeters. The marks describe a series of concentric circles for measurement of displacement of the silicone film by counter-rotating stretching motions. FIG. 11B shows the concentric circles, labeled as Inner 1 (corresponding to a radius of 4.2 mm from the center dot in FIG. 11A), Inner 2 (corresponding to a radius of 8.3 mm from center), Outer (corresponding to a radius of 16.5 mm from center), and External (corresponding to a radius 23.5 mm from center).

A cleansing device having overall device features similar to those shown in FIG. 1, a counter-oscillating cleansing head configuration similar to 150E of FIG. 3E was employed to show displacement of the synthetic skin surface by the cleansing device. The dimensions and other aspects of the counter-oscillating cleansing head of the device are shown in Table 1. A test jig was designed to hold the synthetic skin sample and the cleansing device, further to provide contact of the cleansing features of the cleansing device with the synthetic skin surface using an application force of 4N.

TABLE 1

Features of the cleansing device employed in Example 2.

| Feature | Description or value |
|---|---|
| Outer diameter of cleansing head, 156 of 150E in FIG. 3E | 25.3 mm |
| Inner diameter of cleansing head, 156' of 150E in FIG. 3E | 26.3 mm |
| Outer diameter of cleansing head, 156' of 150E in FIG. 3E | 41.4 mm |
| Maximum displacement at opposing movement boundary 157' of 150E of FIG. 3E (displacement measured as a straight-line distance between start and end points) | 5.4 mm |
| Material used to form cleansing features | PDMS |
| Shore A of material used to form cleansing features | 25 |
| General shape of cleansing features | Design 9 of FIG. 2 |
| Frequency of counter-oscillation | 15 Hz |

The marked silicone film was used to measure displacement during operable contact thereof with the skin cleansing device of Table 1. First, 0.35 mL of a cleansing fluid (Purity Made Simple, obtained from philosophy inc. of Phoenix, Ariz.) was applied to the surface of the cleansing features. Then the device and a silicone film (synthetic skin) were mounted in the test jig so that the center dot (marked on the silicone film as shown in FIG. 11A) contacted the center of the cleansing head on the white side of the silicone film. The test jig provided uniform contact force of 4N between the silicone film and the cleansing features. A high speed camera (500 Hz, approx. 200 frames/sec) was situated proximal to the contacted area such that the side of the silicone film opposite the white (contacted) side was viewed by the camera; the marks placed on the film using the template of FIG. 11A were all viewable in the camera field.

Figure 11C:
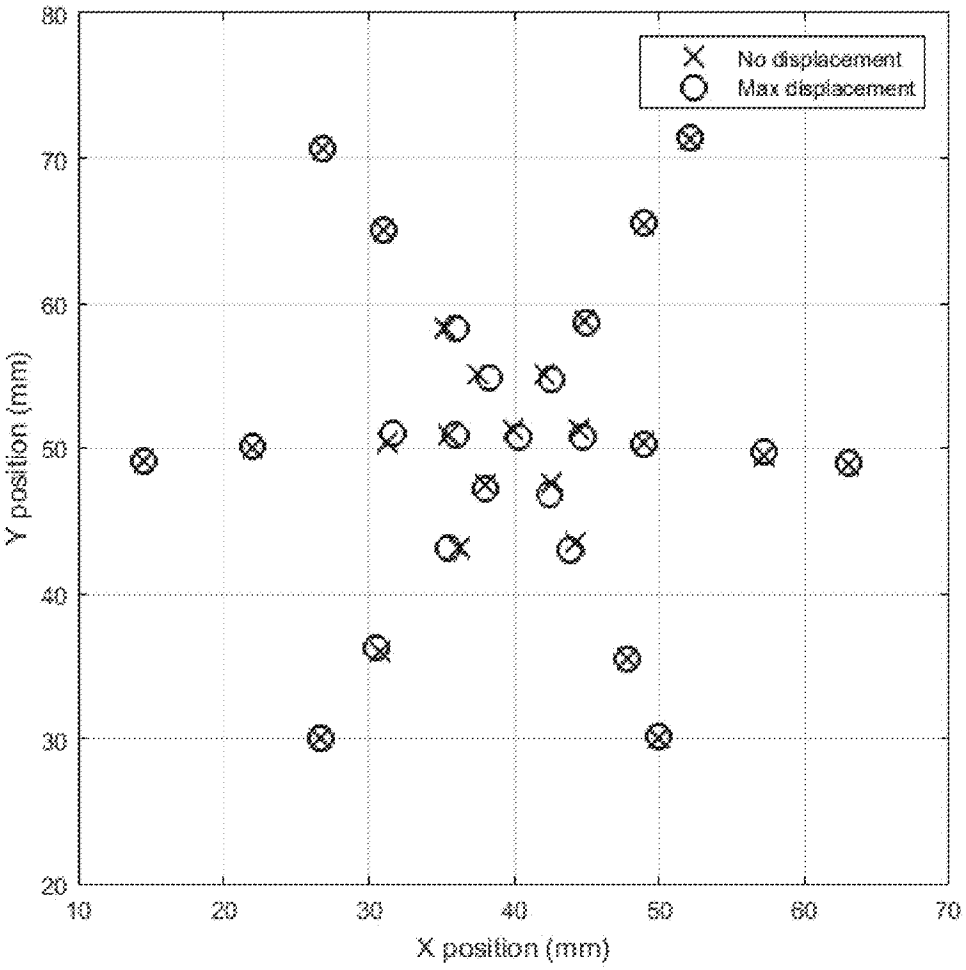

The cleansing device and the camera were turned on. During the counter-rotation of the cleansing head, each mark on the silicone film was tracked and the distance of each marker position to its mean position was calculated. For each marker, the maximum displacement from the mean was calculated and multiplied by 2 to estimate the range. An image analysis algorithm was written in Python and using OpenCV. The analysis tracks the measurement points in each frame of the video and calculates the displacement of the marks on the silicone film. FIG. 11C shows displacement measured by the camera in millimeters. It can be seen from FIG. 11C that the displacement of about 5.4 mm resulted in silicone displacement of about 1 mm at some of the measured points, corresponding to a range of about 2 mm.

Example 3

An 8 week cleansing trial was conducted using human subjects. The cleansing device of Example 2 was used in the study except that the type of cleansing features were varied as shown in Table 2 and the rate of counter-oscillation was 15 Hz. Amplitude of the counter-oscillation was 5 mm. The cleansing device further included an onboard data gathering and logging system to record use parameters, such as time of use and force applied to the cleansing head during use. The cleanser of Example 2 was employed in the study. Table 2 summarizes the protocol and parameters of the cleansing trial and lists the cleansing features employed in the trial.

TABLE 2

Protocol synopsis of Example 3.

| | |
|---|---|
| Cleansing Device | Group 1: Cleansing features - Interlinks (FIG. 2, Design 9), Shore A = 20<br>Group 2: Cleansing features - Interlinks, Shore A = 40<br>Group 3: Cleansing features - Split Alpha (FIG. 2, Design 11), Shore A = 20<br>Group 4: Cleansing features - Split Alpha, Shore A = 40 |
| Trial Design | Baseline Visit:<br>1. All study groups arrived at clinical study site.<br>2. Clinical staff randomly assigned participants into one of 4 study groups.<br>3. Study investigator clinically assessed each subject's facial skin.<br>4. Study participants completed a self-assessment of their facial skin.<br>5. Materials distributed to each participant: one cleansing device (of Group 1-4) and accompanying cleanser.<br>6. Participants completed their first cleansing session onsite, under the direction/guidance of trained clinical staff.<br>8. Study investigator clinically assessed each subject's facial skin following the first in-clinic use of the instrument.<br>9. Study participants completed a self-assessment of their facial skin following the first in-clinic use of the instrument.<br>10. Study participants took the study materials home and cleansed as instructed twice daily for 2 minutes to cleanse their facial skin.<br>Weeks 1 and 8:<br>1. Study participants returned to the clinical study site.<br>2. Study investigator clinically assessed each subject's facial skin.<br>3. Study participants completed a self-assessment of their facial skin.<br>Weeks 2, and 4:<br>1. Study participants returned to the clinical study site.<br>2. Study investigator clinically assessed each subject's facial skin.<br>3. Study participants completed a self-assessment of their facial skin. |
| Study Population | Females 30-75 years of age, Fitzpatrick I-VI, no more than 20% IV-VI |
| Number of Subjects | 60 subjects (15 subjects in each of Group 1-4, as randomly selected) |
| Endpoints | Primary Efficacy Endpoint:<br>The primary efficacy endpoint was the investigator-assessed ability of the assigned cleansing device to cleanse and improve the appearance of the face.<br>Secondary Efficacy Endpoint:<br>The secondary efficacy endpoint was the subject-assessed ability of the assigned cleansing device to cleanse and improve the appearance of the face. |
| Measures | Investigator evaluation of facial skin pre- and post-cleansing in office and at weeks 1, 2, 4, and 8: smoothness, softness, appearance of pores, texture, clarity, radiance, overall appearance, cleansing ability of the cleansing device/cleanser.<br>Subject assessment of facial skin pre- and post-cleansing in office and at weeks 1, 2, 4, and 8: smoothness, softness, appearance of pores, texture, clarity, radiance, overall appearance, cleansing ability of the cleansing device/cleanser. |
| Assessment Rating Scale | 0 = none<br>1 = minimal<br>2 = mild<br>3 = moderate<br>4 = severe |
| Statistical Methods | A Mann Whitney two-tailed test was used to analyze the nonparametric data. Significance was defined as 0.05 or less. |

Figure 12:
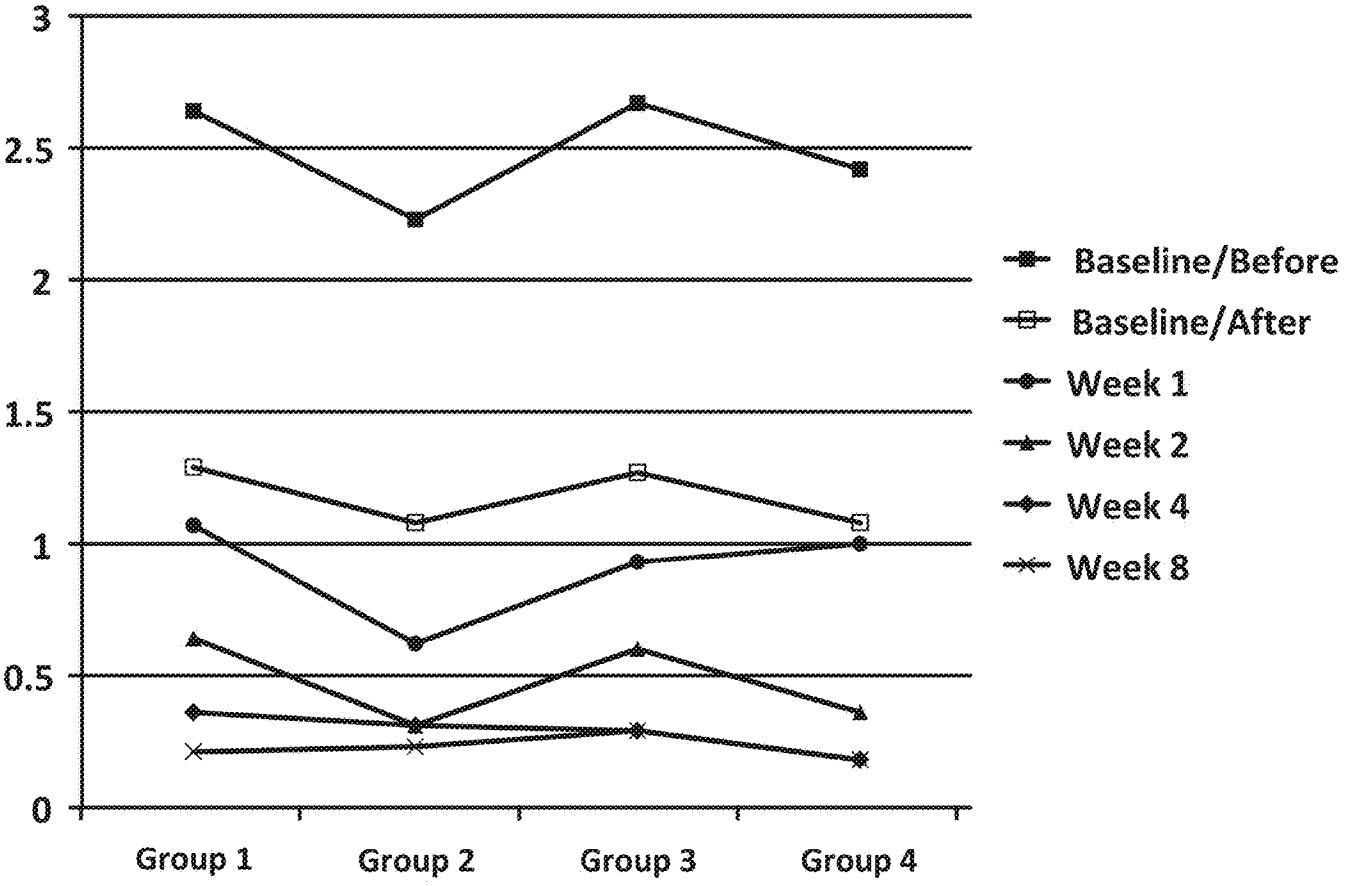
FIG. 12 illustrates a graph showing the assessment for lack of skin smoothness.
Figure 13:
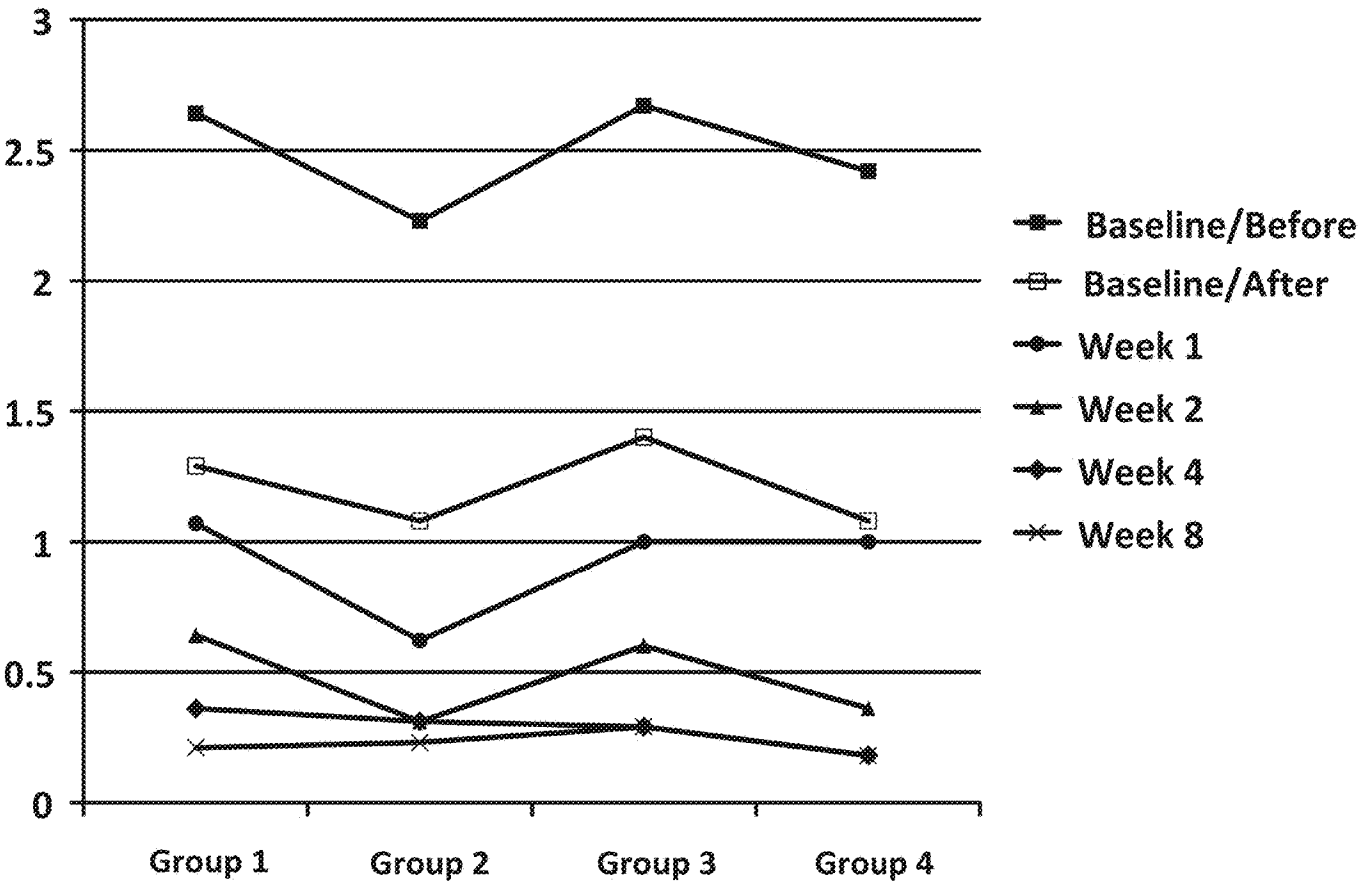
FIG. 13 illustrates a graph showing the assessment for lack of facial skin softness.
Figure 14:
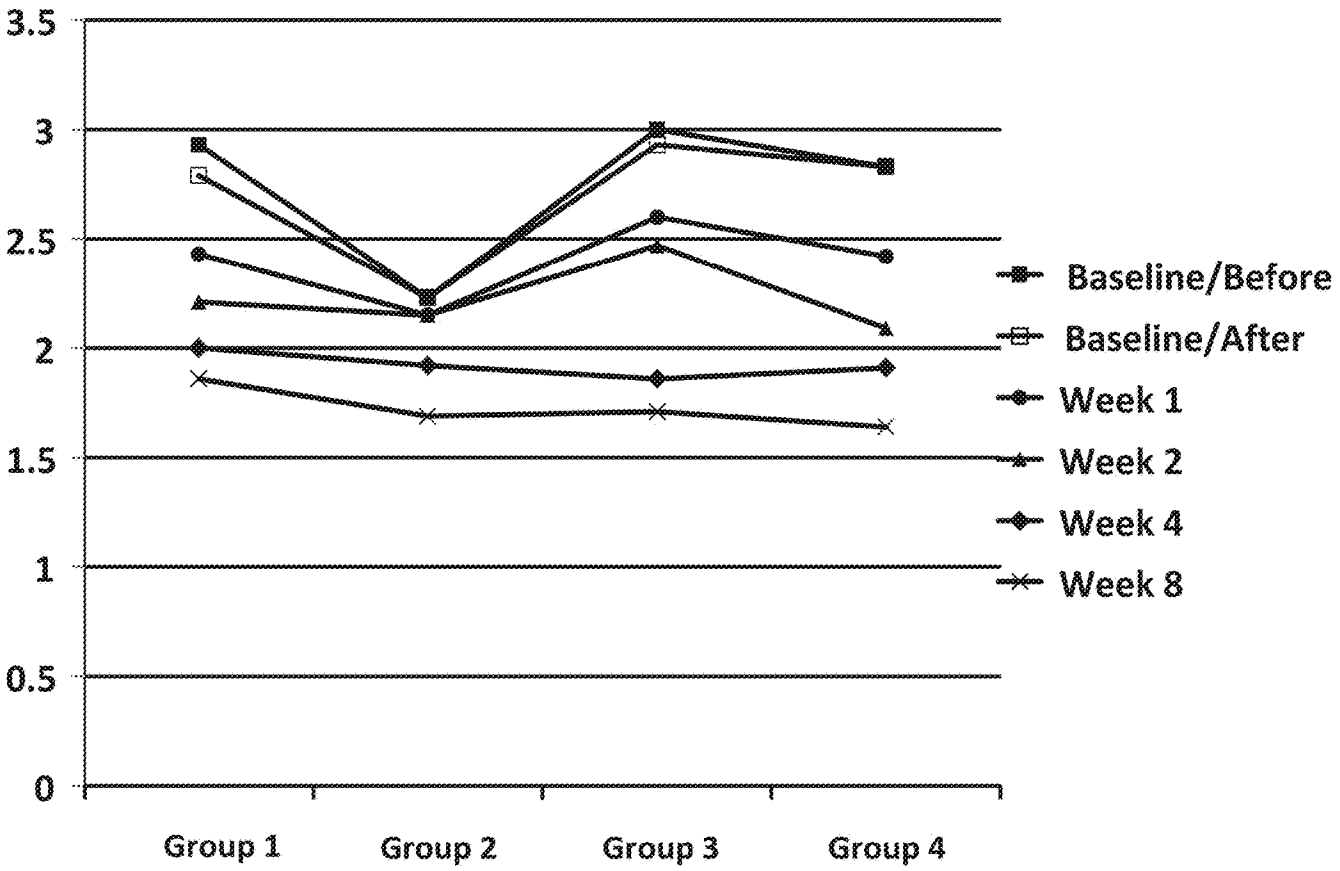
FIG. 14 illustrates a graph showing the assessment for the appearance of pores on the facial skin.
Figure 15:
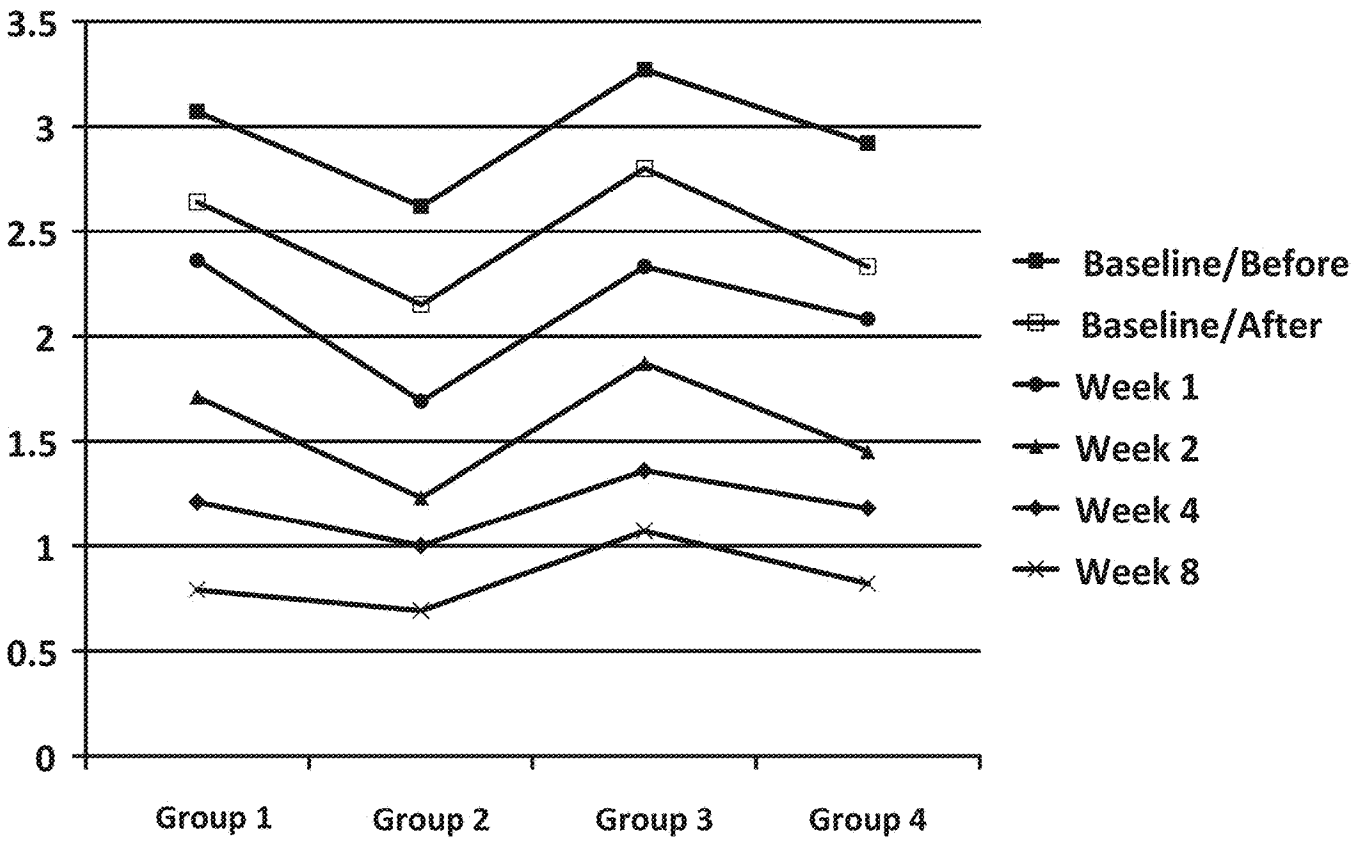
FIG. 15 illustrates a graph showing the assessment for poor facial skin texture.
Figure 16:
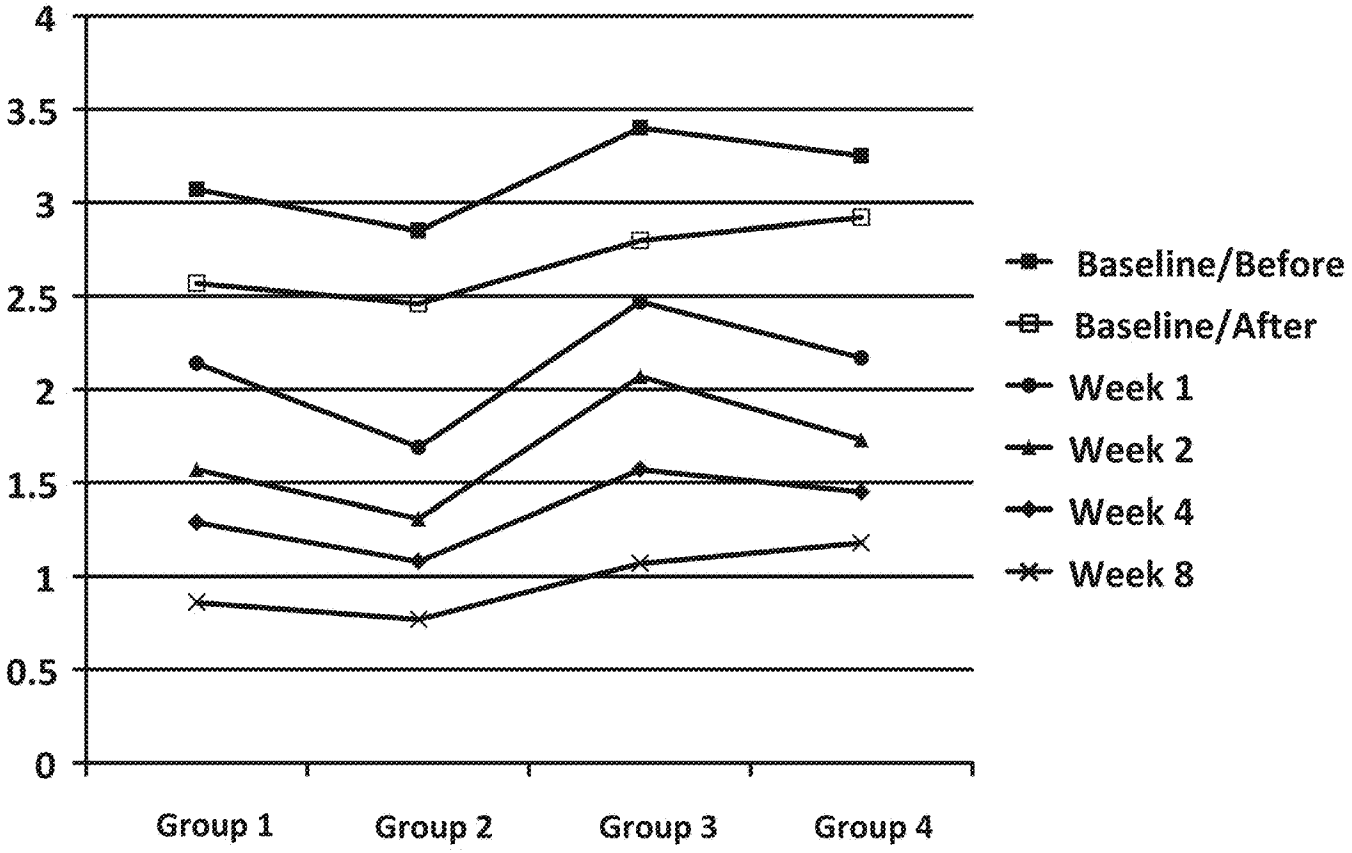
FIG. 16 illustrates a graph showing the assessment for lack of facial skin clarity.
Figure 17:
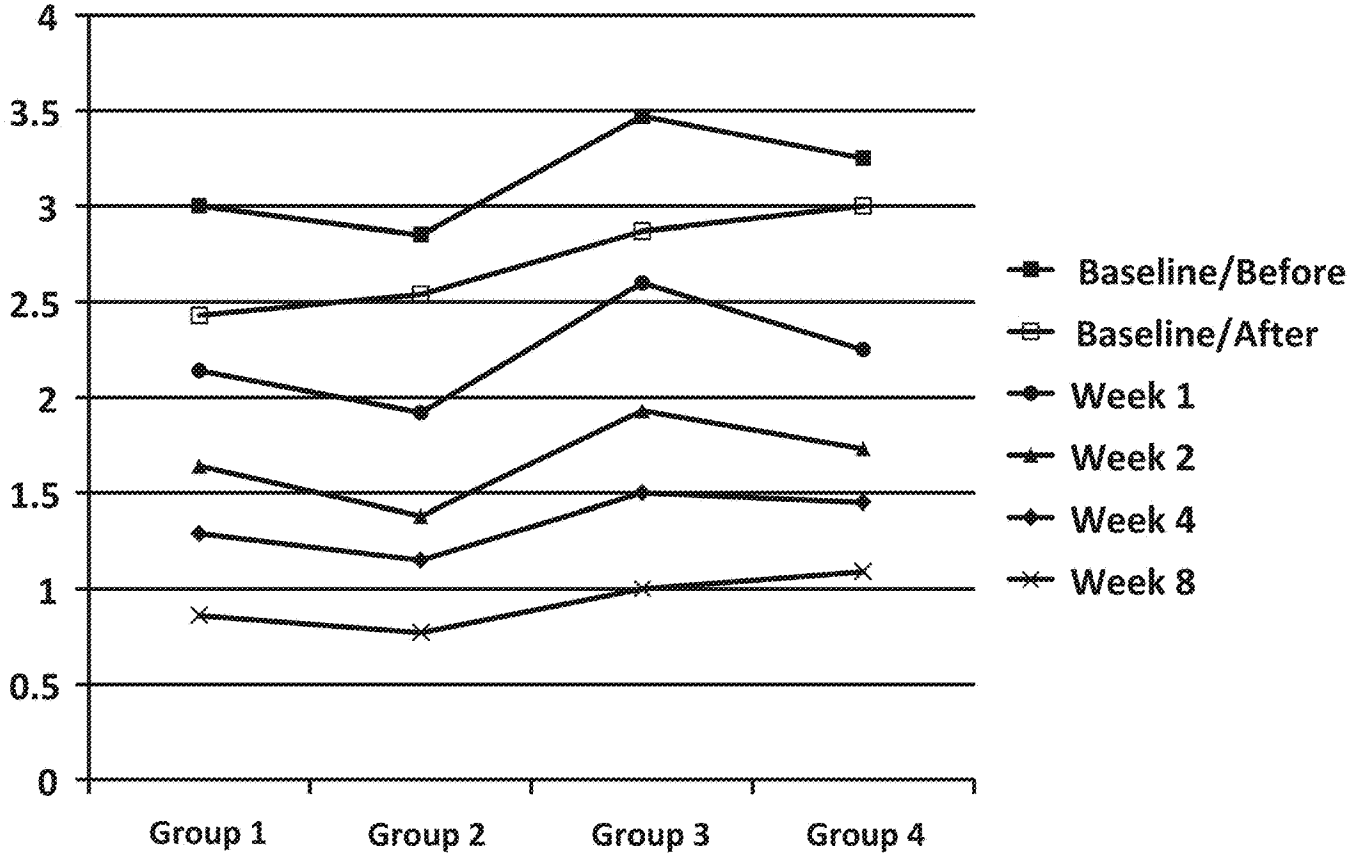
FIG. 17 illustrates a graph showing the assessment for lack of facial skin radiance.
Figure 18:
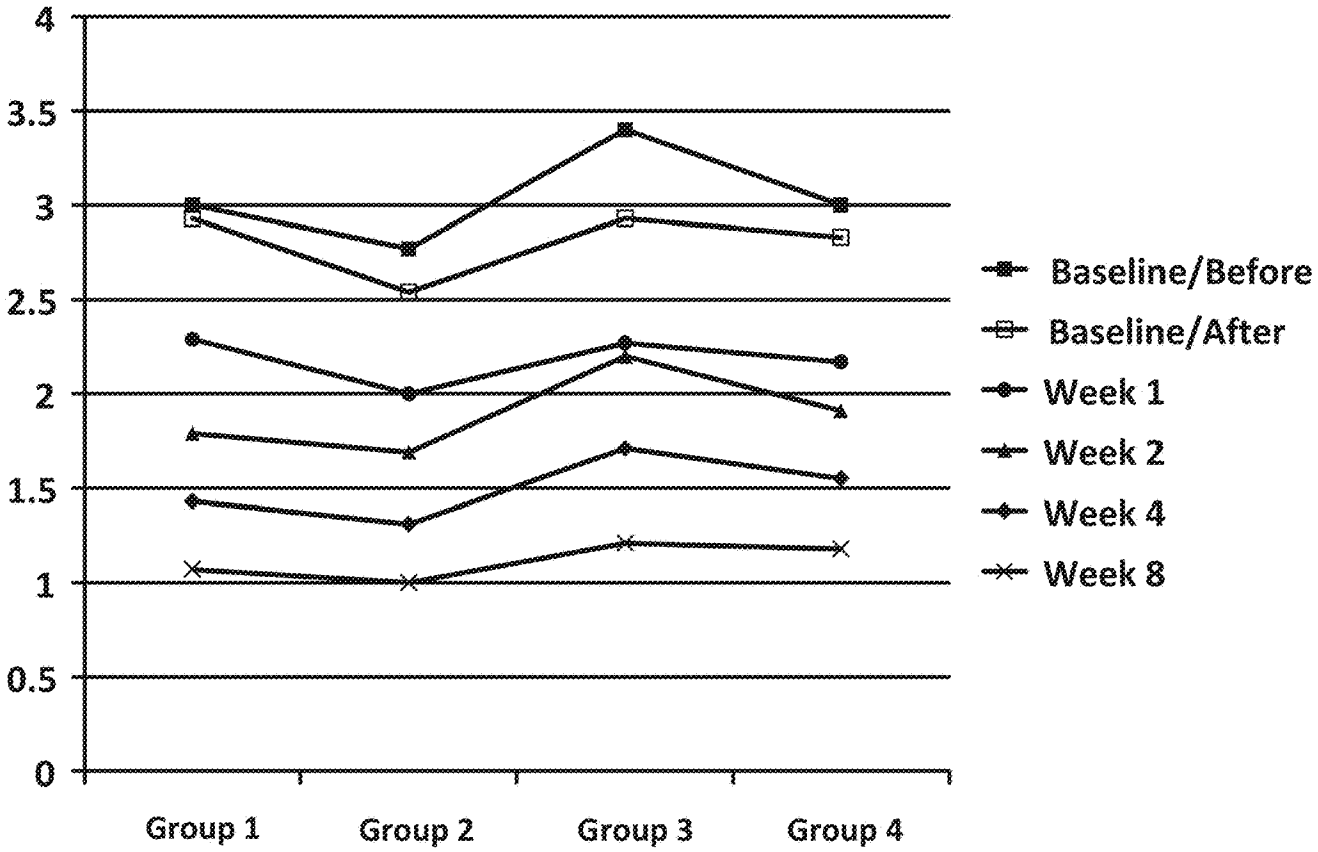
FIG. 18 illustrates a graph showing the assessment for overall facial skin appearance.
Figure 19:
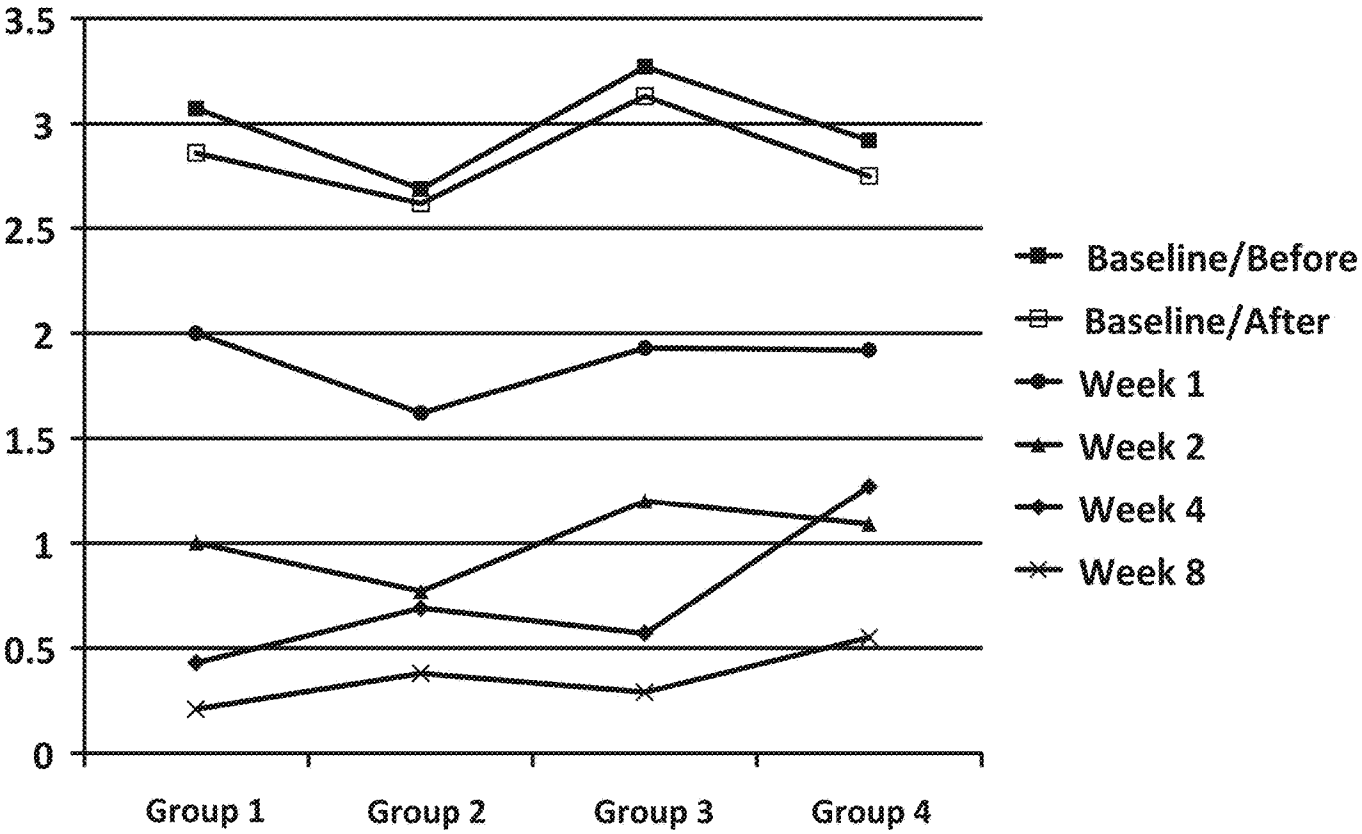
FIG. 19 illustrates a graph showing the assessment for lack of facial skin cleansing ability.

Results of the study according to the combined average ratings of the clinical grader assessment and the subject assessment scores is graphically depicted in FIGS. 12-19. Continuous improvement over the 8 week trial was observed in all ratings areas. FIG. 12 shows the assessment for lack of skin smoothness. FIG. 13 shows the assessment for lack of facial skin softness. FIG. 14 shows the assessment for the appearance of pores on the facial skin. FIG. 15 shows the assessment for poor facial skin texture. FIG. 16 shows the assessment for lack of facial skin clarity. FIG. 17 shows the assessment for lack of facial skin radiance. FIG. 18 shows the assessment for overall facial skin appearance. FIG. 19 shows the assessment for lack of facial skin cleansing ability.

ADDITIONAL EMBODIMENTS

In an embodiment, a device includes a cleansing head comprising one or more components of an actuator system (e.g., the secondary drive 202 of the actuator mechanism 200). The cleansing head further comprises a plurality of moving sections configured to make substantially non-linear (e.g., circular) counter-oscillation type movements to provide cyclical strain on skin to a particular tension and then allow the skin to relax. The non-linear counter-oscillation type movements may beneficially provide improved comfort and movement consistent with natural hand positioning during use. The moving sections comprise an inner circular section having a diameter of about 25.4 mm surrounded by an outer ring section having an inner diameter of about 26.4 mm and an outer diameter of about 41 mm. The moving sections further comprise one or more cleansing features having an elastomeric composition with a Shore A hardness of about 25. The cleansing features have an inverting mushroom design (FIG. 2, Design 8), Inter-links design (FIG. 2, Design 9), Split Alpha Blade design (FIG. 2, Design 11), or a combination thereof.

The device is configured such that, when in use, the inner circular section has a rotational amplitude of 36°±2° (an arc of about 7.8 mm) and the outer ring section has a rotational amplitude of 16°±2°. The cycle frequency (time per cycle) of each moving cleansing head section relative to contiguous moving cleansing head section(s), or relative to contiguous stationary cleansing head sections, is about 15 Hz. The device is further configured to cause skin displacement having amplitude of about 0 mm to 12 mm, or about 2 mm to 12 mm, or about 2 mm to 8 mm, or about 4 mm to 6 mm, or about 5 mm. The device may be configured to cause skin displacement such that the displacement does not exceed a maximum that would stretch dermis cells to the point that the cells are predicted to produce detrimental levels of pro-inflammatory agents. The grip and slip may be sufficient to move the skin to the point that skin resistance to further stretch exceeds the ability of the surface to grip.

The device is configured to provide a substantially constant amount of skin displacement across a broad range of skin resistance to stretch. In particular, the device is configured operate at a constant speed of 15 Hz over a wide range of resistance to movement. If a user applies a relatively high amount of pressure, the skin and underlying fat and muscle may resist to a relatively greater degree, but the motor still maintains the same frequency, applying greater current/torque to compensate for the greater resistance Skin Cleansing Head Section.

In certain embodiments, a skin cleansing system may include first and second skin cleansing head sections having first and second elastomeric cleansing features, respectively and an opposing movement boundary defined by and disposed between the first and second skin cleansing head sections. Both the first and the second skin cleansing head sections may be configured to translate relative to the other in a reciprocating motion in a plane common to the first and second skin cleansing head sections. The first and second cleansing features may have the same pattern of features. The first skin cleansing head section may be circular and the second skin cleansing head section is annular and disposed around the first skin cleansing head section. The reciprocating motion may have a component in a direction perpendicular to the plane common to the first and second skin cleansing head sections.

Multi-Pattern Configuration.

Certain embodiments may comprise different kinds of cleansing features on different cleansing head sections and/or within the same cleansing head section. For example, within a single cleansing head section, a first design (e.g., an inverting mushroom design) may be interspersed with or within a second design (e.g., a non-inverting mushroom design). As another example, there may be a first cleansing feature (e.g., an inverting mushroom design) on a first cleansing head section (e.g., an inner circle of the cleansing head) and a second cleansing feature (e.g., a split alpha blade design) on a second cleansing head section (e.g., an outer ring of the cleansing head).

Non-Planar Cleansing Head Sections.

Figure 20:
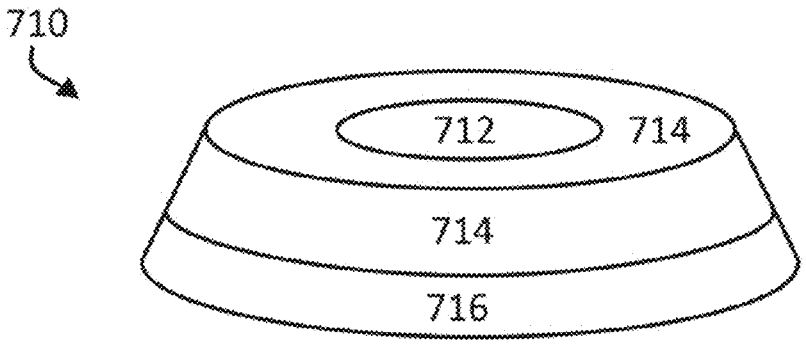
FIG. 20 illustrates a cleansing head having a three-dimensional, frustoconical shape.

While embodiments of cleansing heads have been shown as substantially planar (see e.g., FIG. 1B), the heads need not or need not only be planar. A cleansing head may comprise a substantially three-dimensional shape. For example, FIG. 20 illustrates a cleansing head 710 having a three-dimensional, frustoconical shape. The cleansing head comprises three cleansing head sections: section 712, section 714, and section 716. The placement of the cleansing head sections 712, 714, and 716 on different parts of the head may facilitate cleansing of hard-to-reach areas of the face such as corners near the nose, lower eyelids, mouth, and other areas. The sections 712, 714, and 716 may counter-oscillate relative to each other. While this embodiment of the cleansing head has been shown as having a frustoconical shape, other shapes are also possible, including but not limited to: cylinders, pyramids, prisms, spheres, cubes, other shapes, or combinations thereof.

Multiple Cleansing Head Section Configurations.

In certain embodiments, there may be multiple cleansing head sections. For example, there may be two, three, four, five, six, or more cleansing head sections. The sections may oscillate or otherwise move relative to one or more of the other sections. The sections may, but need not, be arranged in concentric, interlaced, circumscribed, overlapping, linear, non-linear, other fashions, or combinations thereof. For example, there may be interlocking head sections (e.g., like the Olympic Rings).

Sliding Pin Embodiment.

Figure 21B:
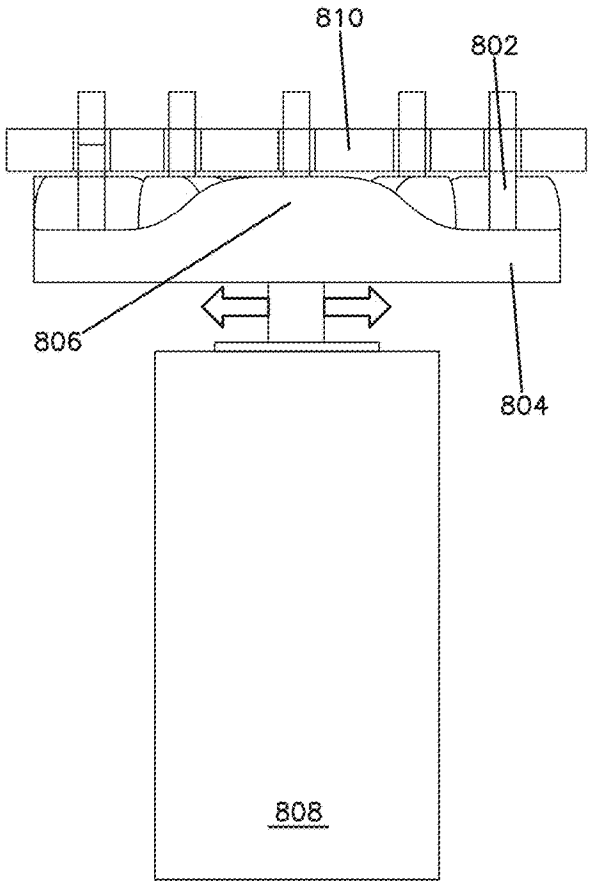
FIGS. 21A and 21B illustrate components of an embodiment for imparting force generally perpendicularly to skin with pins 802 in order to displace tissue.
Figure 21A:
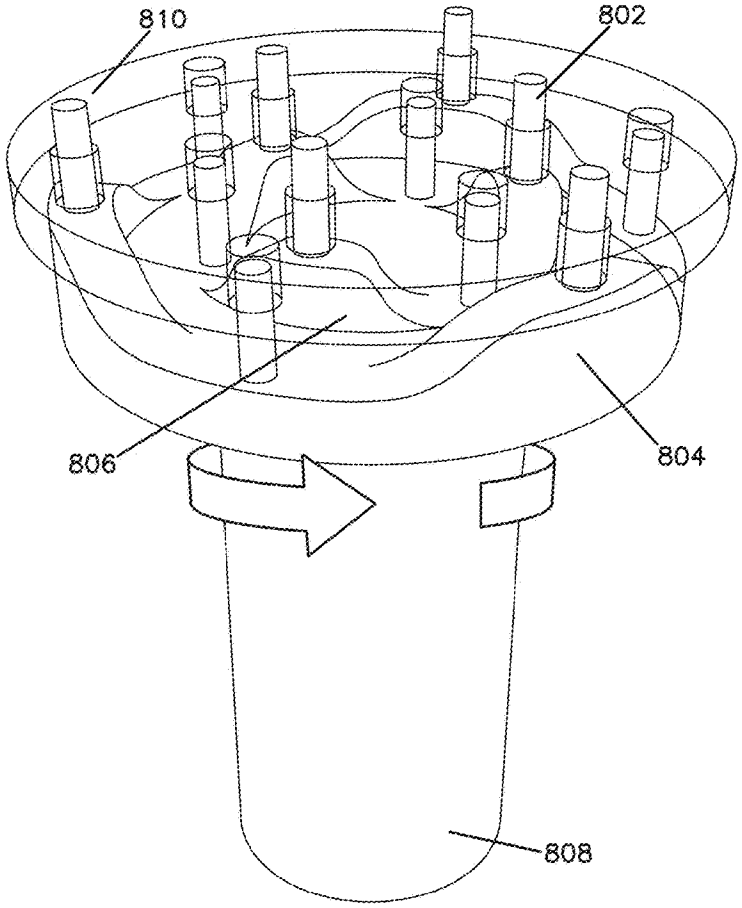

In certain embodiments, beneficial displacement (e.g., stretching and/or compression) of skin may be accomplished by imparting force in excess of hand pressure applied by the user of the device generally perpendicularly to the surface of skin, for example, by using a device with the features illustrated in FIGS. 21A and 21B. In particular, these figures illustrate components of an embodiment for imparting force generally perpendicularly to skin with pins 802 in order to displace tissue. The pins 802 may be blunt, non-penetrating pins that ride on a rotating cam 804 driven by a motor 808 and are configured to slide through openings in a plate 810. The rotating cam 804 includes ramps 806, which are sections of the rotating cam 804 having an increased height. For example, as illustrated in FIGS. 21A and 21B, the ramps 806 have a curved incline portion, a relatively flat plateau and then a curve decline portion. Other configurations of ramps 806 are also possible and may include wavy, bumpy, flat, or other configurations.

To use the device, a user contacts the plate 810 of the device to his or her own face, and turns the device on to start the skin-stretching movement. As the rotating cam 804 rotates, the ramps 806 cause certain pins 802 to raise or lower, with some of the pins 802 extending through a plate 810 to stretch or otherwise displace a user's skin. The sliding pin configuration of this device may enable the device to provide improved skin displacement to regions typically covered with hair, such as the top of a user's head or the skin of the face of a bearded user.

Connectivity and Coaching.

In certain embodiments, the device may include functionality for connecting to a separate device for added functionality. For example, the device may be configured to make a wired or wireless (e.g., via Bluetooth, Wi-Fi, or other wireless communications technologies) connections with a mobile phone, tablet, computer, or other separate device. The connectivity may enable various features, such as tracking usage of the device, tracking pressure applied to the cleansing head by a user during use of the device, reminding the user to use the device, controlling the functionality of the device, and other functionality. As a particular example, the user may pair the device with his or her mobile phone using Bluetooth, and launch an application on the phone. The application may receive data from the device and coach the user on optimal use of the treatment device. For example, the application may receive data (e.g., current draw of the motor of the device) from the device that the user is applying the device with too firm or too light of pressure to his or her face and provide an alert to the user. The application may also provide diagrams or videos showing the user proper use of the device. The application may also tell the user when and where to apply the device next.

Variable Adjustment.

Certain embodiments of the device may provide a feature for adjusting features of the device, such as the amount of skin displacement provided by the device or the frequency of the displacement motion. Certain embodiments may provide adjustments for the amount of skin displacement by providing an adjuster that controls a distance traveled by a displaceable section of the head. For example, the device may include, as a primary mover for a displaceable section of the head, a stepper motor having rotational displacement controlled electronically and incrementally. The motor may be configured to cause a displaceable section of a cleansing head to travel a first adjustable distance before reversing and traveling back the first adjustable distance. For example, the motor may be configured to rotate a first distance before reversing. The first distance may be modifiable by a user (e.g., via a switch or a control knob) to control the amount of skin displacement provided by the device. In a particular implementation, the distance may be anywhere within the range of about 0.5 mm to 8 mm. This then allows the adjustment of the amount of skin stretching displacement based on the stick-slip action described above. Devices may also provide features to enable users to determine the type of skin they have, how strongly their skin resists displacement, what frequency provides best results, and so on to configure the device accordingly.

In certain embodiments, the frequency and/or displacement may vary as part of a pattern of cleansing. For example, there may be periods (e.g., 10 seconds, 20 seconds, or other periods of time) of elevated or decreased frequency and/or displacement. In certain embodiments, the frequency and the displacement may have an inverse relationship, such that when the frequency increases, the displacement decreases, or vice versa. The pattern of cleansing may correspond to different portions of a user's body. For example, a first frequency and/or displacement setting may be used in a first region of the body (e.g., a user's forehead) and a second frequency and/or displacement setting may be used in a second region of the body (e.g., a user's under-eye area). The regions of the body may be selected based on characteristics of skin, such as thickness or thinness.

Pore Displacement.

Without being limited to a particular theory, the stick-slip motion may cause the deformation of pores and facilitate the cleansing thereof. For example, the device may straddle a pore with features that move in opposite directions and open or otherwise deform the pore opening and/or areas proximal to the pore. The deformation of the pore may cause the movement of cleanser into and out of the pore to facilitate cleansing thereof.

Relationship Between Handle and Head Sections.

The head section of the device may define a first axis in the direction at which the head section generally extends. Similarly, the handle section may define a second axis in the direction at which the handle section generally extends. The relationship between the first and second axes may vary based on design considerations, including ergonomics, mechanism placement, aesthetics, and other factors. In certain embodiments, the angle between the axes may be 0° (the head and handle being substantially aligned with each other), 30°, 45°, 90° (the head and handle being substantially perpendicular to each other), and/or other relationships. In certain embodiments, the handle and head sections may be separable to facilitate the swapping of heads (e.g., to provide different or improved functionality), cleaning of the device, maintenance, or other functions.

Embodiments of Shape 9 (Inter-Links Feature).

Figure 22B:
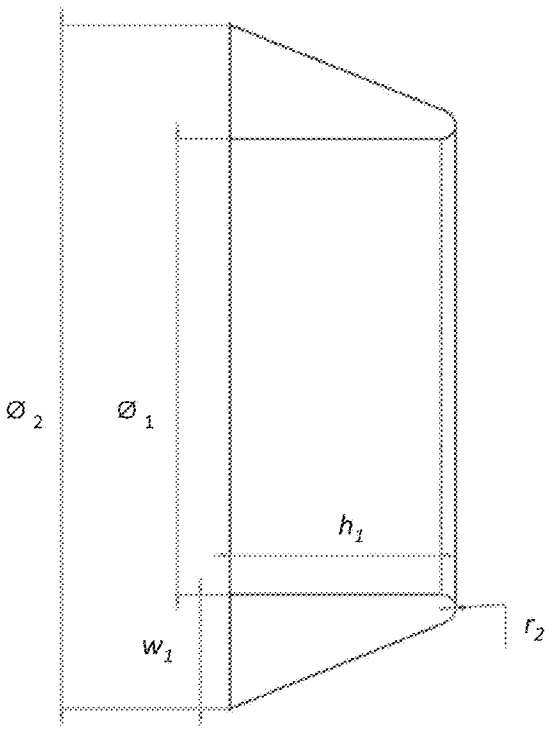
FIGS. 22A and 22B illustrate top and side views, respectively, of an embodiment of an inter-links feature shape.
Figure 22A:
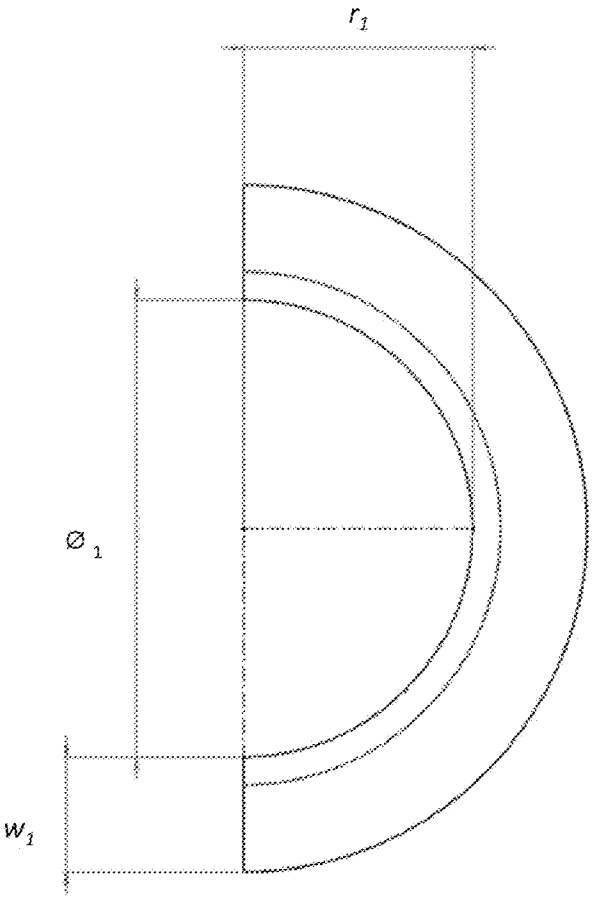

FIGS. 22A and 22B illustrate top and side views, respectively, of a link of shape 9 (inter-links) according to certain embodiments. The link may have an inner radius $r_1$ of various sizes, including but not limited to about 0.5 mm to 3 mm, or about 0.5 mm to 2.5 mm, or about 1 mm to 2.5 mm, or about 1 mm to 2 mm, or about 1.4 mm to 2 mm, or about 1.5 mm to 1.7 mm, or about 1.55 mm to 1.7 mm, or about 1.55 mm to 1.65 mm, or about 1.6 mm. The link may have a diameter $ø_1$ substantially perpendicular to the radius $r_1$. In embodiments where the link is approximately half-circle shaped, the diameter $ø_1$ may be substantially 2× the radius $r_1$. In embodiments where the link is semi-ellipsoid, the diameter $ø_1$ may have a different relationship with the radius $r_1$, including but not limited to about 0.25× to 1.75×, or about 0.5× to 1.75×, or about 0.5× to 1.5×, or about 0.75× to 1.5×, or about 0.75× to 1.25×, or about 1× the radius $r_1$. Depending on the angle of the segment, one or more of the links may overlap or otherwise intersect. The link may have a width $w_1$ of various sizes, including but not limited to about 0.2 mm to 1.4 mm, or about 0.2 mm to 1.2 mm, or about 0.4 mm to 1.2 mm, or about 0.4 mm to 1 mm, or about 0.6 mm to 1 mm, or about 0.6 mm to 0.9 mm, or about 0.7 mm to 0.9 mm, or about 0.7 mm to 0.85 mm, or about 0.75 mm to 0.85 mm, or about 0.8 mm.

The link may have an outer diameter $ø_2$ of approximately diameter $ø_1$ plus twice the width $w_1$. The link may have a height $h_1$ from the base of the link to the base of a rounded portion of the link of various sizes, including but not limited to about 0.25 mm to 3 mm, or about 0.25 mm to 2.5 mm, or about 0.75 mm to 3 mm, or about 0.75 mm to 2.5 mm, or about 1.25 mm to 2.5 mm, or about 1.25 mm to 2 mm, or about 1.4 mm to 2 mm, or about 1.4 mm to 1.6 mm, or about 1.5 mm, or about 1.48 mm. The rounded portion of the link may have a radius $r_2$ of various sizes, including but not limited to about 0 mm (no rounding) to 0.4 mm, or about 0 mm to 0.3 mm, or about 0.03 mm to 0.3 mm, or about 0.03 mm to 0.2 mm, or about 0.06 mm to 0.2 mm, or about 0.06 mm to 0.15 mm, or about 0.09 mm to 0.15 mm, or about 0.09 mm to 0.12 mm, or about 0.1 mm. While the link is shown as being a half of a circle (e.g., about a 180° segment), in certain embodiments, the link may be a segment having a different angle, including but not limited to about 0° to 360°, or about 0° to 270°, or about 90° to 270°, or about 90° to 210°, or about 120° to 210°, or about 180°.

Embodiments of Shape 11 (Split Alpha Feature).

Figure 23B:
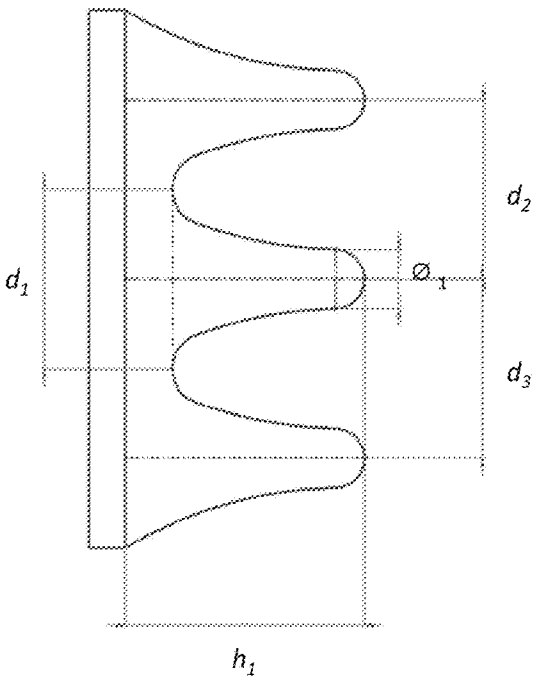
FIGS. 23A and 23B illustrate top and side views, respectively, of an embodiment of a split alpha blade feature shape.
Figure 23A:
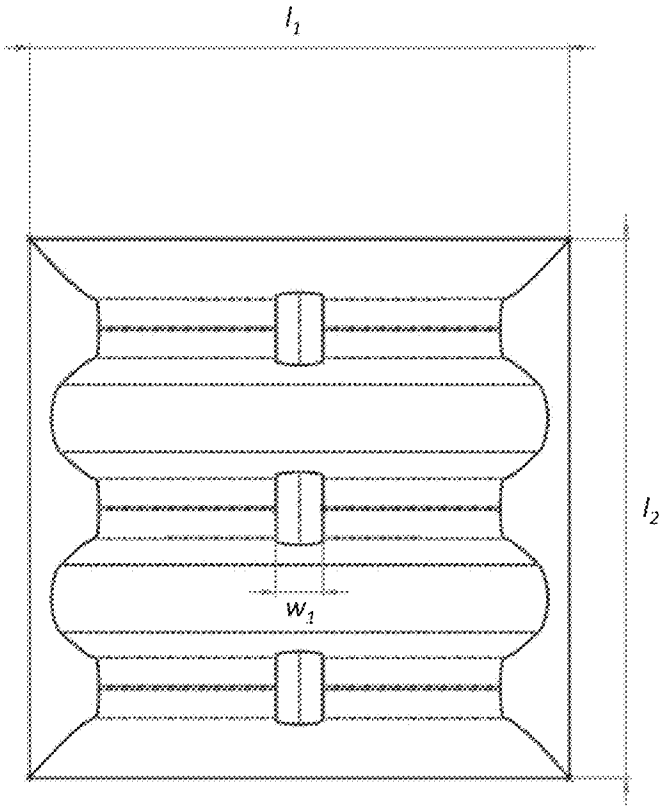

FIGS. 23A and 23B illustrate top and side views, respectively, of an embodiment of shape 11 (split alpha blade) according to certain embodiments. A first pair of opposite sides of the embodiment may have a length $l_1$ of various sizes including, but not limited to about 2.5 mm to 6.5 mm, or about 2.5 mm to 6 mm, or about 3 mm to 6 mm, or about 3 mm to 5.5 mm, or about 3.5 mm to 5.5 mm, or about 3.5 mm to 5 mm, or about 4 mm to 5 mm, or about 4 mm to 4.75 mm, or about 4.25 mm to 4.75 mm, or about 4.5 mm. A second pair of opposite sides of the embodiment may have a length of various sizes related to the length $l_1$, including but not limited to about 0.25× to about 2×, or about 0.25× to 1.75×, or about 0.5× to 1.75×, or about 0.5× to 1.5×, or about 0.75× to 1.5×, or about 0.75× to 1.25×, or about 1× the length $l_1$. The notch of the embodiment may have a width $w_1$ of various sizes, including but not limited to about 0.1 mm to 0.7 mm, or about 0.1 mm to 0.6 mm, or about 0.2 mm to 0.6 mm, or about 0.2 mm to 0.5 mm, or about 0.3 mm to 0.5 mm, or about 0.3 mm to 0.45 mm, or about 0.35 mm to 0.45 mm, or about 0.4 mm.

A distance $d_1$ between the centers of troughs of the embodiment may be of various sizes, including but not limited to about 0.5 mm to 3.5 mm, or about 0.5 mm to 3 mm, or about 1 mm to 3 mm, or about 1 mm to 2.5 mm, or about 1.25 mm to 2.5 mm, or about 1.25 mm to 2 mm, or about 1.25 mm to 2 mm, or about 1.25 mm to 1.75 mm, or about 1.5 mm. A distance $d_2$ between first and second peaks of the embodiment may have various sizes, including but not limited to about 0.5 mm to 3.5 mm, or about 0.5 mm to 3 mm, or about 1 mm to 3 mm, or about 1 mm to 2.5 mm, or about 1.25 mm to 2.5 mm, or about 1.25 mm to 2 mm, or about 1.25 mm to 2 mm, or about 1.25 mm to 1.75 mm, or about 1.5 mm. A distance $d_3$ between second and third peaks of the embodiment may have various sizes, including but not limited to about 0.5 mm to 3.5 mm, or about 0.5 mm to 3 mm, or about 1 mm to 3 mm, or about 1 mm to 2.5 mm, or about 1.25 mm to 2.5 mm, or about 1.25 mm to 2 mm, or about 1.25 mm to 2 mm, or about 1.25 mm to 1.75 mm, or about 1.5 mm. One or more of the peaks may have a rounded tip, the rounded tip having a diameter $ø_1$ of various sizes including but not limited to about 0.1 mm to 1.5 mm, or about 0.1 mm to 1.25 mm, or about 0.2 mm to 1.25 mm, or about 0.2 mm to 1 mm, or about 0.3 mm to 1 mm, or about 0.3 mm to 0.75 mm, or about 0.4 mm to 0.75 mm, or about 0.4 mm to 0.6 mm, or about 0.5 mm. The peaks may have a height $h_1$ from the base of various sizes, including but not limited to about 0.5 mm to 5 mm, or about 0.5 mm to 4 mm, or about 0.75 mm to 4 mm, or about 0.75 mm to 3 mm, or about 1 mm to 3 mm, or about 1 mm to 2.5 mm, or about 1.5 mm to 2.5 mm, or about 1.5 mm to 2.25 mm, or about 1.75 mm to 2.25 mm, or about 2 mm.

Dimensions of Shape 8 and 10 (Inverting and Non-Inverting Mushrooms).

Figure 24B:
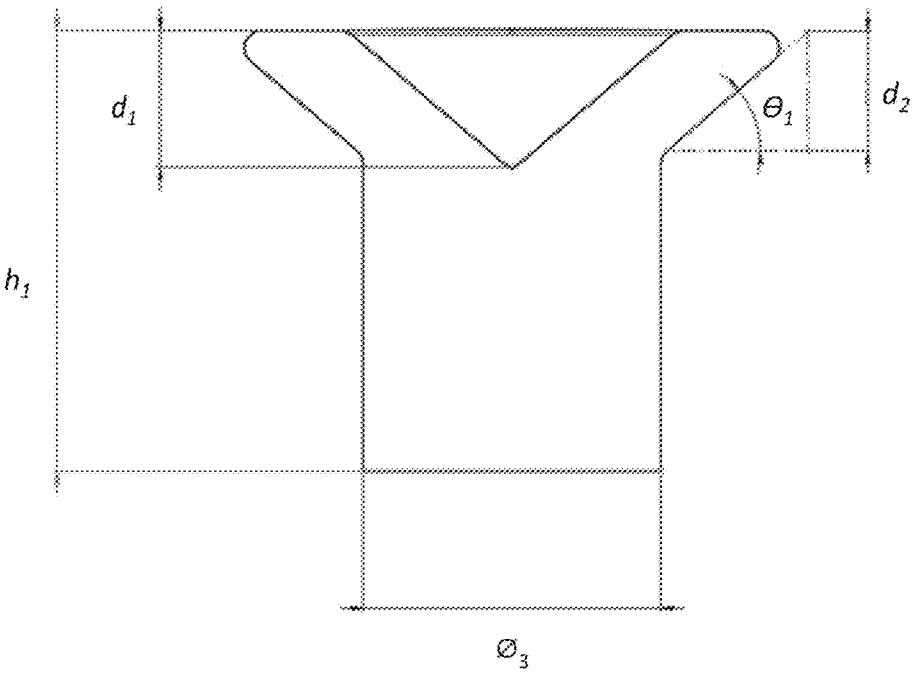
FIGS. 24A and 24B illustrate top and side views, respectively, of an embodiment of inverting and non-inverting mushroom features.
Figure 24A:
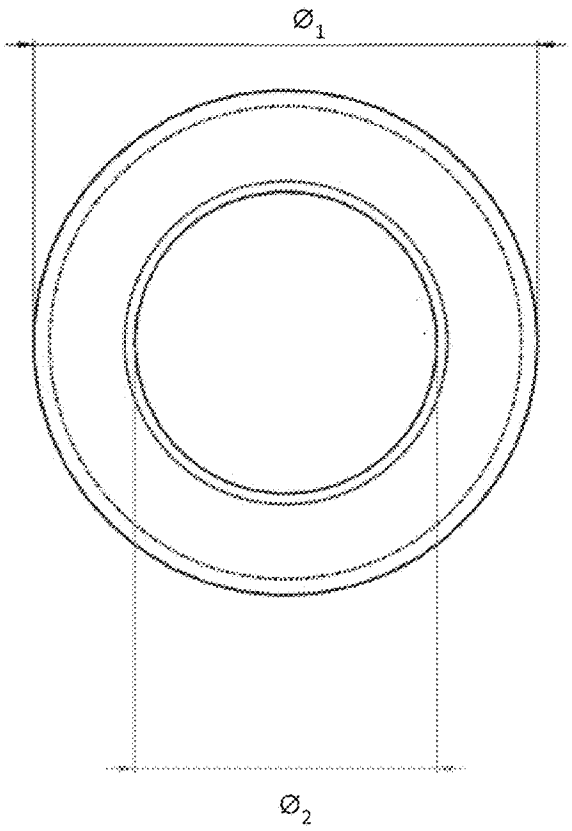

FIGS. 24A and 24B illustrate top and side views, respectively, of an embodiment of shape 8 and 10 (inverting and non-inverting mushroom features). The embodiment may have an outer diameter $ø_1$ of various sizes, including but not limited to about 1 mm to 6 mm, or about 1 mm to 5 mm, or about 2 mm to 5 mm, or about 2 mm to 4 mm, or about 2.5 mm to 4 mm, or about 2.5 mm to 3.55 mm, or about 2.75 mm to 3.55 mm, or about 2.75 mm to 3.25 mm, or about 3.05 mm to 3.25 mm, or about 3.15 mm. The embodiment may have an inner diameter $ø_2$ of various sizes, including but not limited to about 0.9 mm to 4 mm, or about 0.9 mm to 3 mm, or about 1.1 mm to 3 mm, or about 1.1 mm to 2.7 mm, or about 1.4 mm to 2.7 mm, or about 1.4 mm to 2.4 mm, or about 1.8 mm to 2.4 mm, or about 1.8 mm to 2 mm, or about 1.9 mm.

The embodiment may have a base diameter $ø_3$ of various sizes, including but not limited to about 0.75 mm to 2.75 mm, or about 0.75 mm to 2.5 mm, or about 1 mm to 2.5 mm, or about 1 mm to 2.25 mm, or about 1.25 mm to 2.25 mm, or about 1.25 mm to 2 mm, or about 1.5 mm to 2 mm, or about 1.5 mm to 1.8 mm, or about 1.7 mm to 1.8 mm, or about 1.75 mm. The embodiment may have a height $h_1$ of various sizes, including but not limited to about 1 mm to 5 mm, or about 1 mm to 4 mm, or about 1.6 mm to 4 mm, or about 1.6 mm to 3.6 mm, or about 2.1 mm to 3.6 mm, or about 2.1 mm to 3.1 mm, or about 2.4 mm to 3.1 mm, or about 2.4 mm to 2.8 mm, or about 2.6 mm. The top of the embodiment may have a depression having a depth $d_1$ of various sizes, including but not limited to about 0 mm (no depression) to about 1.4 mm, or about 0.2 mm to 1.4 mm, or about 0.4 mm to 1.4 mm, or about 0.4 mm to 1.2 mm, or about 0.6 mm to 1.2 mm, or about 0.6 mm to 1 mm, or about 0.7 mm to 1 mm, or about 0.7 mm to 0.9 mm, or about 0.8 mm. The embodiment may have a distance $d_2$ from the top of the mushroom to a diameter transition portion of various sizes, including but not limited to about 0.1 mm to 1.3 mm, or about 1.3 mm to 1.3 mm, or about 0.3 mm to 1.1 mm, or about 0.5 mm to 1.1 mm, or about 0.5 mm to 0.9 mm, or about 0.6 mm to 0.9 mm, or about 0.6 mm to 0.8 mm, or about 0.7 mm. The embodiment may have an angle $\theta_1$ between the diameter transition portion and an outer surface of the embodiment of various amounts including but not limited to about 0° to 180°, or about 0° to 135°, or about 10° to 135°, or about 10° to 110°, or about 20° to 110°, or about 20° to 85°, or about 30° to 85°, or about 30° to 60°, or about 35° to 60°, or about 35° to 55°, or about 40°.

Additional or Alternative Uses.

While certain embodiments have primarily been described in the context of cleansing, disclosed embodiments need not or need not only be used for that purpose. In certain embodiments, embodiments may be used for skin treatments (e.g., anti-aging treatment, anti-acne treatment, pore reduction treatment, callus treatment, or other treatments), application of products to skin (e.g., sunscreen, moisturizer, anti-aging cream, or other products), or other applications.

The device may be packaged into a kit comprising interchangeable cleansing head sections of varying designs. A user may select a desired design to correspond to a desired level of stretch intensity or effectiveness for the user's individual skin type. The interchangeability may be accomplished by enabling the cleansing features, one or more cleansing head sections, and/or the cleansing head to be interchangeable.

The invention illustratively disclosed herein can be suitably practiced in the absence of any element which is not specifically disclosed herein. While the invention is susceptible to various modifications and alternative forms, specifics thereof have been shown by way of examples, and are described in detail. It should be understood, however, that the invention is not limited to the particular embodiments described. On the contrary, the intention is to cover modifications, equivalents, and alternatives falling within the spirit and scope of the invention. In various embodiments, the invention suitably comprises, consists essentially of, or consists of the elements described herein and claimed according to the claims.

Additionally each and every embodiment of the invention, as described here, is intended to be used either alone or in combination with any other embodiment described herein as well as modifications, equivalents, and alternatives thereof falling within the spirit and scope of the invention. The various embodiments described above are provided by way of illustration only and should not be construed to limit the claims attached hereto. It will be recognized that various modifications and changes may be made without following the example embodiments and applications illustrated and described herein, and without departing from the true spirit and scope of the claims.

The invention claimed is:

1. A cleansing device comprising a handle;

an electrical motor disposed within the handle and attached to an actuator, said motor and actuator adapted to apply an oscillating movement at a frequency of about 5 Hz to 30 Hz; and a cleansing head having a first major surface and a second major surface, the first major surface comprising a plurality of elastomeric cleansing features extending away from the first surface and having a width-to-height aspect ratio of about 1:5 to 10:1, further wherein the plurality of cleansing features has a substantially continuous contact surface of about 1 $mm^2$ to 5 $mm^2$ for stick-slip contacting skin and sliding across cell surfaces with a squeegee action;

wherein the actuator is attached to the second major surface of the cleansing head to apply oscillating movement thereto, wherein the oscillating movement provides a total displacement per oscillation of about 0.5 mm to 8 mm, comprising a stick phase and a slip phase of cleansing action.

2. The cleansing device of claim 1 wherein the cleansing head is partitioned into two or more cleansing head sections.

3. The cleansing device of claim 1 wherein the oscillation is an arcuate or circular oscillation.

4. The cleansing device of claim 1 wherein the cleansing head first major surface comprises more than one cleansing feature shape, relative cleansing feature orientation, or both.

5. The cleansing device of claim 1 wherein the first major surface comprises between 2 and 100 cleansing features per square centimeter.

6. The cleansing device of claim 1 wherein the cleansing features are integral with the cleansing head first major surface.

7. The cleansing device of claim 1 wherein the elastomer is characterized by a fully reversible strain of about 5%-700%, Shore A hardness of about 10 to 50, and a coefficient of friction against human facial skin of about 0.2 to 0.8.

8. The cleansing device of the claim 1 wherein the cleansing features comprise a prismatic or frusto-prismatic shape having a base footprint of about 0.1 mm to 10 mm in the longest dimension, and a height of about 0.5 mm to 5 mm.

9. The cleansing device of claim 1 wherein the elastomer comprises polydimethylsiloxane or a thermoplastic polyurethane.

10. The cleansing device of claim 1 wherein the elastomer comprises an antibacterial silver composition.

11. The cleansing device of claim 1 wherein the total displacement is about 2 mm to 8 mm.

12. The cleansing device of claim 1 wherein the actuator is removably attached to the second major surface of the cleansing head.

13. The cleansing device of claim 1 further comprising a cleansing composition applied on at least a portion of the first major surface of the cleansing head.

14. The cleansing device of claim 1 wherein the handle comprises one or more adjustment control features for adjusting the oscillating movement frequency over a range of about 5 Hz to 30 Hz, or the total displacement over a range of about 0.5 mm to 8 mm, or both.

15. The cleansing device of claim 14 wherein a single adjustment control feature is adapted to adjust both the oscillating movement frequency and the total displacement.

16. The cleansing device of claim 1 wherein the oscillating movement results in a stick-slip action of cleansing features relative to skin surfaces in frictional contact with the surface of the cleansing features.

17. A method for using the skin cleansing device of claim 1, wherein the oscillating movement effects a skin displacement of about 5% to 100% of the total displacement of the cleansing head, or about 5% to 90%, or about 10% to 90%, or about 20% to 90%, or about 25% to 90%, or about 30% to 90%, or about 40% to 90%, or about 50% to 90%, or about 5% to 80%, or about 5% to 70%, or about 5% to 60%, or about 5% to 50%, or about 10% to 70%, or about 20% to 60% of the displacement of the cleansing head.

18. A skin cleansing system comprising a device with a handle;

an electrical motor disposed within the handle and attached to an actuator, said motor and actuator adapted to apply an oscillating movement at a frequency of about 5 Hz to 30 Hz; and a substantially planar cleansing head having a first major surface and a second major surface and partitioned into two or more cleansing head sections, the first major surface comprising a plurality of elastomeric cleansing features extending away from the first surface and having an aspect ratio of about 1:5 to 10:1 and each of the plurality of cleansing features has a substantially continuous contact surface of about 1 $mm^2$ to 5 $mm^2$ for stick-slip contacting skin and sliding across cell surfaces with a squeegee action, wherein the actuator is attached to the second major surface of the cleansing head to apply oscillating movement to one or more cleansing head sections comprising a total displacement per oscillation of about 0.5 mm to 8 mm, with the oscillating movement comprising a stick phase and a slip phase of cleansing action; and a cleanser selected from the group consisting of a liquid, dispersion, lotion, gel, serum, or solution that reduces the stick phase of the stick-slip action of a cleansing feature that has frictional contact with a skin surface during the oscillating movement of the cleansing head.

19. The system of claim 18, further comprising a control system connected to the electric motor for controlling one or more functions selected from the group consisting of: control of amplitude of oscillation of the substantially planar cleansing head; control of frequency of oscillation of the substantially planar cleansing head; duration of a treatment cycle or segment of a treatment cycle of the system; and a user display on the device.

20. The system of claim 18 wherein a cleansing feature has a shape of an inverting or non-inverting mushroom.

21. The system of claim 20 wherein each of the plurality of mushroom cleansing features has a substantially continuous circular contact surface with the skin of about 1 $mm^2$ to 5 $mm^2$.

22. A skin cleansing device comprising:

first and second skin cleansing head sections comprising first and second pluralities of elastomeric cleansing features, respectively, and a plurality of the cleansing features has a substantially continuous contact surface of about 1 $mm^2$ to 5 $mm^2$ for stick-slip contacting skin and sliding across cell surfaces with a squeegee action; and an opposing movement boundary defined by and disposed between the first and second skin cleansing head sections, wherein both the first and the second skin cleansing head sections are configured to translate relative to the other in a reciprocating motion in a plane common to the first and second skin cleansing head sections, said reciprocating motion comprising an oscillating movement providing relative displacement between the first and the second skin cleansing head sections, with the oscillating movement comprising a stick phase and a slip phase of cleansing action.

23. The skin cleansing device of claim 22, wherein the first and second cleansing head sections have a same pattern of features.

24. The skin cleansing device of claim 22, wherein the first skin cleansing head section is circular and the second skin cleansing head section is annular and disposed around the first skin cleansing head section.

25. The skin cleansing device of claim 22, wherein the reciprocating motion has a component in a direction perpendicular to the plane common to the first and second skin cleansing head sections.

* * * * *